US005378594A

United States Patent [19]

Okazaki et al.

[11] Patent Number: 5,378,594

[45] **Date of Patent: * Jan. 3, 1995**

[54] SILVER HALIDE COLOR PHOTOGRAPHIC MATERIAL

[75] Inventors: Kentaro Okazaki; Naoto Oshima; Kiyoto Takada, all of Minami-ashigara, Japan

[73] Assignee: Fuji Photo Film Co., Ltd., Kanagawa, Japan

[ * ] Notice: The portion of the term of this patent subsequent to Apr. 6, 2010 has been disclaimed.

[21] Appl. No.: 760,978

[22] Filed: Sep. 17, 1991

[30] Foreign Application Priority Data

| | | | |
|---|---|---|---|
| Sep. 18, 1990 | [JP] | Japan | 2-247926 |
| Oct. 4, 1990 | [JP] | Japan | 2-267039 |
| Oct. 16, 1990 | [JP] | Japan | 2-276771 |

[51] Int. Cl.[6] ..... G03C 7/392; G03C 1/04; G03C 1/035; G03C 1/09

[52] U.S. Cl. ..... 430/545; 430/546; 430/551; 430/552; 430/553; 430/556; 430/557; 430/567; 430/604; 430/605; 430/607; 430/613; 430/631; 430/638

[58] Field of Search ..... 430/545, 546, 607, 614, 430/, 613, 551, 624, 552, 553, 556, 557, 567, 631, 638, 604, 605

[56] References Cited

U.S. PATENT DOCUMENTS

| | | | |
|---|---|---|---|
| 3,679,630 | 7/1972 | Corson et al. | 528/21 |
| 3,782,952 | 1/1974 | Golda et al. | 430/280 |
| 4,239,851 | 12/1980 | Aoki et al. | 430/377 |
| 4,540,657 | 9/1985 | Krishnamurthy | 430/546 |
| 4,865,962 | 9/1989 | Hasabe et al. | 430/567 |
| 5,057,402 | 10/1991 | Shiba et al. | 430/567 |
| 5,200,307 | 4/1993 | Takahashi | 430/558 |

FOREIGN PATENT DOCUMENTS

| | | | |
|---|---|---|---|
| 0273430 | 7/1988 | European Pat. Off. . | |
| 0294149 | 12/1988 | European Pat. Off. . | |
| 0315833 | 5/1989 | European Pat. Off. . | |
| 60-96618 | 5/1985 | Japan . | |
| 1172417 | 7/1989 | Japan . | |
| 921071 | 3/1963 | United Kingdom | 430/624 |

*Primary Examiner*—Lee C. Wright

*Attorney, Agent, or Firm*—Birch, Stewart, Kolasch & Birch

[57] ABSTRACT

There is disclosed a silver halide color photographic material comprising at least one sparingly water-soluble epoxy compound represented by formula (I), (II), or (III) and a silver halide emulsion layer which comprises high-silver-chloride grains containing metal ions and/or having silver bromide localized phases on the surface thereof, and/or that have been sensitized by a gold compound:

Formula (I)

Formula (II)

Formula (III)

wherein $R^1$, $R^2$, and $R^3$ each represent a substituted or unsubstituted alkyl group or a halogen atom; $L^1$ and $L^2$ each represent a divalent aliphatic group, which may be substituted or unsubstituted; $M^1$ represents an oxygen atom or a nitrogen atom; A represents a polyvalent linking group; a, b, and c each are an integer of 0 to 4; x and y each are an actual number of 0 to 20; 1 is 1 or 2; and m represents an integer of 2 to 4.

66 Claims, No Drawings

SILVER HALIDE COLOR PHOTOGRAPHIC MATERIAL

FIELD OF THE INVENTION

The present invention relates to a silver halide color photographic material that, by using a sparingly water-soluble epoxy compound, has improved the preservability of the color image and improved latent-image keeping after storage for a long period of time. More particularly, the present invention relates to a silver halide color photographic material that is improved in fastness of the color image to heat, moisture, or acids, as well as improved in latent-image keeping after storage of the unexposed photographic material for a long period of time, which material is made by using the above mentioned compound. The present invention also relates to a silver halide color photographic material that is excellent in color image preservability and whose photographic performance changes little when the photographic material is kept for a long period of time and is processed continuously. The present invention further relates to a silver halide color photographic material that is capable of forming a stable image-dye free from unevenness even when subjected to developing processing for a latent-image that is kept for several days after an exposure to light.

BACKGROUND OF THE INVENTION

When color photographic materials are kept as records semipermanently, it is demanded that the extent of light-fading and dark-fading should be suppressed as much as possible and that the color balance of three-color fading among the yellow, magenta, and cyan dye images should be retained as in the initial state. However, the extent of light fading and the extent of dark fading are different between a yellow dye image, a magenta dye image, and a cyan dye image, and after storage for a long period of time the balance of fading among the three colors becomes lost and the qualities of the dye images unfavorably deteriorate.

Although the extent of light-fading and dark-fading varies naturally depending on the couplers used and other factors, with respect to dark-fading, in many cases, it is liable to occur in the order of a cyan dye image, a yellow dye image, and then a magenta dye image, and in particular the extent of dark-fading of a cyan dye image is great in comparison with the other dye images. Dark-fading of a yellow dye image in an environment high in humidity is greatest sometimes. Further, when a photographic material is stored under such conditions, mold occurs on the photographic material surface and the cyan dye image and the yellow dye image are faded extremely by organic acids (e.g., acetic acid, citric acid, tartaric acid, and gluconic acid) secreted from the fungi, thereby leaving red spots in the image, for example, of a color print. Such trouble is often found in areas high in temperature and humidity, for example in southern districts of Japan (e.g., in the Okinawa and Shikoku districts), and in the case of important photographs that are desired to be kept as records, such as wedding photographs, although a measure of laminating the photographs is taken, not only is the operation complicated and laborious but also deterioration of the image quality cannot be obviated. Even if mold does not occur, when the pH of the surface of the produced photographic image is low due to the type or scatter of conditions of the development processing, bleach-fix processing, or stabilization processing, fading of the cyan dye image and the yellow dye image is also facilitated.

In order to solve such problems, with respect to cyan dye images, for example, JP-B ("JP-B" means examined Japanese patent application) No. 45017/1983 and JP-A ("JP-A" means unexamined published Japanese patent application) Nos. 75447/1987, 129853/1987, 172353/1987, 196657/1987, and 21447/1989, and with respect to yellow dye images, JP-A Nos. 50048/1989, 50049/1989, and 4041/1986 disclose the use of cyclic ether compounds or epoxy-group-containing compounds, and although it is recognized that these compounds exhibit a certain effect for improving dark-fading and acid fading, the improvement is still unsatisfactory, and some photographic materials suffer such a harmful effect that fading or insufficient color restoration due to leuco dyes formation of cyan dyes, which are formed when the photographic materials are processed in a bleach-fixing bath containing exhausted solution.

The inventors further studied epoxy-group-containing compounds and found that, by using a sparingly water-soluble epoxy compound with a specific structure, a great effect on improvement in dark-fading and acid-fading could be attained. However, it has been found that photographic material containing such a sparingly water-soluble epoxy compound becomes poor in latent-image keeping with time after production of the photographic material, and that it has a harmful effect that the sensitivity and gradation change greatly depending on the period from the exposure to the development. On the other hand, nowadays, in big commercial photofinishing laboratories, due to the division of printing steps there is a tendency that the period from exposure to development is not always constant and the securement of latent-image keeping has become an important subject.

SUMMARY OF THE INVENTION

The object of the present invention is to provide a silver halide color photographic material that is improved in dark-fading of the color image, fading under high moisture, and fading due to acids, and that is capable of forming dye images that exhibit excellent image preserving property, and that is also improved in latent-image keeping even for the color photographic material after storage for a long period of time.

Another object of the present invention is to provide a silver halide color photographic material that is improved in dark-fading of the color image, fading under high moisture, and fading due to acids, and whose photographic performance changes less on long-term storage of the photographic material or when the photographic material is processed continuously.

Further, another object of the present invention is to provide a silver halide color photographic material that is improved in dark-fading of the color image, fading under high moisture, and fading due to acids, and that is capable of forming a stable color image free from unevenness of development of a latent-image even when subjected to development processing several days after the exposure to light.

The above and other objects, features, and advantages of the invention will become fully apparent in the following description.

DETAILED DESCRIPTION OF THE INVENTION

One of the preferred embodiments of the present invention is a silver halide color photographic material, which comprises at least one compound selected from the group consisting of sparingly water-soluble compounds represented by the following formula (I), (II), or (III), and a silver halide emulsion containing silver chlorobromoiodide, silver chlorobromide, or silver chloride comprising 90 mol % or more of silver chloride whose grains contain at least one metal ion of Group VIII of the Periodic Table in an amount of $10^{-9}$ to $10^{-2}$ mol per mol of the silver halide:

Formula (I)

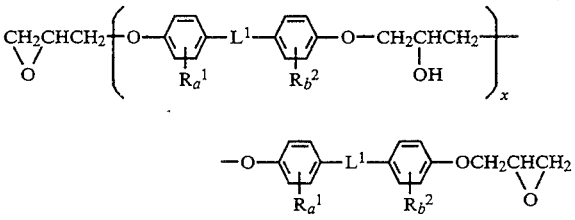

Formula (II)

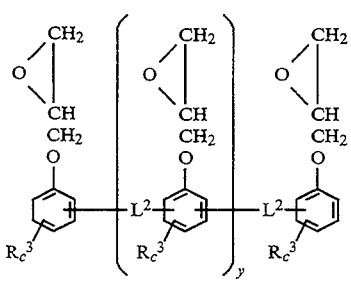

Formula (III)

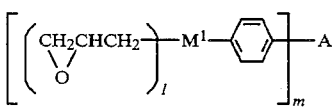

wherein $R^1$ $R^2$ and $R^3$ each represent an alkyl group, $L^1$ and $L^2$ each represent a divalent aliphatic group; $M^1$ represents an oxygen atom or a nitrogen atom; A represents a polyvalent linking group; a, b, and c each are an integer of 0 to 4; x and y each are an actual number of 0 to 20; l is 1 or 2; and m represents an integer of 2 to 4 (herein referred to first embodiment).

Another preferred embodiment of the present invention is a silver halide color photographic material comprising at least one of sparingly water-soluble epoxy compounds represented by formula (I), (II), or (III) and a silver chlorobromide emulsion substantially free from silver iodide and having a silver chloride content of 95 mol % or more, said silver chlorobromide having a silver bromide localized phase which has a silver bromide content of at least 10 mol % and is located near the surfaces of the silver halide grains (herein referred to second embodiment).

Further, another preferred embodiment of the present invention is a silver halide color photographic material which contains a support having thereon photographic constituting-layers comprising at least a non-photosensitive hydrophilic layer and at least a photosensitive silver halide emulsion layer, said silver halide emulsion being sensitized by a gold compound, and at least one sparingly water-soluble epoxy compound represented by formula (I), (II), or (III) being incorporated in at least one of said photographic constituting layers (herein referred to third embodiment).

In the present invention, particularly in the third embodiment of the present invention, a mercapto compound represented by the following formula (IV) is preferably used in at least one photographic constituting layer in order to improve the unevenness of development:

Formula (IV)

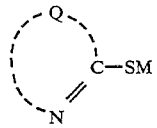

wherein Q represents an atomic group required to form a 5- or 6-membered heterocyclic ring, 5- or 6-membered heterocyclic ring with condensed benzene ring, and M represents a hydrogen atom or a cation.

The present invention will now be described in detail.

The epoxy compound represented by formula (I), (II), or (III) is described in more detail $R^1$, $R^2$, and $R^3$ each represent a halogen atom or a substituted or unsubstituted alkyl group, which may be straight chain or branched chain, wherein the number of carbon atoms is preferably 1 to 4, more preferably 1 to 2. $L^1$ and $L^2$ preferably each represent an alkylene group or a substituted alkylene group and the following structures can be mentioned:

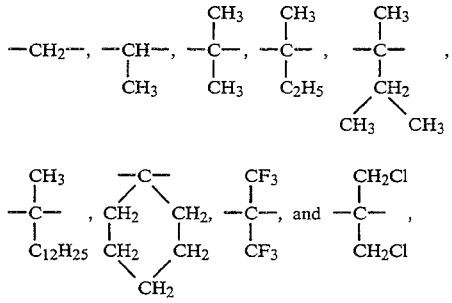

A preferably represent an alkylene group, a substituted alkylene group, an oxygen atom, a sulfur atom, a sulfonyl group, an oxycarbonyl group, an amido group, a phosphorus atom, a phosphoric group, a nitrogen atom, and a sulfonamido group and as examples the following can be mentioned: $-CH_2-$,

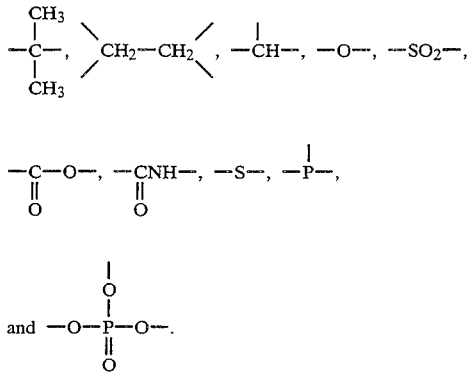

In this specification and claims, the term "sparingly water-soluble" means that the solubility at 25° C. in water is 10% or less. The epoxy compound of the present invention, together with a coupler or separately from a coupler, is used by emulsifying and dispersing it into a hydrophilic binder, such as an aqueous gelatin solution by using a surface-active agent. At that time, a high-boiling organic solvent having a boiling point of 160° C. or over or a low-boiling organic co-solvent, that are sparingly soluble in water, may be used. The coupler and the sparingly water-soluble epoxy compound can be added to separate layers but preferably they are added to the same layer, particularly to the same oil droplets.

Examples of the compounds represented by formulas (I), (II), and (III) that can be used in the present invention are shown below, but the present invention is not restricted to them.

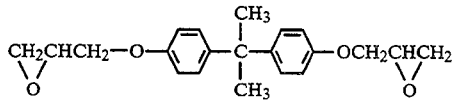

(I-1)

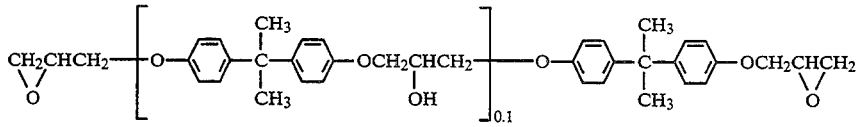

(I-2)

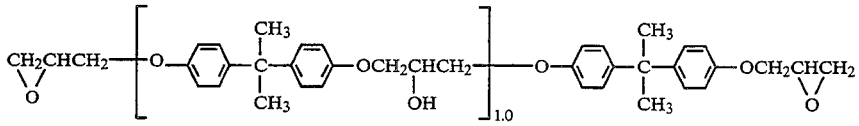

(I-3)

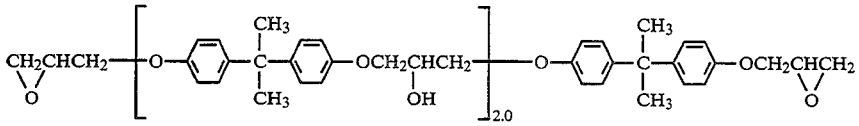

(I-4)

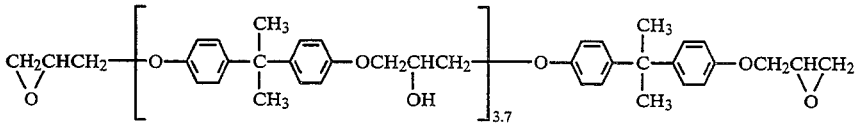

(I-5)

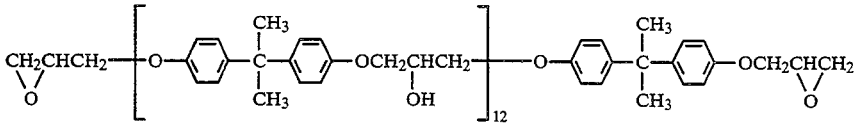

(I-6)

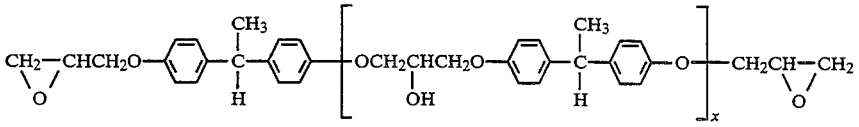

(I-7)

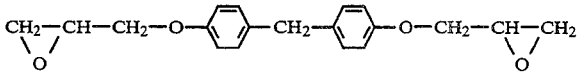

(I-8)

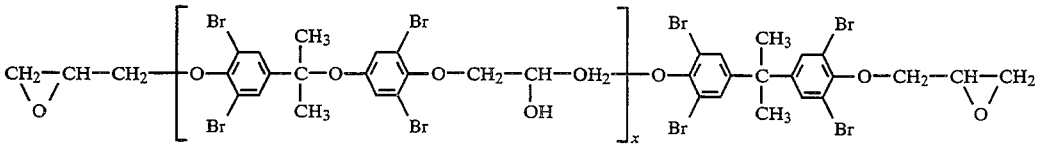

(I-9)

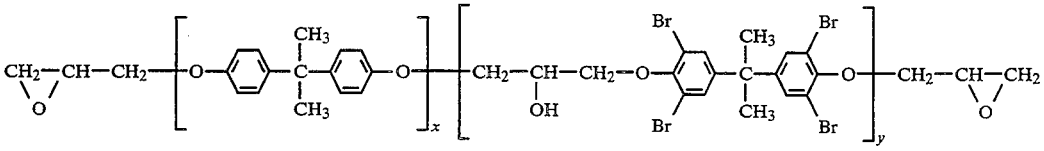

(I-10)

-continued
(I-11)
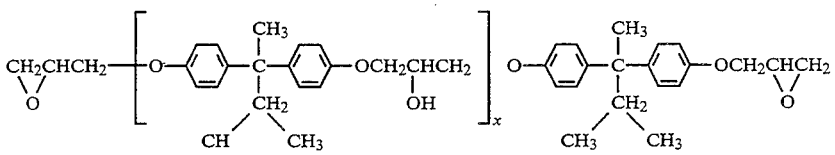
(I-12)
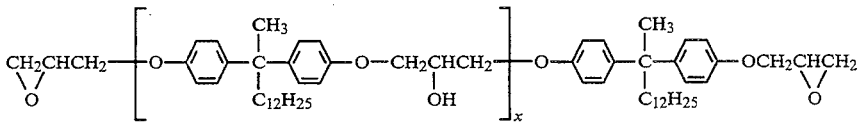
(I-13)
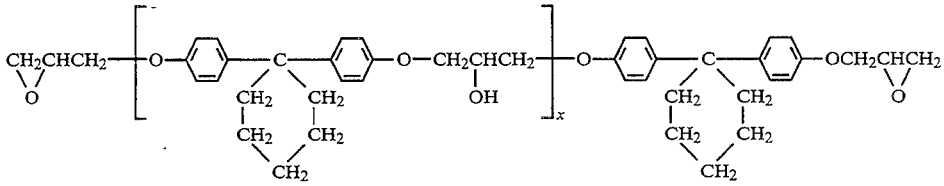
(I-14)
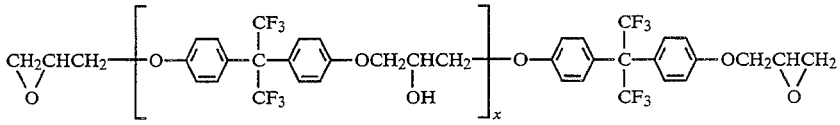
(II-1)
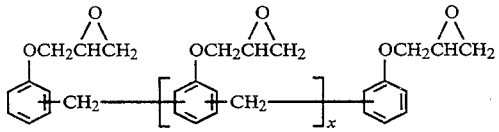
(II-2)
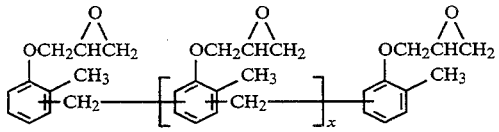
(II-3)
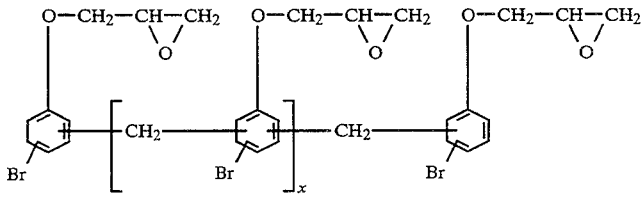
(III-1)
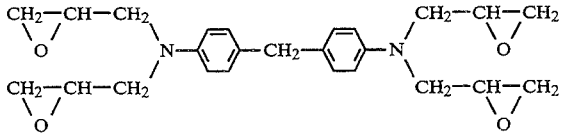
(III-2)
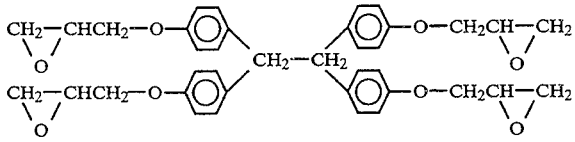
(III-3)
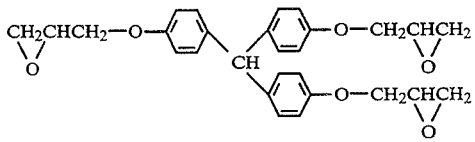

-continued

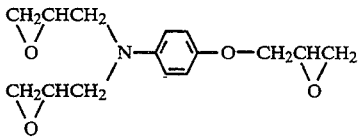

(III-4)

In the structural formulae, the variable x is a real number and may be any real number in the range of 0 to 20. The reason why x is not necessarily an integer is that epoxy compounds having different integral values are mixed in a certain ratio and the variable x is the average value of the different integral values. These epoxy compounds may be used alone or as a mixture of two or more, or they may be used in combination with a high-boiling organic solvent and/or a water-soluble and organic solvent-soluble polymer other than the epoxy compound of the present invention. Preferable examples of the high-boiling organic solvent and the polymer are those disclosed in JP-A No. 537/1989.

The above-mentioned epoxy resin used in the present invention is, for example, one obtained by reacting bisphenol A with epichlorohydrin in the presence of caustic soda (Naoshiro Ohishi, et al., "Purasucchiku Zairyo Koza (5), Epokishi Jushi" Nikkan Kogyo Shinbunsha). As this epoxy resin, a commercially available one can be used, for example Epikote (manufactured by Shell International Chemicals Corp.), Araldite (manufactured by Ciba Ltd.), Bakelite (manufactured by UCC), and DER (manufactured by Dow Chemical Co.), which are trade names.

Examples of the cyan coupler are described in JP-A No. 537/1989 in detail. As the pivaloylacetanilide two-equivalent coupler, those of the nitrogen coupling split-off type and the oxygen coupling split-off type are preferable.

The amount of the epoxy compounds of formulae (I) to (III) to be added is generally 0.001 to 10 g, preferably 0.01 to 5 g, and more preferably 0.03 to 1 g. The epoxy compound represented by formulae (I) to (III) may be preferably incorporated in a yellow coupler-containing layer or a cyan coupler-containing layer, more preferably in a cyan coupler-containing layer. The amount of the cyan coupler compound or the yellow coupler compound to be added is generally 0.1 to 1.0 mol, preferably 0.1 to 0.5 mol, per mol of the silver halide in the silver halide emulsion layer constituting a photosensitive layer.

The metal ion to be contained in the silver halide grains of the first embodiment of the present invention metal of Group VIII of the Periodic Table, such as iron, iridium, platinum, palladium, nickel, rhodium, osmium, ruthenium, and cobalt, preferably the iron ion, and more preferably the hexacyanoferrate(II) ion. Specific compound examples of these metal ions are given below, but the present invention is not restricted to them. Further, the ion of copper, gold, zinc, cadmium, or lead additionally used.

For example, ferrous arsenate, ferrous bromide, ferrous carbonate, ferrous chloride, ferrous citrate, ferrous fluoride, ferrous formate, ferrous gluconate, ferrous hydroxide, ferrous iodide, ferrous lactate, ferrous oxalate, ferrous phosphate, ferrous succinate, ferrous sulfate, ferrous thiocyanate, ferrous nitrate, ammonium ferrous nitrate, basic ferric acetate, ferric alubminate, ammonium ferric acetate, ferric bromide, ferric chloride, ferric chromate, ferric citrate, ferric fluoride, ferric formate, ferric glycerophosphate, ferric hydroxide, acid ferric phosphate, ferric nitrate, ferric phosphate, ferric pyrophosphate, sodium ferric pyrophosphate, ferric thiocyanate, ferric sulfate, ammonium ferric sulfate, guanidine ferric sulfate, ammonium ferric citrate, potassium hexacyanoferrate(II), potassium pentacyaniammineferrate(II), sodium ferric ethylenedinitrilotetraacetate, potassium hexacyanoferrate(III), ferric tris(dipyridyl) chloride, potassium pentacyanonitrosylferrate(II), ferric hexaurea chloride, iridium(III) chloride, iridium(IV) bromide, sodium hexachloroiridate(III), hexammineiridium(III) salt, hexammineiridium(IV) salt, trioxalatoiridate(III) salt, trioxalatoiridate(IV) salt, platinum(IV) chloride, potassium hexachloroplatinate(IV), tetrachloroplatinum(II) acid, tetrabromoplatinum(II) acid, sodium tetrakis(thiocyanato)platinate(VI), hexammineplatinum(IV) chloride, sodium tetrachloropalladinate(II), sodium tetrachloropalladinate(IV), potassium hexachloropalladinate(IV), tetramminepalladium(II) chloride, potassium tetracyanopalladinate(II), nickel chloride, nickel bromide, tetrachloronickel(II) acid, potassium tetrachloronickelate(II), hexamminenickel(II) chloride, sodium tetracyanonickelate(II), potassium hexachlororhodium, sodium hexabromorhodium, and ammonium hexachlororhodium may be used.

In order to incorporate the metal ions to be used in the present invention into localized phases and/or other grain parts (substrates) of silver halide grains, it is adequate that said metal ions are added to the solution preparation before or during the formation of the grains or during the physical ripening thereof. For example, the metal ion may be added to an aqueous gelatin solution, an aqueous halide solution, an aqueous silver salt solution, or other aqueous solution to form silver halide grains.

Additionally, the metal ion is allowed to be contained in silver halide fine grains previously, then the grains are added to a desired silver halide emulsion, and the finely divided silver halide is dissolved, so that the metal ions can be introduced. This method is effective particularly for introducing metal ions in silver bromide localized phases on silver halide grain surfaces. The method of the addition may be varied suitably depending on what position on the silver chloride grains the metal ions are to be positioned.

The amount of the metal ions to be used in the present invention is $10^{-9}$ mol or more, preferably as low as $10^{-9}$ mol but as high as $10^{-2}$ mol, and more preferably as low $10^{-8}$ but as high as $10^{-3}$ mol, per mol of the silver halide.

In the present invention, when the above epoxy compound is used, particularly in combination with a cyan coupler represented by the following formula (V) and a yellow coupler represented by the following formula (VI), the cyan dye image preservability and the yellow dye image preservability can be improved.

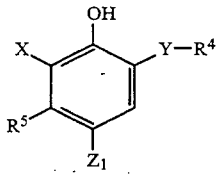

Formula (V)

wherein Y represents —NHCO— or —CONH—, $R^4$ presents an aliphatic group, an aromatic group, a heterocyclic group, or an amino group, X represents a hydrogen atom, a halogen atom, an alkoxy group, or an acylamino group, $R^5$ represents an alkyl group or an acylamino group or a group of atoms required to form a 5- to 7-membered ring together with X, and $Z_1$ represents a hydrogen atom or a group capable of being released when it reacts with the oxidized product of a developing agent.

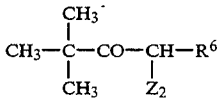

Formula (VI)

wherein $R^6$ represents an N-arylcarbamoyl group and $Z_2$ represents a group capable of being released upon a reaction thereof with the oxidized product of an aromatic primary amine developing agent.

The halogen composition of the silver halide grains of the present invention comprises silver bromochloride and silver chloride, substantially free from silver iodide, wherein preferably 90 mol % or more and more preferably 95 mol % or more of all silver halides constituting the silver halide grains is made up of silver chloride. Herein the term "substantially free from silver iodide" means that the silver iodide content is 1.0 mol % or less. A preferable halogen composition of the silver halide grains comprises silver bromochloride, substantially free from silver iodide, wherein 98 mol % or more of all silver halides constituting the silver halide grains is silver chloride.

The above-mentioned silver halide emulsion and the below-mentioned silver halide emulsion are preferably contained in the epoxy compound-containing layer.

The silver halide grains in the preferred embodiment of the present invention are required to have localized phases having a silver bromide content of at least 10 mol %. The arrangement of the localized phases having such a high silver bromide content is required to be located near the surfaces of the grains in order to allow the effect of the present invention to be exhibited, and also in view of the pressure properties, the processing solution composition dependency, etc. Herein the term "near the surfaces of the grains" means in a position within 1/5 of the grain size of the silver halide grains to be used, measured from the outermost surfaces. Preferably the position is within 1/10 of the grain size of the silver halide grains to be used, measured from the outermost surfaces. The most preferable arrangement of the localized phases high in silver bromide content is one wherein localized phases having a silver bromide content of at least 10 mol % are epitaxially grown on the corners of cubic or tetradecahedral silver halide grains.

Although in the preferred embodiment it is required that the localized phases high in silver bromide content have a silver bromide content of more than 10 mol %, if the silver bromide content is too high, in some cases, properties unpreferable for the photographic material are given; for example, desensitization is brought about when pressure is applied to the photographic material, or the sensitization or gradation changes greatly due to a change in the composition of a processing solution. Taking this into consideration, the silver bromide content of the localized phases high in silver bromide content is preferably in the range of 10 to 60 mol %, most preferably in the range of 20 to 50 mol %. The silver bromide content of the localized phases high in silver bromide content can be analyzed, for example, by X-ray diffractometry (e.g., described in *Shin-jikken Kagaku-koza*, Vol. 6, Kozokaiseki, edited by Nihonkagakukai, Maruzen). Preferably the localized phases high in silver bromide content are made up of 0.1 to 20%, more preferably 0.5 to 7%, of silver of all the silver constituting the silver halide grains of the present invention.

The interface between the localized phases high in silver bromide content and the other phases may have a distinct boundary or may have a transition region through which the silver halide composition changes gradually.

A variety of processes may be used to form such localized phases high in silver bromide content. For example, a soluble silver salt and a soluble halide may be reacted using the single-jet method or the double-jet method to form localized phases. Also the conversion method, wherein already formed silver halide grains are converted to silver halide grains having a lower solubility product, can be used to form localized phases. However, in order to cause the effect of the present invention to be exhibited, most preferably, cubic or tetradecahedral silver halide host grains are mixed with silver halide fine grains smaller in average grain diameter than that of the silver halide host grains and higher in silver bromide content than that of the silver halide host grains, followed by ripening, to form localized phases high in silver bromide content.

Preferably the formation of localized phases high in silver bromide content is carried out in the presence of an iridium compound. Herein the wording "the formation of localized phases is carried out in the presence of an iridium compound" means that an iridium compound is supplied simultaneously with, immediately before, or immediately after the supply of silver or a halogen for the formation of localized phases. In the case wherein silver halide fine grains smaller in average grain diameter than that of the silver halide host grains and higher in silver bromide content than that of the silver halide host grains are mixed, followed by ripening, to form localized phases high in silver bromide content, most preferably an iridium compound is allowed to be contained previously in the silver halide fine grains high in silver bromide content. Although it is possible to let all iridium compound be present at the time of the formation of phases other than localized phases high in silver bromide content, localized phases high in silver halide content are preferably formed together with at least 50%, most preferably at least 80%, of all the iridium to be added.

In the preferred embodiment of the present invention, it is required that, after the formation of localized phases high in silver bromide content, the surfaces are chemically sensitized. As such chemical sensitization, sulfur sensitization is preferably carried out, which may also be preferably used in combination with gold sensitization, reduction sensitization, or the like.

The chemical sensitization by sulfur that is used in the present invention is carried out by using active gelatin or a compound containing sulfur that is capable of reacting with silver (e.g., a thiosulfate, a thiourea, a mercapto compound, and a rhodanine). Specific examples thereof are described in U.S. Pat. Nos. 1,574,944, 2,278,947, 2,410,689, 2,728,668, and 3,656,955.

By incorporating an iridium compound in the silver halide grains of the present invention, the effect of the present invention can be made more conspicuous.

Although the iridium compound preferably used in the present invention may be added in any stage of the preparation of the silver halide grains, i.e., at the time of the formation or the growth of the nuclei, or before or after the physical ripening or the chemical sensitization, preferably the formation of localized phases high in silver bromide content is conducted in the presence of an iridium compound. The iridium compound may be added in portions. The iridium compound is used generally in the form of a metal salt or a metal complex salt, and preferably it is used by dissolving it in water or a suitable solvent. Examples of preferable compounds containing a trivalent or tetravalent iridium ion that are used to be contained in the silver halide emulsion are listed below, but the present invention is not restricted to them: hexachloroiridium-(III) or -(IV) acid salts, hexammineiridium-(III) or -(IV) acid salts, and trioxalatoiridium-(III) or -(IV) acid salts.

A combination of compounds containing iridium ions with different valences may be used. The amount of the iridium compound to be added is preferably in the range of $10^{-9}$ to $10^{-4}$ mol, most preferably in the range of $10^{-8}$ to $10^{-5}$ mol, per mol of the silver halide.

The effect of the present invention can be made more conspicuous by incorporating a metal complex of Fe, Ru, Rh, Re, Os, Ir, Pt, or Au that has at least two cyan ligands into the silver halide grains of the present invention.

The metal complex of Fe, Ru, Rh, Re, Os, Ir, Pt, or Au that has at least two cyan ligands to be used preferably in the present invention is preferably represented by the following formula (C-I) or (C-II):

Formula (C-I)

$[M_1(CN)_{6-a}L_a]^n$

Formula (C-II)

$[M_2(CN)_{4-b}L_b]^m$ wherein $M_1$ represents Fe, Ru, Rh, Re, Os, Ir, or Pt, $M_2$ represents Pt or Au, L represents a ligand excluding CN, a is 0.1 or 2, b is 0.1 or 2, n is −2, −3, or −4, and m is −1 or −2.

Among these, a metal complex represented by formula (C-I) is more preferably used. As $M_1$ in formula (C-I), Fe, Ru, Re, Os, or Ir is most preferable.

Specific examples of a metal complex that has at least two cyan ligands and is used in the present invention are shown below. As counter ions of these metal complexes, ammonium ions and alkali metal ions, such as sodium ions and potassium ions, are used preferably.

$[Fe(CN)_6]^{-3}$, $[Fe(CN)_6]^{-4}$, $[Ru(CN)_6]^{-4}$, $[Ru(CN)_5Cl]^{-4}$, $[Ru(CN)_4Cl_2]^{-4}$, $[Ru(CN)_5(H_2O)]^{-3}$, $[Rh(CN)_6]^{-3}$, $[Re(CN)_6]^{-4}$, $[Os(CN)_6]^{-4}$, $[Os(CN)_5Cl]^{-4}$, $[Os(CN)_4Cl_2]^{-4}$, $[OS(CN)_5Br]^{-4}$, $[OS(CN)_4Br_2]^{-4}$, $[Os(CN)_5(H_2)]^{-3}$, $[Ir(CN)_6]^{-3}$, $[Ir(CN)_5(H_2O)]^{-2}$, $[Pt(CN)_4]^{-2}$, $[Pt(CN)_4Cl_2]^{-2}$, $[Pt(CN)_4Br_2]^{-2}$, $[Au(CN)_4]^{-1}$, and $[Au(CN)_2Cl_2]^{-1}$.

Preferably, the content of at least one metal complex selected from the group consisting of metal complexes having at least two cyan ligands which are preferably used in the present invention is as low as $10^{-6}$ mol but as high as $10^{-3}$ mol, more preferably as low as $5\times10^{-6}$ mol but as high as $5\times10^{-4}$ mol, per mol of the silver halide.

At least one metal complex selected from the group consisting of metal complexes having at least two cyan ligands which are preferably used in the present invention may be incorporated by adding it in any stage of the preparation of the silver halide grains, i.e., at the time of the formation or the growth of the nuclei, or before or after the physical ripening or the chemical sensitization and it can be added in portions. However, preferably 50% or more of the total content of at least one metal complex selected from the group consisting of metal complexes having at least two cyan ligands that is contained in the silver halide grains is contained in the surface layer taking 50% or less of the grain volume. Herein the expression "the surface layer taking 50% or less of the grain volume" refers to the surface part corresponding to a volume taking 50% or less of the volume of one grain. The volume of the surface layer is preferably 40% or less, more preferably 20% or less. A further layer not containing any metal complex may be located outside the surface layer containing the metal complex defined above.

Preferably these metal complexes may be dissolved in water or in any suitable solvent, and the solution may be added directly to the reaction solution where silver halide grains are formed, or it may be added to an aqueous halide solution or aqueous silver salt solution for forming silver halide grains, or to a solution other than that, thereby forming grains. Also, preferably these metal complexes may be incorporated by adding silver halide fine grains in which the metal complex has been previously incorporated, then dissolving the silver halide fine grains, and then allowing them to deposit on other silver halide grains.

The silver halide grains of the present invention may be those having a (111) plane or (100) planes on the outer surfaces, or those having both (100) planes and a (111) plane, or those including more higher degree planes, but cubes or tetradecahedrons comprising mainly (100) planes are preferable.

Although the size of the silver halide grains of the present invention may be in the range generally used, preferably the average grain size is 0.1 to 1.5 μm. The grain diameter distribution may be polydisperse or monodisperse, with preference given to monodisperse. The grain size distribution that indicates the degree of the monodisperse distribution is preferably 0.2 or less, more preferably 0.15 or less, in terms of the ratio (s/d) of the statistical standard deviation (s) to the average grain size (d). Two or more monodisperse emulsions may be used in combination preferably.

Preferably the silver halide emulsion to be used in the third embodiment of the present invention comprises silver chloride or silver bromochloride substantially free from silver iodide and containing 90% or more of silver chloride. The expression "substantially free from silver iodide" means that the content of silver iodide is 0.5 mol % or less, preferably 0.1 mol % or less, and more preferably nil. Preferably the silver chloride content is 90% or more, further preferably 95 mol % or more, and particularly more preferably 98 mol % or more. An emulsion comprising pure silver chloride but containing a trace amount of polyvalent metal impurity ions is also preferable.

If the silver chloride emulsion of the present invention contains silver bromide, it may take various forms. That is, the silver bromide may be distributed uniformly throughout the silver halide grains, to form a so-called solid solution, or phases containing the silver bromide may be present ununiformly in the grains. In the latter case the phases containing the silver bromide may take various shapes. For example, the phases may form a so-called layered structure, wherein the phases different in silver bromide content form a core or a shell, or the phases containing much silver bromide may form separate localized phases in the grains or in part of the surfaces of the grains.

One kind or more kinds of polyvalent impurity ions may be included into the silver halide emulsion of the present invention when the grains are formed, in order to obtain high sensitivity and high contrast. Examples of the polyvalent impurity ions include salts or complex salts of the ion of a transition metal of group VIII, such as iron, cobalt, nickel, ruthenium, rhodium, palladium, osmium, iridium, or platinum, and salts of the ion of a divalent metal, such as copper, zinc, and cadmium.

The average grain size of the silver halide grains contained in the silver halide emulsion used in the present invention (the diameters of circles equivalent to the projected areas of the grains are assumed to be the grain sizes and the number average thereof is taken) is preferably 0.1 μm to 2 μm.

The particle size distribution is preferably a so-called monodisperse distribution that has a deviation coefficient of 20% or less, desirably 15% or less (the deviation coefficient being obtained by dividing the standard deviation of the grain size distribution by the average grain size). In this case, in order to obtain a wide latitude, it is also preferable that such monodisperse emulsions are used by blending them in the same layer or that they are applied in layers.

With respect to the shape of the silver halide grains contained in the photographic emulsion, use may be made of a regular crystalline form, such as a cubic form, a tetradecahedral form, or an octahedral form, or an irregular crystalline form such as a spherical form or a tabular form, or a composite form of these. Also a mixture of various crystalline forms can be used. In the present invention, out of these, those containing 50% or more, preferably 70% or more, and more preferably 90% or more, of the above regular crystalline form are favorable.

The silver chlorobromide emulsion or the silver chloride emulsion used in the present invention can be prepared by methods described, for example, by P. Glafkides in *Chimic et Phisique Photographique* (published by Paul Montel, 1967), by G. F. Duffin in *Photographic Emulsion Chemistry* (published by Focal Press, 1966), and by V. L. Zelikman in *Making and Coating Photographic Emulsion* (published by Focal Press, 1964). That is, any of the acid process, the neutral process, the ammonia process, etc., can be used, and in order to react a soluble silver salt and a soluble halide, for example, any of the single-jet process, the double-jet process, or a combination of these can be used. A process of forming grains in an atmosphere having excess silver ions, the so-called reverse precipitation process, can also be used. A process wherein the silver ion concentration in the liquid phase, in which a silver halide is to be formed, is kept constant, that is, the so-called controlled double-jet process, is more preferably used as one type of the double-jet process. According to the controlled double-jet process, a silver halide emulsion wherein the crystal form of the silver halide is regular and the grain sizes are nearly monodisperse can be obtained.

The silver halide emulsion used in the present invention is chemically sensitized and also spectrally sensitized.

The silver halide emulsion of the present invention must be chemically sensitized by using a gold compound, the gold oxidation number of the gold compound to be used may be monovalent or trivalent, and a variety of gold compounds may be used. Typical examples include tetrachloroauric(III) acid, tetracyanoauric(III) acid, or tetrakis(thiocyanato)auric(III) acid, or their alkali metal salts, a complex ion or a complex salt of bis(thiosulfato)aurous(I) acid or chlorodimethylrhodanato aurous(I) acid.

Although the amount of these gold compounds to be added may vary from case to case, generally it is in the range of $1\times10^{-7}$ to $1\times10^{-2}$ mol, preferably $1\times10^{-6}$ to $1\times10^{-3}$ mol, and more preferably $2\times10^{-6}$ to $1\times10^{-4}$ mol, per mol of the silver halide.

The addition of these gold compounds is carried out when the silver halide emulsion is prepared, and preferably the addition is carried out before the completion of chemical sensitization.

The silver halide emulsion of the present invention may be sensitized by a combination of chemical sensitization utilizing gold compound above-described with a so-called sulfur sensitization, selenium sensitization, reduction sensitization, or noble metal sensitization.

Compounds that can be mentioned for use in sulfur sensitization include thiosulfates, rhodanines, thioureas, or thioamides (compounds described in, for example, U.S. Pat. Nos. 2,410,689, 3,501,313, 2,278,947, 1,574,944, 2,728,668, 3,656,955, 4,001,025, and 4,116,697, and JP-A No. 45016/1980), thioesters (compounds described in, for example, JP-B Nos. 13485/1968 and 42374/1980, and British Patent No. 1,190,678), and polysulfur compounds (compounds described in, for example, U.S. Pat. Nos. 3,647,469, 3,656,955, and 3,689,273, JP-A No. 81230/1978, and JP-B Nos. 20533/1974 and 45134/1984).

As compounds for use in selenium sensitization, selenium compounds described in, for example, JP-A No. 150046/1985 can be mentioned.

Compounds that can be mentioned for use in reduction sensitization include inorganic reducing agents, such $SnCl_2$, $NaBH_4$, etc., amines, hydrazines, formamidinesulfinic acids, silane compounds (compounds described in, for example, U.S. Pat. Nos. 2,518,698, 2,743,182, 3,369,904, 2,666,700, 2,419,973, 2,419,974, 2,419,975,2,740,713, 2,521,926, 2,487,850, 2,983,609, 2,983,610, 2,694,637, 3,930,867, and 3,904,540, British Patent No. 1,390,540, and JP-A Nos. 127622/1975 and 163232/1982), and aldehydes (compounds described in, for example, U.S. Pat. No. 2,604,397).

Compounds that can be mentioned for use is noble metal sensitization include, in addition to gold compound of the present invention, complex compounds of transition elements of Group VIII of the Periodic Table, such as platinum, iridium, and palladium (compounds described in, for example, U.S. Pat. Nos. 2,399,083, 2,448,060, 3,503,749, 2,597,856, 2,597,915, 2,634,674, and 2,642,361, and British Patent No. 618,061).

The spectral sensitization is carried out for the purpose of providing the emulsions of the layers of the photographic material of the present invention with spectral sensitivities in desired wavelength regions. In the present invention, the spectral sensitization is preferably carried out by adding dyes that absorb light in the wavelength ranges corresponding to the desired spectral sensitivities, that is, by adding spectrally sensitizing dyes. As the spectrally sensitizing dyes used herein, for example, those described by F. M. Harmer in *Heterocyclic compounds—Cyanine dyes and related compounds* (published by John Wiley & Sons [New York, London], 1964) can be mentioned. As specific examples of the compounds and the spectral sensitization method, those described in the above JP-A No. 215272/1987, page 22 (the right upper column) to page 38, are preferably used.

To the silver halide emulsion of the present invention, various compounds or their precursors can be added in order to prevent fogging of the photographic material during its preparation, during the storage of the prepared photographic material, or during the development processing thereof, or in order to stabilize the photographic performance. Specific examples of these compounds are described in the above-mentioned JP-A No. 215272/1987, pages 39 to 72, which are preferably used.

The addition of at least one of compounds represented by the following formulas (AII) to (AIV) to the silver halide emulsion of the present invention is remarkably effective in preventing fogging from increasing, in particular fogging in the case of the use of a gold sensitizer. Although the addition can be made at the step of the formation of grains, at the step of desalting, at the step of chemical ripening, or immediately before the application, the addition is preferably made at the step of the formation of grains, at the step of desalting, or at the step of chemical ripening, and in particular before the addition of a gold sensitizer.

Compounds having a thiosulfonyl group represented by formula (AII), (AIII), or (AIV) will now be described.

Formula (AII)

$Q_1—SO_2S—M_3$

Formula (AIII)

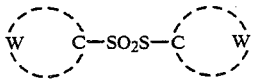

Formula (AIV)

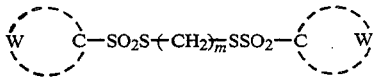

wherein $Q_1$ represents an alkyl group, an aryl group, or a heterocyclic group, which may be substituted, W represents a group of atoms required to form an aromatic ring or a heterocyclic ring, which may be substituted, $M_3$ represents a metal atom or an organic cation, and m is an integer of 2 to 10.

Substituents that may be substituted on the above alkyl group, aryl group, aromatic ring, and heterocyclic ring include, for example, a lower alkyl group, such as a methyl group and an ethyl group; an aryl group, such as a phenyl group; an alkoxy group having 1 to 8 carbon atoms; a halogen atom, such as chlorine; a nitro group; an amino group; and a carboxyl group.

The number of carbon atoms of the alkyl group represented by $Q_1$ is 1 to 18, and the number of carbon atoms of the aryl group or aromatic ring represented by each of $Q_1$ and W is 6 to 18.

The heterocyclic ring represented by each of Q and W includes, for example, a thiazole ring, a benzthiazole ring, an imidazole ring, a benzimidazole ring, and an oxazole ring.

As the metal cation represented by $M_1$, an alkali metal ion, such as a sodium ion and a potassium ion, is preferable, and as the organic cation represented by $M_1$, an ammonium ion and a guanidinium ion are preferable.

Specific examples of the compound represented by formula (AII), (AIII), or (AIV) are listed below:

(A-1)

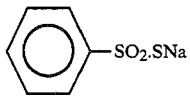

(A-2)

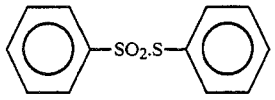

(A-3)

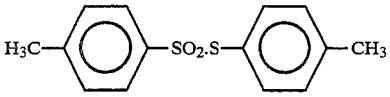

(A-4)

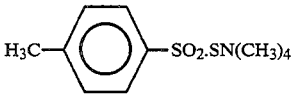

$H_3C.SO_2.SNa$ (A-5)

(A-6)

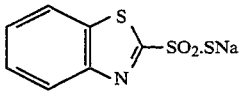

(A-7)

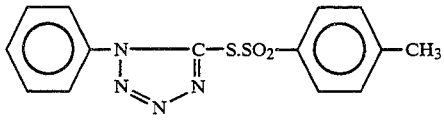

(A-8)

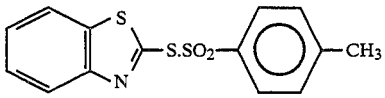

(A-9)

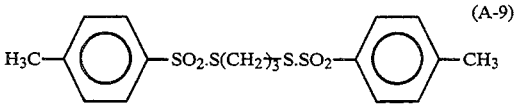

(A-10)

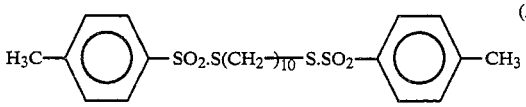

L-Cystine-disulfoxide (A-11)

$H_5C_2.SO_2.S.K$ (A-12)

$H_{17}C_8.SO_2.SNa$ (A-13)

Compounds represented by formulae (AII), (AIII), and (AIV) can be used in combination with sulfites and sulfinates, such as alkyl sulfinates, aryl sulfinates, and heterocylic sulfinates.

The compound represented by formula (IV) used in the present invention will now be described in detail.

In formula (IV), Q represents an atom selected from the group of atoms required to form a 5- or 6-membered heterocyclic ring or a 5- or 6-membered heterocyclic ring in which a benzene ring has been condensed, and the heterocyclic ring formed by Q includes, for example, an imidazole ring, a tetrazole ring, a thiazolean oxazole ring, a selenazole ring, a benzimidazole ring, a naphthoimidazole ring, a benzthiazole ring, a naphthothiazole ring, a benzoselenazole ring, anaphthoselenazole ring, and a benzoxazole ring.

As the cation represented by M, alkali metal (e.g., sodium and potassium) and ammonium radicals can be mentioned.

As the mercapto compound represented by formula (IV), mercapto compounds represented by the following formulas (IV-1), (IV-2), (IV-3), and (IV-4) are preferable.

Formula (IV-1)

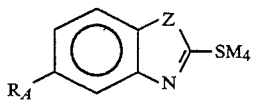

wherein $R_A$ represents a hydrogen atom, an alkyl group, an alkoxy group, an aryl group, a halogen atom, a carboxyl group or its salt, a sulfo group or its salt, or an amino group, Z represents —NH—, —O—, or —S—, and $M_4$ has the same meaning as that of $M_4$ in formula (IV).

Formula (IV-2)

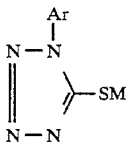

wherein Ar represents

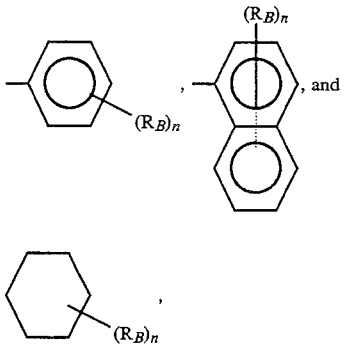

$R_B$ represents an alkyl group, an alkoxy group, a carboxyl group or its salt, a sulfo group or its salt, a hydroxyl group, an amino group, an acylamino group, a carbamoyl group, or a sulfonamido group, n is an integer of 0 to 2, and M has the same meaning as that of M in formula (IV).

In formulas (IV-1) and (IV-2), as the alkyl group represented by each of $R_A$ and $R_B$, for example, a methyl group, an ethyl group, and a butyl group can be mentioned; as the alkoxy group represented by each of $R_A$ and $R_B$, for example, a methoxy group and an ethoxy group can be mentioned, and as the salts of the carboxyl group or the sulfo group represented by each of $R_A$ and $R_B$, for example, the sodium salt and the ammonium salt can be mentioned.

In formula (IV-1), as the aryl group represented by $R_A$, for example, a phenyl group and a naphthyl group can be mentioned, and as the halogen atom represented by $R_A$, for example, a chlorine atom and a bromine atom can be mentioned.

In formula (IV-2), the acylamino group represented by $R_B$ includes, for example, a methylcarbonylamino group and a benzoylamino group, the carbamoyl group includes, for example, an ethylcarbamoyl group and a phenylcarbamoyl group, and the sulfonamido group includes, for example, a methylsulfonamido group and a phenylsulfonamido group.

The alkyl group, the alkoxy group, the aryl group, the amino group, the acylamino group, the carbamoyl group, the sulfonamido group, etc. that are mentioned above may be substituted.

Formula (IV-3)

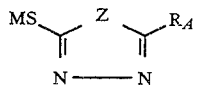

wherein Z represents

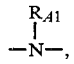

an oxygen atom, or a sulfur atom, $R_4$ represents an alkyl group, an aryl group, an alkenyl group, a cycloalkyl group, —$SR_{A1}$,

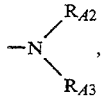

—$NHCOR_{A4}$,—$NHSO_2R_{A5}$, or a heterocyclic group, $R_{A1}$ represents a hydrogen atom, an alkyl group, an alkenyl group, a cycloalkyl group, an aryl group, -$COR_{A4}$, or —$SO_2R_{A5}$, $R_{A2}$ and $R_{A3}$ each represent a hydrogen atom, an alkyl group, or an aryl group, $R_{A4}$ and $R_{A5}$ each represent an alkyl group or an aryl group, and M has the same meaning as that of M in formula (IV).

As the alkyl group represented by each of $R_A$, $R_{A1}$, $R_{A2}$, $R_{A3}$, $R_{A4}$, and $R_{A5}$, for example, a methyl group, a benzyl group, an ethyl group, and a propenyl group can be mentioned, and as the aryl group, for example, a phenyl group and a naphthyl group can be mentioned.

As the alkenyl group represented by each of $R_A$ and $R_{A1}$, for example, a propenyl group can be mentioned, and as the cycloalkyl group, for example, a cyclohexyl group can be mentioned. As the heterocyclic group represented by $R_A$, for example, a furyl group and a pyridinyl group can be mentioned.

The alkyl group and the aryl group represented by each of $R_A$, $R_{A1}$, $R_{A2}$, $R_{A3}$, $R_{A4}$, and $R_{A5}$, the alkenyl group and the cycloalkyl group represented by each of $R_A$ and $R_{A1}$, and the heterocyclic group represented by $R_A$ may be substituted.

Formula (IV-4)

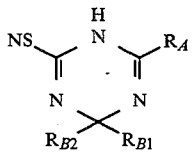

wherein $R_A$ and M each have the same meaning as that of each of $R_A$ and M in formula (IV-3), and $R_{B1}$ and $R_{B2}$ each have the same meaning as that of each of $R_{A1}$ and $R_{A2}$ in formula (IV-3).

Specific examples of the compound represented by formula (IV) are given below, but the present invention is not restricted to them.

IV-1-1

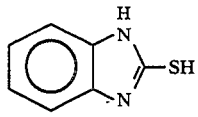

IV-1-2

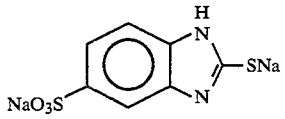

IV-1-3

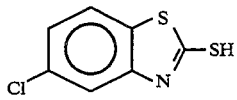

IV-1-4

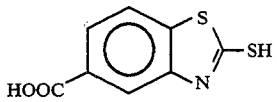

IV-1-5

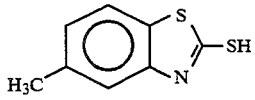

IV-1-6

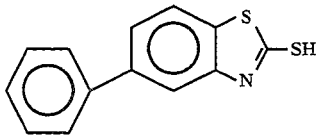

IV-1-7

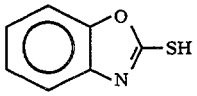

IV-1-8

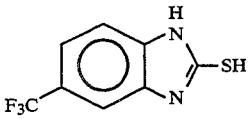

IV-2-1

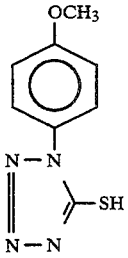

-continued

IV-2-2

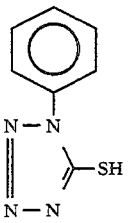

IV-2-3

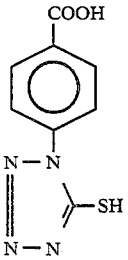

IV-2-4

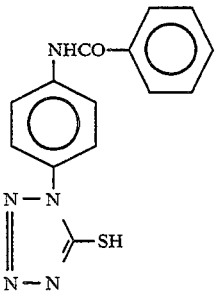

IV-2-5

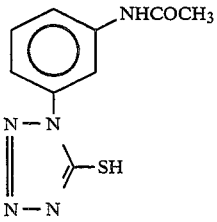

IV-2-6

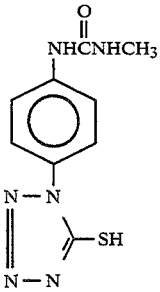

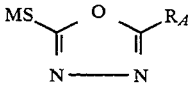

| Exemplified Compound | $R_A$ | M |
|---|---|---|
| IV-3-1 | $-C_2H_5$ | —H |
| IV-3-2 | $-CH_2-CH=CH_2$ | —H |
| IV-3-3 | $-CH=CH-CH_2-CH_3$ | —H |
| IV-3-4 | $-C_7H_{15}$ | —H |
| IV-3-5 | $-C_9H_{19}$ | —Na |

-continued
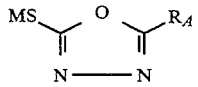
| Exemplified Compound | $R_A$ | M |
|---|---|---|
| IV-3-6 | 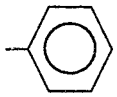 | —H |
| IV-3-7 | $-C_4H_9(t)$ | —H |
| IV-3-8 | 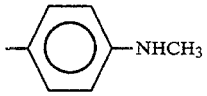 | —H |
| IV-3-9 | 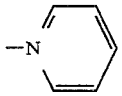 | —H |
| IV-3-10 | 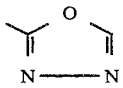 | —H |
| IV-3-11 | 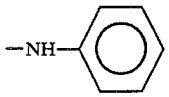 | —H |
| IV-3-12 | 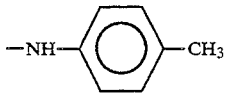 | $-NH_4$ |
| IV-3-13 | $-NHCOCH_3$ | —H |
| IV-3-14 | 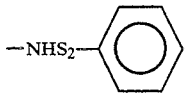 | —H |
| IV-3-15 | $-N(CH_3)_2$ | —H |
| IV-3-16 | 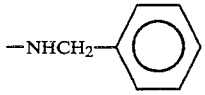 | —H |
| IV-3-17 | 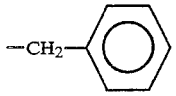 | —H |
| IV-3-18 | $-S-SH_3$ | —H |
| IV-3-19 | 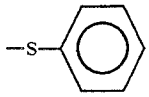 | —H |
| IV-3-20 | —SH | —H |
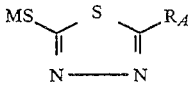
| Exemplified Compound | $R_A$ | M |
|---|---|---|
| IV-3-21 | —H | —H |
| IV-3-22 | $-C_2H_5$ | —H |
| IV-3-23 | $-C_4H_9(t)$ | —H |
| IV-3-24 | $-C_6H_{13}$ | —H |
| IV-3-25 | 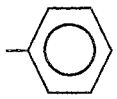 | —H |
| IV-3-26 | 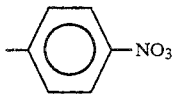 | —H |
| IV-3-27 | 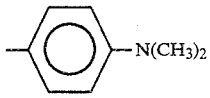 | —H |
| IV-3-28 | 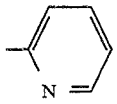 | —H |
| IV-3-29 | 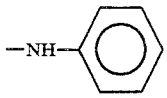 | —H |
| IV-3-30 | $-NH_2$ | —H |
| IV-3-31 | $-CH_2CH-CH_2$ | —H |
| IV-3-32 | —SH | —H |
| IV-3-33 | $-NHCOC_2H_5$ | —H |
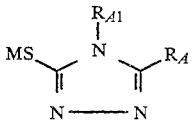
| Exemplified Compound | $R_A$ | $R_{A1}$ | M |
|---|---|---|---|
| IV-3-34 | $-C_2H_5$ | —H | —H |
| IV-3-35 | $-CH_3$ | $-CH_3$ | —H |
| IV-3-36 | $-CH_3$ | 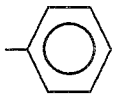 | —H |
| IV-3-37 | $-NHCOCH_3$ | $-CH_3$ | —H |
| IV-3-38 | 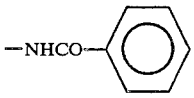 | 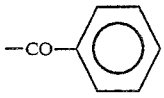 | —H |
| IV-3-39 | $-NHCOCH_3$ | $-COCH_3$ | —H |

-continued

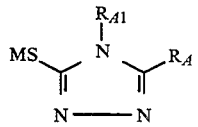

| Exemplified Compound | $R_A$ | $R_{A1}$ | M |
|---|---|---|---|
| IV-3-40 | $-NHCOCH_3$ | $-CH_2-$ 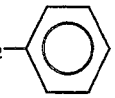 | $-H$ |

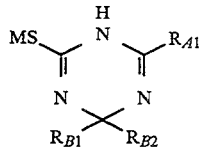

| Exemplified Compound | $R_{A1}$ | $R_{B1}$ | $R_{B2}$ | M |
|---|---|---|---|---|
| IV-4-1 | $-C_2H_5$ | $-CH_3$ | $-CH_3$ | $-H$ |
| IV-4-2 | 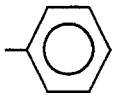 | $-CH_3$ | $-CH_3$ | $-H$ |
| IV-4-3 | $-NH_2$ | $-H$ | 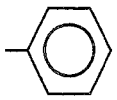 | $-H$ |
| IV-4-4 | 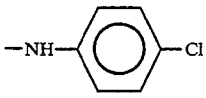 | $-H$ | $-C_4H_9$ | $-H$ |
| IV-4-5 | $-NHCOCH_3$ | $-CH_3$ | $-CH_3$ | $-H$ |
| IV-4-6 | 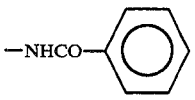 | $-CH_3$ | $-CH_3$ | $-H$ |
| IV-4-7 | 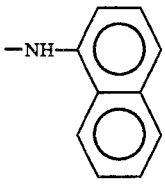 | $-CH_3$ | $-C_3H_7(i)$ | $-H$ |
| IV-4-8 | 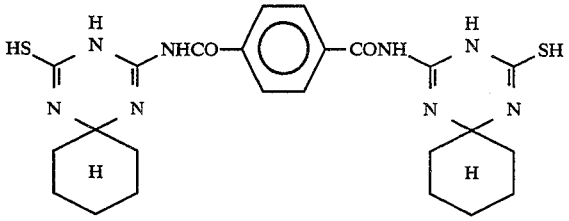 | | | |

The amount of compound represented by formula (IV) to be added is preferably $1\times10^{-5}$ to $5\times10^{-2}$, more preferably $1\times10^{-4}$ to $1\times10^{-2}$ per mol of silver halide. Although the layer in which the compound is to be added is not particularly restricted, the compound is preferably contained in a non-photosensitive hydrophilic layer between a yellow coupler-containing layer and a cyan coupler-containing layer. Further, the method of addition is also not particularly restricted, the compound may be added during any of grain formation of silver halide, physical ripening, chemical ripening, and preparation of coating solution.

The silver halide emulsion to be used in the present invention is generally chemically sensitized and also spectrally sensitized.

The chemical sensitization can be carried out, for example, by sulfur sensitization, typically by the addition of an unstable sulfur compound, or by noble metal sensitization, typically by gold sensitization, or reduction sensitization, which method may be used alone or in combination. With respect to compounds that are used in combination such chemical sensitization, those described in JP-A No. 215272/1987, page 18, right lower column, to page 22, right upper column, are preferably used.

The metal ions to be contained in the silver halide grains of the present invention may be present uniformly in the grains or may be contained in localized phases that are formed, and when the metal ions are of an iron compound, they are preferably concentrated in the surface layer constituting 50%, more preferably 40%, and most preferably 20%, of the grain volume. Making the volume of the surface layer as small as possible (i.e., to make the surface layer as thin as possible) allows the effect of the present invention to be exhibited remarkably.

In the photographic material of the present invention, in order to improve, for example, the sharpness of an image, preferably a dye that can be processed to be decolored (in particular an oxonol dye), as described in European Patent EP 0,337,490A2, pages 27 to 76, is added to the hydrophilic colloid layer, so that the optical reflection density of the photographic material at 680 nm may be 0.7 or over, or titanium oxide, whose surface has been treated with a dihydric to tetrahydric alcohol (e.g., trimethylolethane) is contained in an amount of 12% by weight or more (more preferably 14% by weight or more) in the water resistant resin layer of the base.

In the photographic material of the present invention, an image dye lasting quality improving compound, as described in European Patent EP 0,277,589A2, is preferably used in combination with the coupler.

In particular, a combination with a pyrazoloazole coupler is preferable.

That is, the use of a compound (F) which will chemically combine with the aromatic primary amine developing agent remaining after color development processing to produce a chemically inactive and substantially colorless compound, and/or a compound (G) which will chemically combine with the oxidized product of the aromatic primary amine developing agent remaining after color development processing to produce a chemically inactive and substantially colorless compound, is preferable, because, for example, the occurrence of stain due to the production of a color-formed dye by the reaction between the coupler and the color developing agent remaining in the film or its oxidized product and other side effects on storage after the processing can be prevented.

Preferable as compound (F) are those that can react with p-anisidine at the second-order reaction-specific rate $k_2$ (in trioctyl phosphate at 80° C.) in the range of 1.0 1/mol.sec to $1\times10^{-5}$ 1/mol.sec. The second-order reaction-specific rate can be determined by the method described in JP-A No. 158545/1983.

If $k_2$ is over this range, the compound itself becomes unstable, and in some cases the compound reacts with gelatin or water to decompose. On the other hand, if $k_2$ is below this range, the reaction with the remaining aromatic amine developing agent becomes slow, resulting, in some cases, in the failure to prevent the side effects of the remaining aromatic amine developing agent, which prevention is aimed at by the present invention.

More preferable as compound (F) are those that can be represented by the following formula (FI) or (FII):

Formula (FI)

$R_{21}-(A_1)_n-X_{21}$

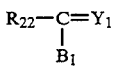

Formula (FII)

wherein $R_{21}$ and $R_{22}$ each represent an aliphatic group, an aromatic group, or a heterocyclic group, n is 1 or 0, $A_1$ represents a group that will react with an aromatic amine developing agent to form a chemical bond therewith, $X_{21}$ represents a group that will react with the aromatic amine developing agent and split off, $B_1$ represents a hydrogen atom, an aliphatic group, an aromatic group, a heterocyclic group, an acyl group, or a sulfonyl group, $Y_1$ represents a group that will facilitate the addition of the aromatic amine developing agent to the compound represented by formula (FII), and $R_{21}$ and $X_{21}$, or $Y_1$ and $R_{22}$ or $B_1$, may bond together to form a ring structure.

Of the processes wherein compound (F) bonds chemically to the remaining aromatic amine developing agent, typical processes are a substitution reaction and an addition reaction.

Specific examples of the compounds represented by formulae (FI), and (FII) are described, for example, in JP-A Nos. 158545/1988, 283338/1987, European Published Patent Nos. 298,321 and 277,589.

On the other hand, more preferable examples of compound (G), which will chemically bond to the oxidized product of the aromatic amine developing agent remaining after color development processing, to form a chemically inactive and colorless compound, can be represented by the following formula (GI):

Formula (GI)

$R_{23}-Z$ wherein $R_{23}$ represents an aliphatic group, an aromatic group, or a heterocyclic group, Z represents a nucleophilic group or a group that will decompose in the photographic material to release a nucleophilic group. Preferably the compounds represented by formula (GI) are ones wherein $^{n}CH_3I$ value (R. G. Pearson, et al., *J. Am. Cem. Soc.*, 90, 319 (1968)) is 5 or over, or a group derived therefrom.

Specific examples of compounds reprsented by formula (GI) are described, for example, in European Published Patent No. 255722, JP-A Nos. 143048/1987 and 229145/1987, Japanese Patent Application Nos. 136724/1988 and 214681/1987, and European Published Patent Nos. 298,321 and 277,589.

Details of combinations of compound (G) and compound (F) are described in European Published Patent No. 277,589.

To the photographic material according to the present invention, a mildew-proofing agent, as described in JP-A No. 271247/1988, is preferably added in order to prevent the growth of a variety of mildews and fungi that will propagate in the hydrophilic colloid layer and deteriorate the image.

As a base to be used for the photographic material of the present invention, a white polyester base for display may be used, or a base may be used wherein a a white pigment is placed on the side that will have the silver halide emulsion layer. Further, in order to improve sharpness, preferably an anti-halation layer is applied on the side of the base where the silver halide emulsion layer is applied or on the undersurface of the base. In particular, preferably the transmission density of the base is set in the range of 0.35 to 0.8, so that the display can be appreciated through either reflected light or transmitted light.

The photographic material of the present invention may be exposed to visible light or infrared light. The method of exposure may be low-intensity exposure or high-intensity short-time exposure, and particularly in the latter case, the laser scan exposure system, wherein the exposure time per picture element is less than $10^{-4}$ sec is preferable.

When exposure is carried out, the band stop filter, described in U.S. Pat. No. 4,880,726, is preferably used. Thus, light color mixing is eliminated and the color reproduction is remarkably improved.

The exposed photographic material may be subjected to conventional black-and-white development processing or color processing, and in the case of a color photographic material, preferably it is subjected to color development processing and then is bleached and fixed for the purpose of rapid processing. In particular, when the above-mentioned high-silver-chloride emulsion is used, the pH of the bleach-fix solution is preferably about 6.5 or below, more preferably about 6 or below, for the purpose of the acceleration of desilvering, etc.

With respect to silver halide emulsions, other materials (e.g., additives) and photographic component layers (e.g., layer arrangement) that will be applied to the photographic material of the present invention, as well as processing methods and processing additives that will be applied to the photographic material of the present invention, particularly those described in below-mentioned patent publications, particularly in European Patent EP 0,355,660A2 (JP-A No. 107011/1989), are preferably used.

| Element constituting photographic material | JP-A No. 215272/1987 | JP-A No. 33144/1990 | EP 0,355,660A2 |
|---|---|---|---|
| Silver halide emulsion | p. 10 upper right column line 6 to p. 12 lower left | p. 28 upper right column line 16 to p. 29 lower right | p. 45 line 53 to p. 47 line 3 and |

-continued

| Element constituting photographic material | JP-A No. 215272/1987 | JP-A No. 33144/1990 | EP 0,355,660A2 |
|---|---|---|---|
| | column line 5, and p. 12 lower right column line 4 from the bottom to p. 13 upper left column line 17 | column line 11 and p. 30 lines 2 to 5 | p. 47 lines 20 to 22 |
| Solvent for silver halide | p. 12 lower left column line 6 to 14 and p. 13 upper left column line 3 from the bottom to p. 18 lower left column last line | — | — |
| Chemical sensitizing agent | p. 12 lower left column line 3 from the bottom to lower right column line 5 from the bottom and p. 18 lower right column line 1 to p. 22 upper right column line 9 from the bottom | p. 29 lower right column line 12 to last line | p. 47 lines 4 to 9 |
| Spectral sensitizing agent (method) | p. 22 upper right column line 8 from the bottom to p. 38 last line | p. 30 upper left column lines 1 to 13 | p. 47 lines 10 to 15 |
| Emulsion stabilizer | p. 39 upper left column line 1 to p. 72 upper right column last line | p. 30 upper left column line 14 to upper right column line 1 | p. 47 lines 16 to 19 |
| Developing accelerator | p. 72 lower left column line 1 to p. 91 upper right column line 3 | — | — |
| Color coupler (Cyan, Magent, and Yellow coupler) | p. 91 upper right column line 4 to p. 121 upper left column line 6 | p. 3 upper right column line 14 to p. 18 upper left column last line and p. 30 upper right column line 6 to p. 35 lower right column line 11 | p. 4 lines 15 to 27, p. 5 line 30 to p. 28 last line, p. 45 lines 29 to 31 and p. 47 line 23 to p. 63 line 50 |
| Color Formation-strengthen agent | p. 121 upper left column line 7 to p. 125 upper right column line 1 | — | — |
| Ultra violet absorbent | p. 125 upper right column line 2 to p. 127 lower left column last line | p. 37 lower right column line 14 to p. 38 upper left column line 11 | p. 65 lines 22 to 31 |
| Discoloration inhibitor (Image-dye stabilizer) | p. 127 lower right column line 1 to p. 137 lower left column line 8 | p. 36 upper right column line 12 to p. 37 upper left column line 19 | p. 4 line 30 to p. 5 line 23, p. 29 line 1 to p. 45 line 25 p. 45 lines 33 to 40 and p. 65 lines 2 to 21 |
| High-boiling and/or low-boiling solvent | p. 137 lower left column line 9 to p. 144 upper right column last line | p. 35 lower right column line 14 to p. 36 upper left column line 4 | p. 64 lines 1 to 51 |
| Method for dispersing additives for photograph | p. 144 lower left column line 1 to p. 146 upper right coulumn line 7 | p. 27 lower right column line 10 to p. 28 upper left column last line and p. 35 lower right column line 12 to p. 36 upper right column line 7 | p. 63 line 51 to p. 64 line 56 |
| Film Hardener | p. 146 upper right column line 8 to p. 155 lower left column line 4 | — | — |
| Developing Agent precursor | p. 155 lower left column line 5 to p. 155 lower right column line 2 | — | — |
| Compound releasing development restrainer | p. 155 lower right column lines 3 to 9 | — | — |
| Base | p. 155 lower right column line 19 to p. 156 upper left column line 14 | p. 38 upper right column line 18 to p. 39 upper left column line 3 | p. 66 lline 29 to p. 67 line 13 |
| Constitution of photosensitive layer | p. 156 upper left column line 15 to p. 156 lower right column line 14 | p. 28 upper right column lines 1 to 15 | p. 45 lines 41 to 52 |
| Dye | p. 156 lower right column line 15 to p. 184 lower ringt column last line | p. 38 upper left column line 12 to upper right column line 7 | p. 66 lines 18 to 22 |
| Color-mix inhibitor | p. 185 upper left column line 1 to p. 188 lower right column line 3 | p. 36 upper right column lines 8 to 11 | p. 64 line 57 to p. 65 line 1 |
| Gradation controller | p. 188 lower right column lines 4 to 8 | — | — |

-continued

| Element constituting photographic material | JP-A No. 215272/1987 | JP-A No. 33144/1990 | EP 0,355,660A2 |
|---|---|---|---|
| Stain inhibitor | p. 188 lower right column line 9 to p. 193 lower right column line 10 | p. 37 upper left column last line to lower right column line 13 | p. 65 line 32 to p. 66 line 1 |
| Surface-active agent | p. 201 lower left column line 1 to p. 210 upper right column last line | p. 18 upper right column line 1 to p. 24 lower right column last line and p. 27 lower left column line 10 from the botom to lower right column line 9 | — |
| Fluorine-containing agent (As Antistatic agent, coating aid, lubricant, adhesion inhibitor, or the like) | p. 210 lower left column line 1 to p. 222 lower left column line 5 | p. 25 upper left column line 1 to p. 27 lower right column line 9 | — |
| Binder (Hydrophilic colloid) | p. 222 lower left column line 6 to p. 225 upper left column last line | p. 38 upper right column lines 8 to 18 | p. 66 lines 23 to 28 |
| Thickening agent | p. 225 upper right column line 1 to p. 227 upper right column line 2 | — | — |
| Antistatic agent | p. 227 upper right column line 3 to p. 230 upper left column line 1 | — | — |
| Polymer latex latex | p. 230 upper left column line 2 to p. 239 last line | — | — |
| Matting agent | p. 240 upper left column line 1 to p. 240 upper right column last line | — | — |
| Photographic processing method (processing process, additive, etc.) | p. 3 upper right column line 7 to p. 10 upper right column line 5 | p. 39 upper left column line 4 to p. 42 upper left column last line | p. 67 line 14 to p. 69 line 28 |

Note:
In the cited part of JP-A No. 21572/1987, amendment filed on March 16, 1987 is included.

According to the present invention, a silver halide color photographic material that is improved in dark-fading of the color image, fading under high moisture, and fading due to acids, and that is capable of forming dye images that exhibit excellent image stability, and that is also improved in latent-image keeping after storage for a long period of time. Further, according to the present invention, a silver halide color photographic material can be obtained that is improved in dark-fading of the color image, in fading under high humidity, and acid-fading, and whose photographic performance changes less on long-term storage of the photographic material or when the photographic material is processed continuously. Further, according to the present invention, a silver halide color photographic material can be obtained whose color image is improved in dark-fading, fading under high humidity, and acid-fading, and this material can provide a stable color image free from unevenness of development even when subjected to development processing several days after the exposure to light.

Next, the present invention will be described in more detail in accordance with examples, but the invention is not limited to these Examples.

EXAMPLE 1

A silver halide emulsion was prepared as follows:

| | |
|---|---|
| (liquid 1) | |
| $H_2O$ | 1000 ml |
| NaCl | 3.3 g |
| lime-processed gelatin | 32 g |
| (liquid 2) | |
| sulfuric acid (1 N) | 24 ml |
| (liquid 3) | |
| N,N'-dimethylimidazolidine-2-thion (1% aqueous solution) | 3 ml |
| (liquid 4) | |
| NaCl | 10.5 g |
| KBr | 0.4 g |
| $H_2O$ to make | 200 ml |
| (liquid 5) | |
| $AgNO_3$ | 32.00 g |
| $H_2O$ to make | 200 ml |
| (liquid 6) | |
| NaCl | 41.8 g |
| KBr | 1.92 g |
| $H_2O$ to make | 560 ml |
| (liquid 7) | |
| $AgNO_3$ | 128 g |
| $H_2O$ to make | 560 ml |

(liquid 1) was heated to 76° C. and (liquid 2) and (liquid 3) were added. Thereafter, (liquid 4) and (liquid 5) were simultaneously added over 14 min while vigorously stirring. After 10 min, (liquid 6) and (liquid 7) were added simultaneously over 15 min while vigorously stirring. 5 min after the addition, the temperature was lowered and desalting was carried out.

Water and dispersed gelatin were added and the pH was adjusted to 6.2, thereby obtaining a monodisperse cubic silver bromochloride emulsion having an average grain size of 1.01 μm and a deviation coefficient (a value obtained by dividing the standard deviation by the average grain size: s/d) of 0.08. Triethyl thiourea was added to the emulsion at 58° C. to sensitize chemically the emulsion optimally. The obtained emulsion was named A-1.

Emulsions A-2 to A-9 were prepared in the same procedure, except that the amounts of the agents in (liquid 1) to (liquid 7) and the temperature were changed as shown in Table 1, respectively. Iridium ions, rhodium ions, and iron ions were added in the forms of aqueous solutions of potassium irrigate(IV) chloride, potassium hexachlororhodate, potassium ferrous(II) chloride, and potassium hexacyanoferrate(II), by mixing the solutions with (liquid 6).

TABLE 1

| Emulsion | Cl content (mol %) | Size (μm) | Deviation Coefficient | Species of metal ion | Amount added of metal ion (mol/mol · Ag) |
|---|---|---|---|---|---|
| A-1 | 98 | 1.01 | 0.08 | — | — |
| A-2 | 98 | 1.01 | 0.08 | Iridium | $1 \times 10^{-8}$ |
| A-3 | 98 | 1.01 | 0.08 | Iridium | $1 \times 10^{-7}$ |
| A-4 | 98 | 1.01 | 0.08 | Rhodium | $1 \times 10^{-8}$ |
| A-5 | 98 | 1.01 | 0.08 | Rhodium | $1 \times 10^{-7}$ |
| A-6 | 98 | 1.01 | 0.08 | Iron* | $1 \times 10^{-5}$ |
| A-7 | 98 | 1.01 | 0.08 | Iron* | $1 \times 10^{-4}$ |
| A-8 | 98 | 1.01 | 0.08 | Iron** | $1 \times 10^{-5}$ |
| A-9 | 98 | 1.01 | 0.08 | Iron** | $1 \times 10^{-4}$ |
| A-10 | 100 | 1.01 | 0.08 | — | — |
| A-11 | 100 | 1.01 | 0.08 | Iron** | $1 \times 10^{-4}$ |
| A-12 | 98 | 0.48 | 0.10 | — | — |
| A-13 | 98 | 0.48 | 0.10 | Iron* | $1 \times 10^{-4}$ |
| A-14 | 98 | 0.48 | 0.10 | Iron** | $1 \times 10^{-4}$ |

Note;
*Ferrous chloride
**Potassium hexacyanoferrate(II)

Coated sample A composed of the following layer composition was prepared on a polyethylene laminated paper base.

Preparation of first layer coating solution

To 19.1 g of yellow coupler (ExY), 3.8 g of image-dye stabilizer (Cpd-1), and 1.9 g of image-dye stabilizer (Cpd-7), 27.2 ml of ethyl acetate and each 3.8 g of solvents (Solv-3) and (Solv-6) were added to dissolve them, and the solution was dispersed and emulsified into 185 ml of a 10% aqueous gelatin solution containing 8 ml of 10% sodium dodecylbenzenesulfonate solution. Separately, an emulsion prepared by adding a blue-sensitive sensitizing dye shown below to the above prepared silver chloride emulsion A-1. The above emulsified dispersion and this emulsion were mixed and dissolved to prepare the first coating solution so as to give the composition shown below.

Coating solutions for the second to seventh layers were also prepared in the same manner as the first layer coating solution. As a gelatin hardener for the respective layers, sodium salt of 1-hydroxy-3,5-dichloro-s-triazine was used.

As spectral-sensitizing dyes for the respective layers, the following compounds were used:

For blue-sensitive emulsion layer

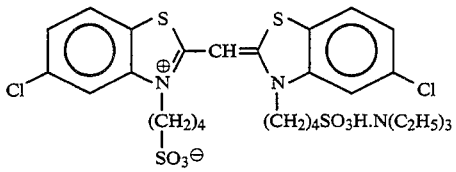

($5.0 \times 10^{-4}$ mol per mol of silver halide)

For green-sensitive emulsion layer

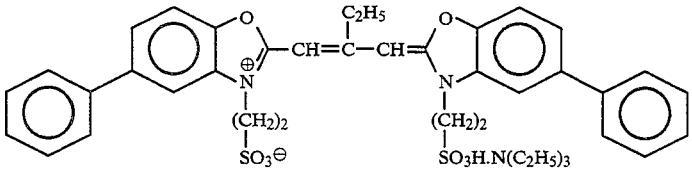

($4.0 \times 10^{-4}$ mol per mol of silver halide) and

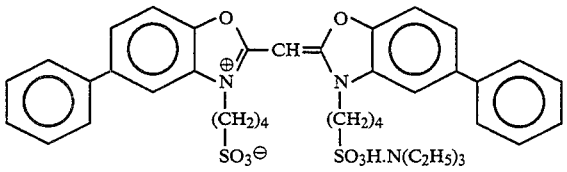

($7.0 \times 10^{-5}$ mol per mol of silver halide)

For red-sensitive emulsion layer

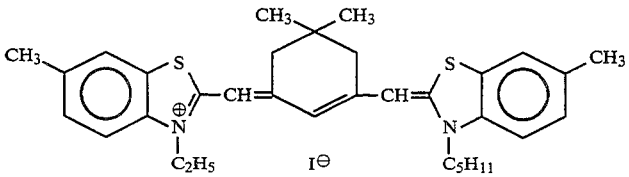

($0.9 \times 10^{-4}$ mol per mol of silver halide)

To the red-sensitive emulsion layer, in addition to the above sensitizing dye, the following compound in an amount of $2.6 \times 10^{-3}$ mol per mol of silver halide was added.

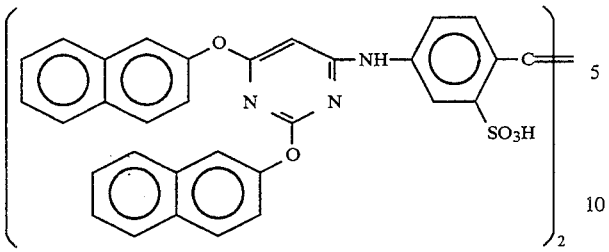

Further, to the blue-sensitive emulsion layer, the green-sensitive emulsion layer, and the red-sensitive emulsion layer, 1-(5-methylureidophenyl)-5-mercaptotetrazole was added in amounts of $4.0\times10^{-5}$ mol, $3.0\times10^{-4}$ mol, and $1.0\times10^{-4}$ mol, per mol of silver halide, respectively, and 2-methyl-5-t-octylhydroquinone was added in amounts of $8\times10^{-3}$ mol, $2\times10^{-3}$ mol, and $1\times10^{-3}$ mol, per mol of silver halide, respectively.

Further, to the blue-sensitive emulsion layer and the green-sensitive emulsion layer, 4-hydroxy-6-methyl-1,3,3a,7-tetrazaindene was added in amounts of $2\times10^{-2}$ mol and $1.1\times10^{-2}$ mol, per mol of silver halide, respectively.

Further, to the red-sensitive emulsion layer, mercaptoimidazole compound and mercaptothiazole compound, shown below, were added in amounts of $2\times10^{-4}$ mol and $4\times10^{-4}$ mol, per mol of silver halide, respectively.

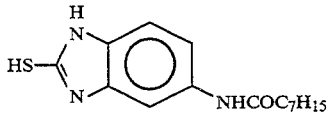

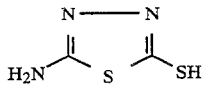

The following dyes were added to the emulsion layers to prevent irradiation.

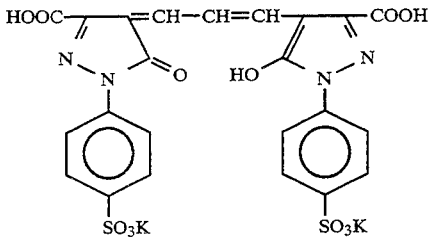

($7.0\times10^{-6}$ mol/m$^2$)

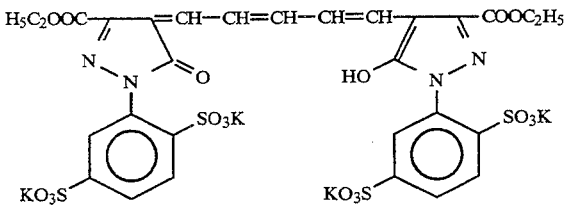

($1.4\times10^{-5}$ mol/m$^2$)

and

-continued

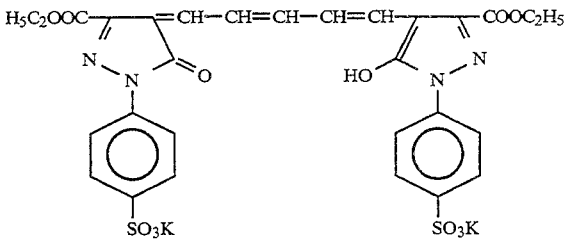

($1.4\times10^{-5}$ mol/m$^2$)

Further, to all emulsions from the first layer to the seventh layer, the following compounds were added so as to prevent putrefaction and occurrence of fungi, respectively.

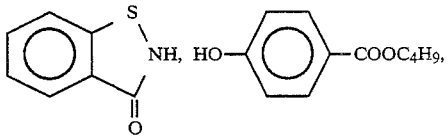

(25 mg/m$^2$) (25 mg/m$^2$)

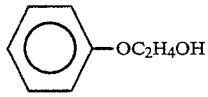

(500 mg/m$^2$)

(Composition of each layer)

The composition of each layer is shown below. Figures represent coating amount in g/m$^2$. The coating amount of silver halide is represented in terms of silver.

| | |
|---|---|
| Supporting base | |
| Paper laminated on both sides with polyethylene film (a white pigment: $TiO_2$ of 14.7 wt. % and a bluing dye: ultramarine of 0.3 wt. % were included in the polyethylene film of first layer side.) | |
| First layer (Blue-sensitive layer) | |
| Silver halide emulsion (A-1) | 0.30 |
| Gelatin | 1.15 |
| Yellow coupler (ExY) | 0.68 |
| Image-dye stabilizer (Cpd-1) | 0.14 |
| Image-dye stabilizer (Cpd-7) | 0.07 |
| Solvent (Solv-3) | 0.14 |
| Solvent (Solv-6) | 0.14 |
| Second layer (Color-mix preventing layer) | |
| Gelatin | 1.34 |
| Color-mix inhibitor (Cpd-5) | 0.04 |
| Solvent (Solv-1) | 0.10 |
| Solvent (Solv-4) | 0.10 |
| Third layer (Green-sensitive emulsion layer) | |
| Silver halide emulsion (A-12) | 0.13 |
| Gelatin | 1.48 |
| Magenta coupler (ExM) | 0.27 |
| Imge-dye stabilizer (Cpd-2) | 0.04 |
| Imge-dye stabilizer (Cpd-3) | 0.20 |
| Imge-dye stabilizer (Cpd-4) | 0.01 |
| Imge-dye stabilizer (Cpd-8) | 0.03 |
| Imge-dye stabilizer (Cpd-9) | 0.08 |
| Solvent (Solv-2) | 0.65 |
| Fourth layer (Ultraviolet ray absorbing layer) | |
| Gelatin | 1.44 |
| Ultraviolet ray absorber (UV-1) | 0.52 |
| Color-mix inhibitor (Cpd-5) | 0.06 |
| Solvent (Solv-5) | 0.26 |

-continued

| | |
|---|---|
| Fifth layer (Red-sensitive emulsion later) | |
| Silver halide emulsion (A-12) | 0.20 |
| Gelatin | 0.85 |
| Cyan coupler (ExC) | 0.28 |
| Image-dye stabilizer (Cpd-6) | 0.56 |
| Image-dye stabilizer (Cpd-7) | 0.27 |
| Image-dye stabilizer (Cpd-8) | 0.02 |
| Image-dye stabilizer (Cpd-9) | 0.17 |
| Solvent (Solv-6) | 0.17 |
| Sixth layer (Ultraviolet ray absorbing layer) | |

-continued

| | |
|---|---|
| Gelatin | 0.39 |
| Ultraviolet ray absorber (UV-1) | 0.16 |
| Color-mix inhibitor (Cpd-5) | 0.02 |
| Solvent (Solv-5) | 0.08 |
| Seventh layer (Protective layer) | |
| Gelatin | 1.26 |
| Acryl-modified copolymer of polyvinyl alcohol (modification degree: 17%) | 0.05 |
| Liquid paraffin | 0.02 |

Compounds used are as follows:

(Cpd-1) Image-dye stabilizer

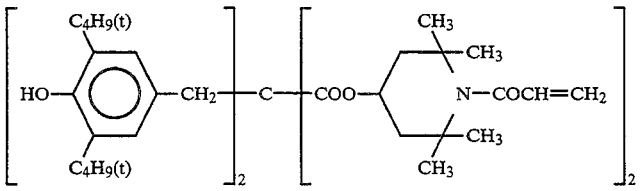

(Cpd-2) Image-dye stabilizer

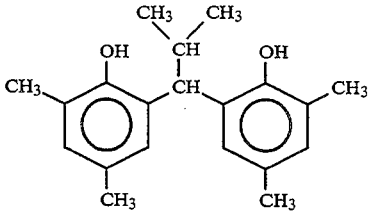

(Cpd-3) Image-dye stabilizer

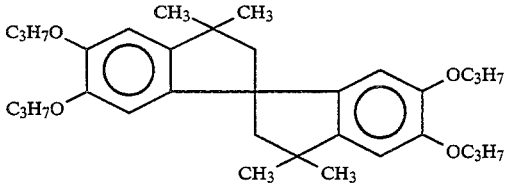

(Cpd-4) Image-dye stabilizer

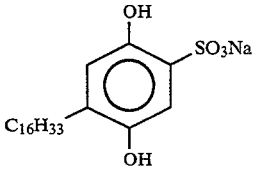

(Cpd-5) Color-mix inhibitor

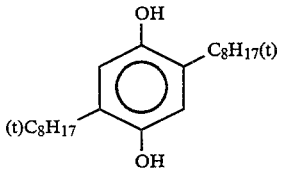

(Cpd-6) Image-dye stabilizer
Mixture (2:4:4 in weight) of

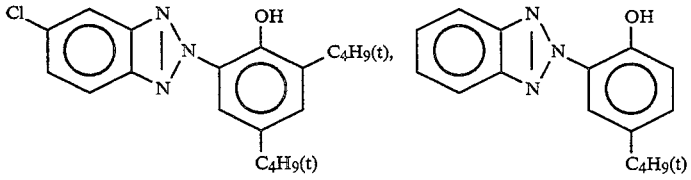

and

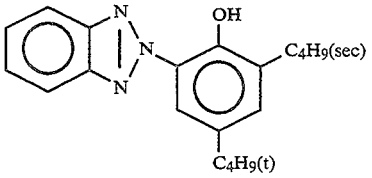

(Cpd-7) Image-dye stabilizer (Cpd-8) Image-dye stabilizer

-continued
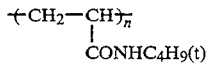
Average molecular weight: 80,000
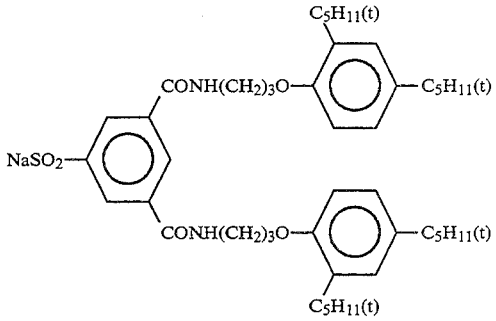
(Cpd-9) Image-dye stabilizer
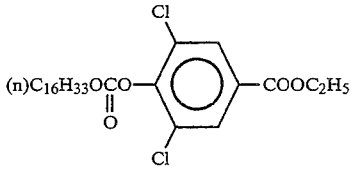
(UV-1) Ultraviolet ray absorber
Mixture (4:2:4 in weight ratio) of
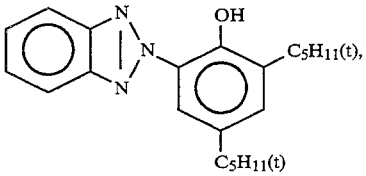
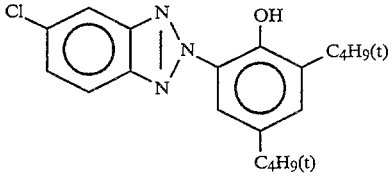
and
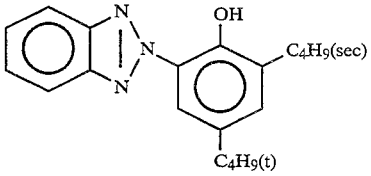
(Solv-1) Solvent
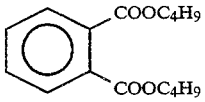
(Solv-2) Solvent
Mixture (2:1 in weight ratio) of
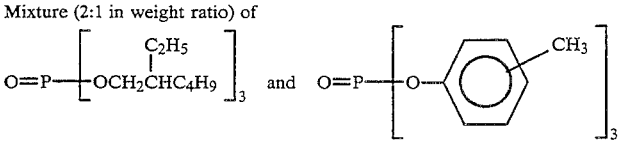
(Solv-3) Solvent
$O{=}P{+}O{-}C_9H_{19}(iso)]_3$
(Solv-4) Solvent
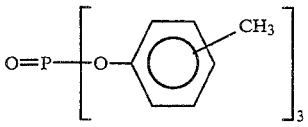
(Solv-5) Solvent
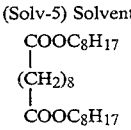
(Solv-6) Solvent
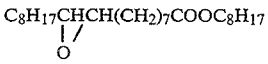
(ExY) Yellow coupler
Mixture (1:1 in molar ratio) of -continued

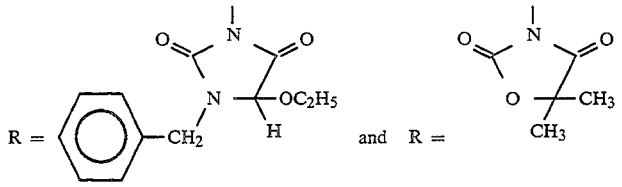

of

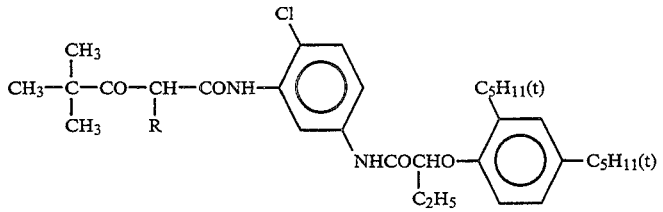

(ExM) Magenta coupler
Mixture (1:1 in molar ratio) of

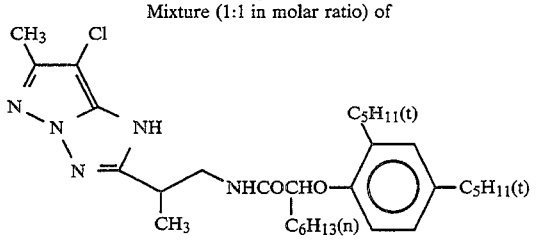

and

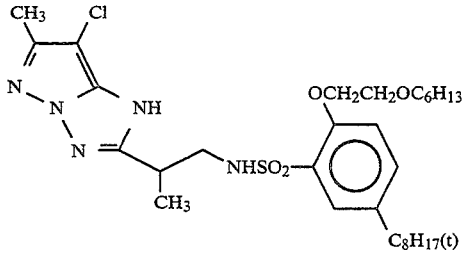

(ExC) Cyan coupler
Mixture (1:1 in molar ratio) of

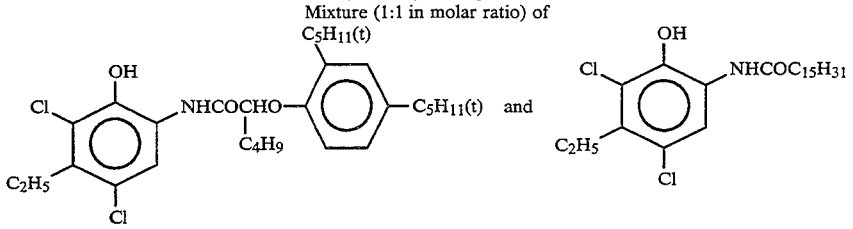

Epoxy compound J

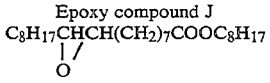

TABLE 2

| Sample | Blue-sensitive Emulsion | Green-sensitive Emulsion | Red-sensitive Emulsion | Epoxy Compound |
|---|---|---|---|---|
| A | A-1 | A-12 | A-12 | — |
| B | A-1 | A-12 | A-12 | J |
| C | A-1 | A-12 | A-12 | I-2 |
| D | A-1 | A-13 | A-12 | I-2 |
| E | A-1 | A-14 | A-12 | I-2 |
| F | A-1 | A-12 | A-14 | I-2 |
| G | A-2 | A-12 | A-12 | I-2 |
| H | A-3 | A-12 | A-12 | I-2 |

TABLE 2-continued

| Sample | Blue-sensitive Emulsion | Green-sensitive Emulsion | Red-sensitive Emulsion | Epoxy Compound |
|---|---|---|---|---|
| I | A-4 | A-12 | A-12 | I-2 |
| J | A-5 | A-12 | A-12 | I-2 |
| K | A-6 | A-12 | A-12 | I-2 |
| L | A-7 | A-12 | A-12 | I-2 |
| M | A-8 | A-12 | A-12 | I-2 |
| N | A-9 | A-12 | A-12 | I-2 |
| O | A-10 | A-12 | A-12 | I-2 |
| P | A-11 | A-12 | A-12 | I-2 |

TABLE 2-continued

| Sample | Blue-sensitive Emulsion | Green-sensitive Emulsion | Red-sensitive Emulsion | Epoxy Compound |
|---|---|---|---|---|
| Q | A-11 | A-12 | A-12 | II-2 |
| R | A-11 | A-12 | A-12 | III-2 |
| S | A-11 | A-12 | A-12 | — |
| T | A-11 | A-12 | A-12 | J |

Similarly, 20 coating samples were prepared by combining the emulsions and the epoxy compounds shown in Table 2. Epoxy Compounds (1-2), (II-2), (III-2), and J were co-emulsified with the above couplers and added to the first layer in an amount of 0.18 g/m$^2$.

After 1 day of standing at room temperature after the coating, each sample was given a gradation exposure through a color separation filter for sensitometry by using a sensitometer (manufactured by Fuji Photo Film Co., Ltd., FWH-model, the color temperature of the light source: 3200° K.). The exposure was carried out in such a manner that an exposure time of 0.1 sec gave an exposure amount of 250 CMS. To investigate the stability of the image, each sample was allowed to stand for two separate time periods: 30 sec and 2 hours, after the exposure and was then developed. The same experiment was conducted with respect to samples after 1 day and 2 weeks of standing, respectively, at 50° C. after the coating.

The exposed samples were processed using an automatic processor using the below-mentioned processing steps and processing solution compositions.

| Processing Step | Temperature | Time | Replenisher* | Tank Capacity |
|---|---|---|---|---|
| Color-developing | 350° C. | 45 sec | 161 ml | 17 liter |
| Bleach-fixing | 30–35° C. | 45 sec | 215 ml | 17 liter |
| Rinse (1) | 30–35° C. | 20 sec | — | 10 liter |
| Rinse (2) | 30–35° C. | 20 sec | — | 10 liter |
| Rinse (3) | 30–35° C. | 20 sec | 350 ml | 10 liter |
| Drying | 70–80° C. | 60 sec | | |

Note:
*Replenisher amount per m$^2$ of photographic material
(Rinse steps: 3 tanks counter-current flow mode from the tank of rinse (3) towards the tank of rinse (1))

Composition of each processing solution were as follows:

| | Tank solution | Replenisher |
|---|---|---|
| Color developer | | |
| Water | 800 ml | 800 ml |
| Ethylenediamine-N,N,N,N-tetramethylene phosphonic acid | 1.5 g | 2.0 g |
| Potassium bromide | 0.015 g | — |
| Triethanolamine | 8.0 g | 12.0 g |
| Sodium chloride | 1.4 g | — |
| Potassium carbonate | 25 g | 25 g |

-continued

| | Tank solution | Replenisher |
|---|---|---|
| N-Ethyl-N-(β-methanesulfonamidoethyl)-3-methyl-4-aminoaniline sulfate | 5.0 g | 7.0 g |
| N,N-Bis(carboxymethyl)hydrazine | 4.0 g | 5.0 g |
| Sodium N,N-di(sulfoethyl)-hydroxylamine | 4.0 g | 5.0 g |
| Fluorescent brightening agent (WHITEX 4B, made by Sumutomo Chemical Co.) | 1.0 g | 2.0 g |
| Water to make | 1000 ml | 1000 ml |
| pH (25° C.) | 10.05 | 10.45 |
| Bleach-fixing solution (Both tank solution and replenisher) | | |
| Water | 400 ml | |
| Ammonium thiosulfate (70%) | 100 ml | |
| Sodium sulfite | 17 g | |
| FE(III) ammonium ethylenediamine-tetraacetate | 55 g | |
| Disodium ethylenediaminetetraacetate | 5 g | |
| Ammonium bromide | 40 g | |
| Water to make | 1000 ml | |
| pH (25° C.) | 6.0 | |
| Rinse solution (Both tank solution and replenisher) | | |
| Ion-exchanged water (contents of calcium and magnesium: each 3 ppm or below) | | |

The reflection density of each of the thus prepared and processed samples was determined to obtain the so-called characteristic curve. The reciprocal number of the exposure amount that gave a density 0.5 higher than the fog density was designated density S. With respect to the change of latent-image keeping, the value derived from the following expression was used.

$$\Delta S = \left( \frac{S_{2h}^{2w}}{S_{30s}^{2w}} - \frac{S_{2h}^{1d}}{S_{30s}^{1d}} \right) \times 100$$

wherein the superscript attached to each S stands for the period passed after coating, with 1d representing 1 day and 2w representing 2 weeks, and the subscript attached to each S stands for the period between the exposure and the development processing, with 30s representing 30 sec and 2h representing 2 hours.

It is indicated that the nearer to 0 this value is, the better the latent-image keeping.

To evaluate the fastness of the yellow dye image of these processed samples under acid, each sample 30 sec after the exposure was soaked for 1 min in a 1N citric acid aqueous solution, then it was dried and was allowed to stand for 3 days at 80° C., and the drop of the density from the initial density of 2.0 was determined.

To evaluate the heat and humidity fastness of the dye image, each sample developed 30 sec after the exposure was allowed to stand for 2 weeks under the conditions of 80° C. and 70%, and the drop of the density from the initial density of 2.0 was determined.

The results are summarized in Table 3.

TABLE 3

| Sample | ΔS Blue-sensitive layer | ΔS Green-sensitive layer | ΔS Red-sensitive layer | Acid-fading 80° C. 3 days | Humidity & heat-fading 80° C., 70% RH 2 weeks | Remarks |
|---|---|---|---|---|---|---|
| A | 3 | 3 | 3 | 0.31 | 0.22 | Comparative Example |
| B | 12 | 10 | 8 | 0.21 | 0.15 | Comparative Example |
| C | 15 | 12 | 9 | 0.09 | 0.11 | Comparative Example |
| D | 14 | 4 | 9 | 0.09 | 0.11 | This Invention |
| E | 14 | 2 | 9 | 0.09 | 0.11 | This Invention |

TABLE 3-continued

| Sample | ΔS Blue-sensitive layer | ΔS Green-sensitive layer | ΔS Red-sensitive layer | Acid-fading 80° C. 3 days | Humidity & heat-fading 80° C., 70% RH 2 weeks | Remarks |
|---|---|---|---|---|---|---|
| F | 14 | 12 | 2 | 0.09 | 0.11 | This Invention |
| G | 10 | 12 | 9 | 0.09 | 0.11 | This Invention |
| H | 10 | 12 | 9 | 0.09 | 0.11 | This Invention |
| I | 11 | 12 | 9 | 0.09 | 0.11 | This Invention |
| J | 11 | 12 | 9 | 0.09 | 0.11 | This Invention |
| K | 8 | 11 | 8 | 0.09 | 0.11 | This Invention |
| L | 7 | 11 | 8 | 0.09 | 0.11 | This Invention |
| M | 6 | 11 | 8 | 0.09 | 0.11 | This Invention |
| N | 5 | 11 | 8 | 0.09 | 0.11 | This Invention |
| O | 14 | 11 | 8 | 0.09 | 0.11 | Comparative Example |
| P | 4 | 11 | 8 | 0.09 | 0.11 | This Invention |
| Q | 4 | 11 | 8 | 0.08 | 0.10 | This Invention |
| R | 4 | 11 | 8 | 0.09 | 0.09 | This Invention |
| S | 2 | 2 | 2 | 0.30 | 0.22 | Comparative Example |
| T | 4 | 9 | 7 | 0.19 | 0.15 | Comparative Example |

From the results, it can be understood that only the constitution of the present invention is excellent in both image preservability and latent-image keeping. That is, it can be understood that samples containing epoxy compounds (Samples B to R, and T) are improved in yellow dye image preservability, and samples containing sparingly water-soluble epoxy compounds of the present invention (Samples C to R) are particularly improved. Further, it can be understood that when emulsions containing hexacyanoferrate(II) ions are used, the latent-image keeping is best.

EXAMPLE 2

Silver chloride emulsions were prepared in the same manner as Example 1, except that the following alterations were conducted. Each of (liquid 6) and (liquid 7) was divided into two parts, which were added separately, with the ratio of the division being 1:1, 3:1, and 7:1, and potassium hexacyanoferrate(II) was added only to the second part of (liquid 6) to have the compositions as shown in Table 4, thereby preparing Silver Chloride Emulsions B-1 to B-3. To B-3 was added a silver bromide fine-grain emulsion (average grain size: 0.05 μm) corresponding to 2 mol % for the silver halide at 58° C., thereby preparing Emulsion B-4. The amounts of chemicals of (liquid 1) to (liquid 7) and the temperature was changed to prepare Emulsions B-5 to B-7 shown in Table 7.

In accordance with the combinations of the emulsions and the epoxy compounds shown in Table 5, coating samples were prepared.

Similar to Example 1, the dye image fastness and the latent-image keeping after storage were evaluated. The results are shown in Table 6.

TABLE 4

| Emulsion | Cl content (mol %) | Size (μm) | Deviation Coefficient | AgBr localized phase | Amount added of iron ion (mol/mol · A) | Ion containing layer of grain |
|---|---|---|---|---|---|---|
| B-1 | 98 | 1.01 | 0.08 | Absent | $1 \times 10^{-4}$ | 40% of surface layer |
| B-2 | 98 | 1.01 | 0.08 | Absent | $1 \times 10^{-4}$ | 20% of surface layer |
| B-3 | 98 | 1.01 | 0.08 | Absent | $1 \times 10^{-4}$ | 10% of surface layer |
| B-4 | 98 | 1.01 | 0.08 | Present | $1 \times 10^{-4}$ | 10% of surface layer |
| B-5 | 98 | 0.49 | 0.10 | Absent | $1 \times 10^{-4}$ | 40% of surface layer |
| B-6 | 98 | 0.49 | 0.10 | Absent | $1 \times 10^{-4}$ | 20% of surface layer |
| B-7 | 98 | 0.49 | 0.10 | Absent | $1 \times 10^{-4}$ | 10% of surface layer |

TABLE 5

| Sample | Blue-sensitive emulsion layer | Green-sensitive emulsion layer | Red-sensitive emulsion layer | Epoxy compound |
|---|---|---|---|---|
| U | B-1 | B-5 | B-5 | I-2 |
| V | B-2 | B-6 | B-6 | I-2 |
| W | B-3 | B-7 | B-7 | I-2 |
| X | B-4 | B-7 | B-7 | I-2 |

TABLE 6

| Sample | ΔS Blue-sensitive layer | ΔS Green-sensitive layer | ΔS Red-sensitive layer | Acid-fading 80° C. 3 days | Humidity & heat-fading 80° C., 70% RH 2 weeks | Remarks |
|---|---|---|---|---|---|---|
| U | 3 | 3 | 3 | 0.09 | 0.11 | This Invention |
| V | 2 | 2 | 2 | 0.09 | 0.11 | This Invention |
| W | 1 | 1 | 1 | 0.09 | 0.11 | This Invention |
| X | 0 | 1 | 1 | 0.09 | 0.11 | This Invention |

As is apparent from the results shown in Table 6, the latent-image keeping of the emulsions after storage wherein the volume of the layer containing hexacyanoferrate(II) ions is made small and the hexacyanoferrate(II) ions are concentrated near the surface of the grains (Emulsions B-3, 4 and 7) is better. It can be understood that in the case having a silver bromide localized layer (Emulsion B-4), the latent-image keeping is better by far.

EXAMPLE 3

32 g of lime-processed gelatin was added to 1000 ml of distilled water and dissolved at 40° C., and after 3.3 g of sodium chloride was added, the temperature was elevated to 60° C. 1.8 ml of N,N'-dimethyl-imidazolidine-2-thion (1% aqueous solution) was added to the solution. Then, a solution of 32.0 g of silver nitrate in 200 ml of distilled water and a solution of 11.0 g of sodium chloride in 200 ml of distilled water were added to and mixed with the resulting solution over 14 min at 60° C. Further, a solution of 128.0 g of silver nitrate in 560 ml of distilled water and a solution of 44.0 g of sodium chloride in 560 ml of distilled water were added over 40 min at 60° C. After desalting at 40° C. and washing were carried out, 90.0 g of lime-processed gelatin was added and the pAg and the pH were respectively adjusted to 7.5 and 6.5 with sodium chloride and sodium hydroxide. Then, after red-sensitive sensitizing dye (S-1) was added in an amount of $8\times10^{-5}$ mol per mol of silver halide, the silver chloride emulsion was sulfur-sensitized with triethyl thiourea optimally at 50° C. The resulting silver chloride emulsion was named Emulsion A.

32 g of lime-processed gelatin was added to 1000 ml of distilled water and dissolved at 40° C., and after 3.3 g of sodium chloride was added, the temperature was elevated to 60° C. 2.0 ml of N,N'-dimethyl-imidazolidine-2-thion (1% aqueous solution) was added to the solution. Then, a solution of 32.0 g of silver nitrate in 200 ml of distilled water and a solution of 10.9 g of sodium chloride and 0.22 g of potassium bromide in 200 ml of distilled water were added to and mixed with the resulting solution over 15 min at 60° C. Further, a solution of 128.0 g of silver nitrate in 560 ml of distilled water and a solution of 43.6 g of sodium chloride and 0.90 g of potassium bromide in 560 ml of distilled water were added over 40 min at 60° C. After desalting at 40° C. and washing were carried out, 90.0 g of lime-processed gelatin was added and the pAg and the pH were respectively adjusted to 7.5 and 6.5 with sodium chloride and sodium hydroxide. Then, after red-sensitive sensitizing dye (S-i) was added in an amount of $8\times10^{-5}$ mol per mol of silver halide, the silver bromochloride emulsion was sulfur-sensitized with triethyl thiourea optimally at 50° C. The resulting silver bromochloride emulsion (containing 1 mol % of silver bromide) was named Emulsion B.

32 g of lime-processed gelatin was added to 1000 ml of distilled water and dissolved at 40° C., and after 3.3 g of sodium chloride was added, the temperature was elevated to 60° C. 2.4 ml of N,N'-dimethyl-imidazolidine-2-thion (1% aqueous solution) was added to the solution. Then, a solution of 32.0 g of silver nitrate in 200 ml of distilled water and a solution of 10.2 g of sodium chloride and 1.57 g of potassium bromide in 200 ml of distilled water were added to and mixed with the resulting solution over 20 min at 60° C. Further, a solution of 128.0 g of silver nitrate in 560 ml of distilled water and a solution of 41.0 g of sodium chloride and 6.28 g of potassium bromide in 560 ml of distilled water were added over 60 min at 60° C. After desalting at 40° C. and washing were carried out, 90.0 g of lime-processed gelatin was added and the pAg and the pH were respectively adjusted to 7.5 and 6.5 with sodium chloride and sodium hydroxide. Then, after red-sensitive sensitizing dye (S-1) was added in an amount of $8\times10^{-5}$ mol per mol of silver halide, the silver bromochloride emulsion was sulfur-sensitized with triethyl thiourea optimally at 50° C. The resulting silver bromochloride emulsion (containing 1% of silver bromide) was named Emulsion C.

A silver chlorobromide emulsion was prepared in the same manner as Emulsion A, except that before the sulfur sensitization, a silver bromide ultrafine emulsion (having a grain size of 0.05 μm) was added at 50° C. in such an amount that 1.0 mol % of silver bromide would be contained for the silver chloride and after 15 min of ripening the sensitization was carried out optimally, and this emulsion was named Emulsion D.

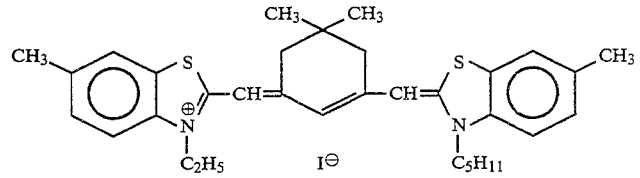

With respect to the four thus prepared Emulsions A to D, the shape of the grains, the grain size, and the grain size distribution were determined from their electromicrographs. The grain size was expressed by the average value of the diameters of circles equivalent to the projected areas of the grains, and the grain size distribution was expressed by the value obtained by dividing the standard deviation of the grain diameters by the average grain size. Each of the four Emulsions A to D comprised cubic grains having a grain size of 0.54 μm and a grain size distribution of 0.09.

The electromicrograph of the Emulsion D, wherein silver bromide ultrafine grains had been added, showed that the corners of the cubes were sharper than those of the Emulsion A, wherein silver bromide ultrafine grains had not been added. The X-ray diffraction of the Emulsion D showed a weak diffraction at a part corresponding to 10 mol % to 50 mol % in terms of silver bromide content. From the above, the Emulsion D seems to be one wherein localized phases having a silver bromide content of 10 mol % to 50 mol % are epitaxially grown on the corners of the cubic silver chloride grains.

A multilayer color photographic paper having layer compositions shown below (Sample $A_2$) was prepared by coating various photograph-constituting layers on a paper base. As the paper base, a paper laminated on both sides with polyethylene, subjected to a corona discharge treatment on the surface thereof, and then provided a prime coat of gelatin containing sodium dodecylbenzenesulfonate was used.

Coating solutions were prepared as follows:

Preparation of first layer coating solution

To 19.1 g of yellow coupler (ExY), 4.1 g of image-dye stabilizer (Cpd-1), and 0.7 g of image-dye stabilizer (Cpd-7), 27.2 ml of ethyl acetate and each 4.1 g of solvents (Solv-3) and (Solv-6) were added to dissolve them, and the solution was dispersed and emulsified into 185 ml of a 10% aqueous gelatin solution containing 8 ml of 10% sodium dodecylbenzenesulfonate solution by using a supersonic homogenizer. The obtained dispersion was mixed and dissolved with a silver chlorobromide emulsion (cubic grains, average grain size: 0.80 μm, contained 0.5 mol % of silver bromide locally on the grain surface, and contained sensitizing dyes A and B for blue-sensitive emulsion of each $2\times10^{-4}$ mol per mol of silver halide) to prepare the first coating solution.

Preparation of fifth layer coating solution

To 32.0 g of cyan coupler (ExC), 3.0 g of image-dye stabilizer (Cpd-2), 2.0 g of image-dye stabilizer (Cpd-4), 18.0 g of image-dye stabilizer (Cpd-6), 40.0 g of image-dye stabilizer (Cpd-7), and 5.0 g of image-dye stabilizer (Cpd-8), 50.0 ml of ethyl acetate and 14.0 g of solvent (Solv-6) were added to dissolve them, and the solution was added to 500 ml of 20% aqueous gelatin solution containing 8 ml of 10% sodium dodecylbenzenesulfonate, thereafter the mixture was emulsified and dispersed by a supersonic homogenizer. The obtained dispersion was mixed and dissolved in silver chloride emulsion A, thereby prepared the fifth layer coating solution.

Coating solutions for the second to fourth layers, and the sixth and seventh layers were also prepared in the same manner as the fifth layer coating solution. As a gelatin hardener for the respective layers, sodium salt of 1-hydroxy-3,5-dichloro-s-triazine was used.

Further, to each layer Cpd-10 and Cpd-11 were added so as to be the total amount 25.0 mg/m$^2$ and 50.0 mg/m$^2$, respectively.

As spectral-sensitizing dyes for the respective layers, the following compounds were used:

Sensitizing dye A for blue-sensitive emulsion layer

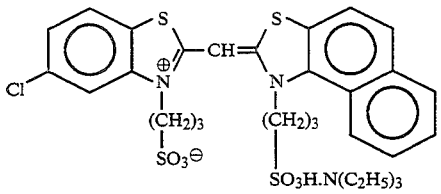

Sensitizing dye B for blue-sensitive emulsion layer

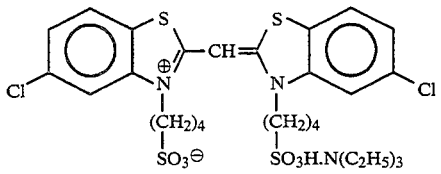

Sensitizing dye C for green-sensitive emulsion layer

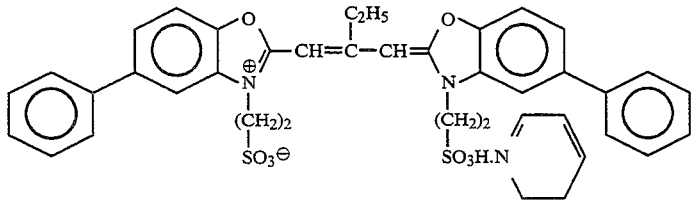

To the red-sensitive emulsion layer, the following compound in an amount of $2.6\times10^{-3}$ mol per mol of silver halide was added.

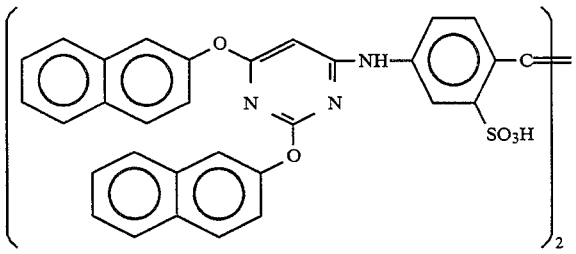

Further, to the blue-sensitive emulsion layer, the green-sensitive emulsion layer, and the red-sensitive emulsion layer, 1-(5-methylureidophenyl)-5-mercaptotetrazole was added in amounts of $8.5\times10^{-5}$ mol, $7.7\times10^{-4}$ mol, and $2.5\times10^{-4}$ mol, per mol of silver halide, respectively.

Further, to the blue-sensitive emulsion layer and the green-sensitive emulsion layer, 4-hydroxy-6-methyl-1,3,3a,7-tetrazaindene was added in amounts of $1\times10^{-2}$ mol and $2\times10^{-2}$ mol, per mol of silver halide, respectively.

The following dyes were added to the emulsion layers to prevent irradiation. Figures in parentheses represents a coating amount.

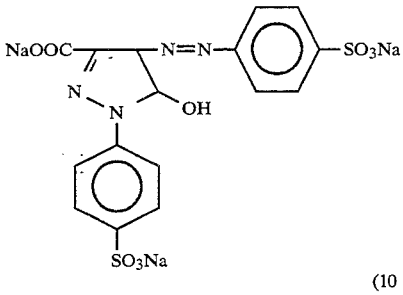

(10 mg/m²)

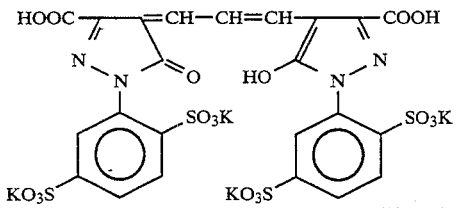

(10 mg/m²)

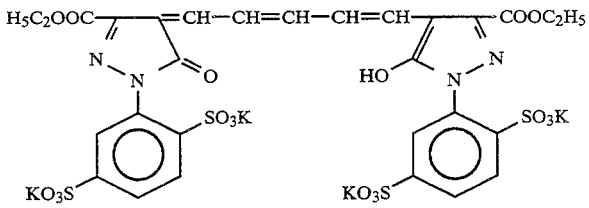

(40 mg/m²)

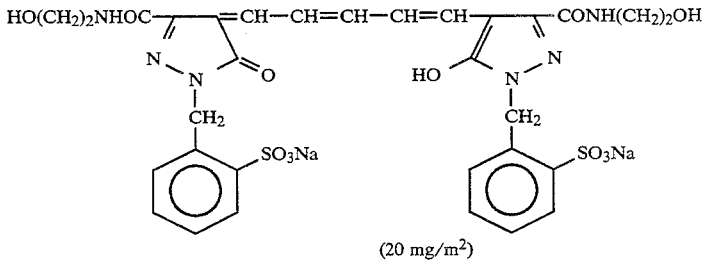

(20 mg/m²)

(Composition of each layer)

The composition of each layer is shown below. Figures represent coating amount in g/m². The coating amount of silver halide is represented in terms of silver.

| | |
|---|---|
| Supporting base | |
| Polyethylene laminated paper (a white pigment: $TiO_2$ and a bluing dye: ultramarine of 0.3 wt. % were included in the polyethylene film of first layer side.) | |
| First layer (Blue-sensitive layer) | |
| Silver chlorobromide emulsion described above | 0.30 |
| Gelatin | 1.86 |
| Yellow coupler (ExY) | 0.82 |
| Image-dye stabilizer (Cpd-1) | 0.19 |
| Solvent (Solv-3) | 0.18 |
| Solvent (Solv-7) | 0.18 |
| Image-dye stabilizer (Cpd-7) | 0.06 |
| Second layer (Color-mix preventing layer) | |
| Gelatin | 0.99 |
| Color-mix inhibitor (Cpd-5) | 0.08 |
| Solvent (Solv-1) | 0.16 |

-continued

| | |
|---|---|
| Solvent (Solv-4) | 0.08 |
| Third layer (Green-sensitive emulsion layer) | |
| Silver chlorobromide emulsion | 0.12 |
| Gelatin | 1.24 |
| Magenta coupler (ExM) | 0.23 |
| Image-dye stabilizer (Cpd-2) | 0.03 |
| Image-dye stabilizer (Cpd-3) | 0.16 |
| Image-dye stabilizer (Cpd-4) | 0.02 |
| Image-dye stabilizer (Cpd-9) | 0.02 |
| Solvent (Solv-2) | 0.40 |
| Fourth layer (Ultraviolet ray absorbing layer) | |
| Gelatin | 1.58 |
| Ultraviolet ray absorber (UV-1) | 0.47 |
| Color-mix inhibitor (Cpd-5) | 0.05 |
| Solvent (Solv-5) | 0.24 |
| Fifth layer (Red-sensitive emulsion later) | |
| Emulsion A | 0.23 |
| Gelatin | 1.34 |
| Cyan coupler (ExC) | 0.32 |
| Image-dye stabilizer (Cpd-2) | 0.03 |
| Image-dye stabilizer (Cpd-4) | 0.02 |
| Image-dye stabilizer (Cpd-6) | 0.18 |
| Image-dye stabilizer (Cpd-7) | 0.40 |
| Image-dye stabilizer (Cpd-8) | 0.05 |
| Solvent (Solv-6) | 0.14 |

-continued

| | |
|---|---|
| Sixth layer (Ultraviolet ray absorbing layer) | |
| Gelatin | 0.53 |
| Ultraviolet ray absorber (UV-1) | 0.16 |
| Color-mix inhibitor (Cpd-5) | 0.02 |
| Solvent (Solv-5) | 0.08 |
| Seventh layer (Protective layer) | |

-continued

| | |
|---|---|
| Gelatin | 1.33 |
| Acryl-modified copolymer of polyvinyl alcohol (modification degree: 17%) | 0.17 |
| Liquid paraffin | 0.03 |

Compounds used are as follows:

Mixture (1:1 in molar ratio) of (ExY) Yellow coupler

R = 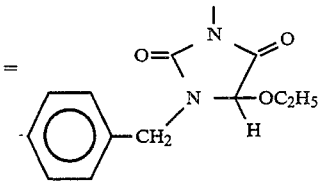 and X = Cl, and

R = 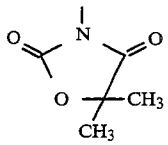 and X = OCH3 of

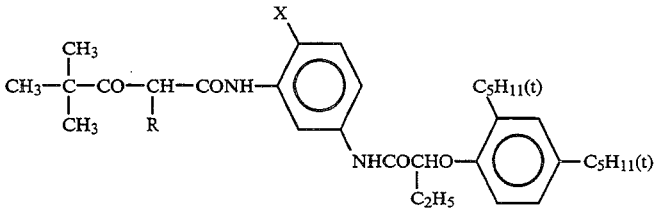

(ExM) Magenta coupler

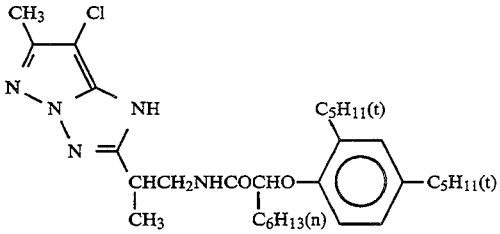

Mixture (1:1 in molar ratio) of (ExC) Cyan coupler

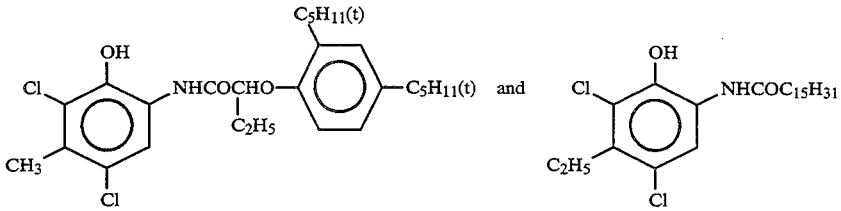

(Cpd-1) Image-dye stabilizer

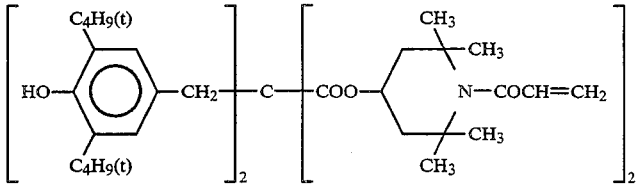

-continued
(Cpd-2) Image-dye stabilizer
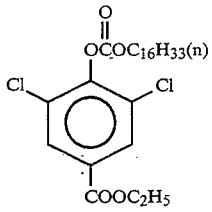
(Cpd-3) Image-dye stabilizer
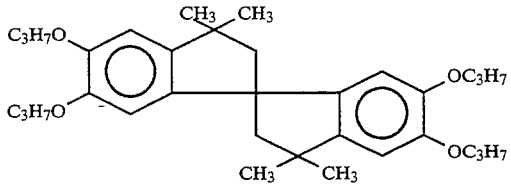
(Cpd-4) Image-dye stabilizer
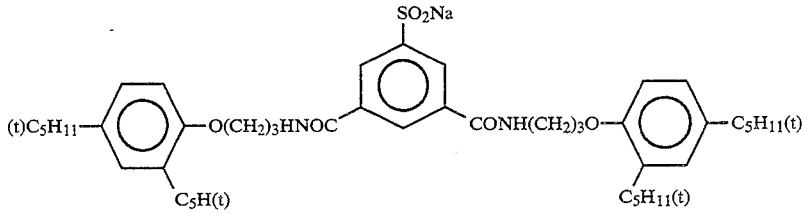
(Cpd-5) Color-mix inhibitor
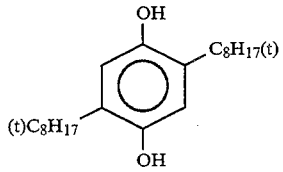
(Cpd-6) Image-dye stabilizer
Mixture (2:4:4 in weight) of
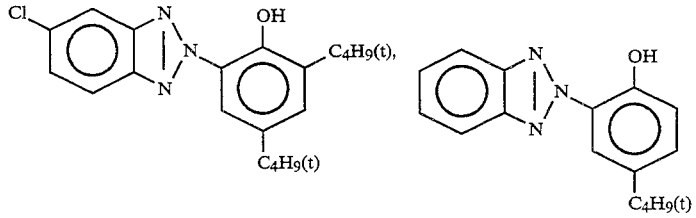
and
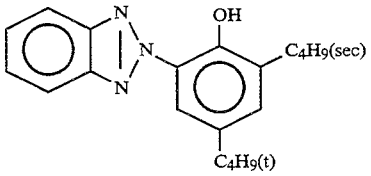
(Cpd-7) Image-dye stabilizer
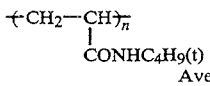
Average molecular weight: 60,000
(Cpd-8) Image-dye stabilizer
Mixture (1:1 in weight ratio) of
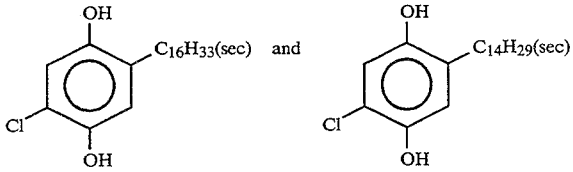

-continued
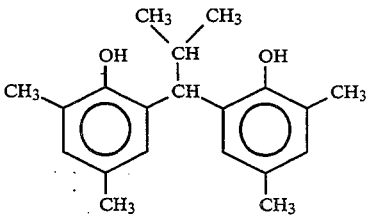
(Cpd-9) Image-dye stabilizer
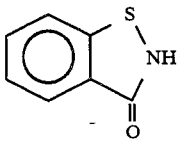
(Cpd-10) Antiseptic
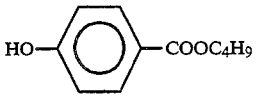
(Cpd-11) Antiseptic
Mixture (4:2:4 in weight ratio) of
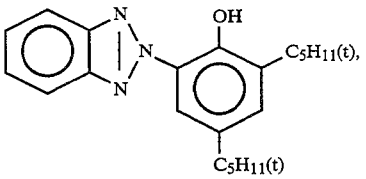
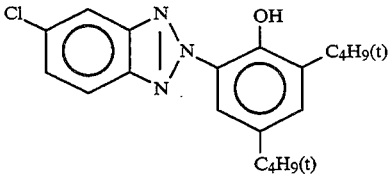
and
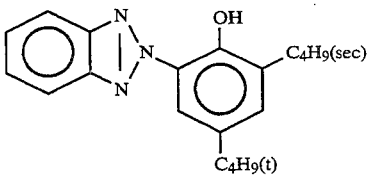
(UV-1) Ultraviolet ray absorber
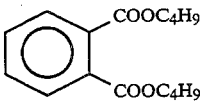
(Solv-1) Solvent
Mixture (2:1 in weight ratio) of
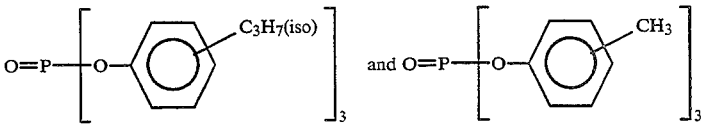
(Solv-2) Solvent
(Solv-3) Solvent
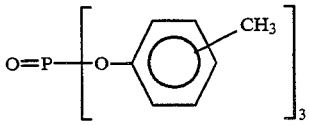
(Solv-4) Solvent
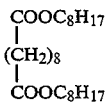
(Solv-5) Solvent -continued Mixture (80:20 in volume ratio) of

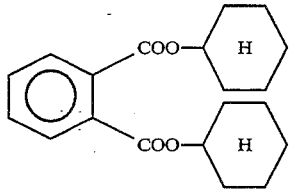

and $C_8H_{17}CH{-}CH(CH_2)_7COOC_8H_{17}$ (epoxide)

$C_8H_{17}CH{-}CH(CH_2)_7COOC_8H_{17}$ (epoxide)

Solv-6) Solvent (Solv-7) Solvent

Samples $B_2$ to $U_2$ were prepared in the same manner as Sample $A_2$, except that the emulsion of the fifth layer (red-sensitive layer) and solvent (Solv-6) were exchanged as shown in Table 7.

(Solv-8) Solvent

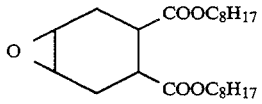

Each sample above prepared was given a gradation exposure of light of three separated filter for sensitometry by using a sensitometer (FWH-model, made by Fuji Photo Film Co., Ltd., the color temperature of the light source: 3200° K.). The exposure was carried out in such that an exposure time of 0.1 sec gave an exposure amount of 250 CMS.

After the exposure to light, each sample was subjected to a continuous processing (running test) according to the processing process shown below and the processing solution of which composition are shown below, using a paper-processor, until the volume of color-developer had been replenished twice that of the tank.

| Processing Step | Temperature | Time | Replenisher* | Tank Capacity |
|---|---|---|---|---|
| Color-developing | 35° C. | 45 sec | 161 ml | 17 liter |
| Bleach-fixing | 30–35° C. | 45 sec | 215 ml | 17 liter |
| Rinse (1) | 30–35° C. | 20 sec | — | 10 liter |
| Rinse (2) | 30–35° C. | 20 sec | — | 10 liter |
| Rinse (3) | 30–35° C. | 20 sec | 350 ml | 10 liter |
| Drying | 70–80° C. | 60 sec | | |

Note:
*Replenisher amount per $m^2$ of photographic material
(Rinse steps: 3 tanks counter-current flow mode from the tank of rinse (3) towards the tank of rinse (1))

Composition of each processing solution were as follows:

| Color developer | Tank solution | Replenisher |
|---|---|---|
| Water | 800 ml | 800 ml |
| Ethylenediamine-N,N,N,N-tetramethylene phosphonic acid | 1.5 g | 2.0 g |
| Potassium bromide | 0.015 g | — |
| Triethanolamine | 8.0 g | 12.0 g |
| Sodium chloride | 1.4 g | — |
| Potassium carbonate | 25 g | 25 g |
| N-Ethyl-N-(β-methanesulfonamidoethyl)-3-methyl-4-aminoaniline sulfate | 5.0 g | 7.0 g |
| N,N-Bis(carboxymethyl)hydrazine | 4.0 g | 5.0 g |

-continued

| | | |
|---|---|---|
| Sodium N,N-di(sulfoethyl)-hydroxylamine | 4.0 g | 5.0 g |
| Fluorescent brightening agent (WHITEX 4B, made by Sumutomo Chemical Co.) | 1.0 g | 2.0 g |
| Water to make | 1000 ml | 1000 ml |
| pH (25° C.) | 10.05 | 10.45 |
| Bleach-fixing solution (Both tank solution and replenisher) | | |
| Water | | 400 ml |
| Ammonium thiosulfate (70%) | | 100 ml |
| Sodium sulfite | | 17 g |
| Fe(III) ammonium ethylenediamine-tetraacetate | | 55 g |
| Disodium ethylenediaminetetraacetate | | 5 g |
| Ammonium bromide | | 40 g |
| Water to make | | 1000 ml |
| pH (25° C.) | | 6.0 |
| Rinse solution (Both tank solution and replenisher) | | |
| Ion-exchanged water (contents of calcium and magnesium were each 3 ppm or less) | | |

To evaluate the fading of the cyan dye images by acids (fastness of the cyan dye images to acids), each of the processed samples was immersed in a 1N citric acid solution for 1 min, then it was dried and allowed to stand at 80° C. for 2 days, and the drop of the density (ΔD) of the cyan from the initial density of 2.0 was determined.

To evaluate the fading of the cyan dye images by heat (fastness of the cyan dye images to heat), each of the processed samples was allowed to stand at 100° C. for 7 days, and the drop (ΔD) of the density of the cyan from the initial density of 2.0 was determined.

To evaluate the change of the photographic performance of the photographic material on long-term storage (raw stock stability), each of the samples was kept under a pressure of 50 atmospheres for 7 days and then was exposed and processed, and the change (ΔS) of the sensitivity from that of each of the samples that were not kept under pressure was determined. The change of the sensitivity was expressed by the difference of the logarithm of the exposure amount needed to give a density 0.5 higher than the fog density. The negative value indicates desensitization due to pressurizing.

To evaluate the change of the photographic performance due to the continuous processing of the photographic material (running processability), at the exposure amount needed to give a cyan density of 2.0 at the start of the above continuous processing, the density obtained during the continuous processing was determined and the change was expressed by the drop (ΔD) of the density. The results are shown in Table 7.

TABLE 7

| Sample | Composition of red-sensitive emulsion layer: Emulsion | Epoxy compound | Substitution ratio of Solv-6 | Acid-fading ΔD | Heat-fading ΔD | Durability of raw material ΔS | Running processability ΔD | Remarks |
|---|---|---|---|---|---|---|---|---|
| $A_2$ | A | Solv-6 | — | 0.53 | 0.72 | −0.06 | 0.23 | Comparative Example |
| $B_2$ | A | I-2 | 100 | 0.04 | 0.44 | −0.11 | 0.35 | Comparative Example |
| $C_2$ | B | Solv-6 | — | 0.52 | 0.73 | −0.05 | 0.25 | Comparative Example |
| $D_2$ | B | Solv-7 | 100 | 0.38 | 0.84 | −0.06 | 0.22 | Comparative Example |
| $E_2$ | B | Solv-8 | 100 | 0.32 | 0.79 | −0.05 | 0.26 | Comparative Example |
| $F_2$ | B | I-2 | 100 | 0.04 | 0.43 | −0.12 | 0.33 | Comparative Example |
| $G_2$ | B | I-4 | 100 | 0.09 | 0.41 | −0.13 | 0.37 | Comparative Example |
| $H_2$ | B | I-8 | 100 | 0.08 | 0.44 | −0.10 | 0.31 | Comparative Example |
| $I_2$ | B | II-1 | 100 | 0.06 | 0.39 | −0.14 | 0.35 | Comparative Example |
| $J_2$ | B | III-1 | 100 | 0.12 | 0.36 | −0.13 | 0.35 | Comparative Example |
| $K_2$ | C | Solv-6 | — | 0.55 | 0.73 | −0.04 | 0.29 | Comparative Example |
| $L_2$ | C | I-2 | 100 | 0.04 | 0.45 | −0.10 | 0.41 | Comparative Example |
| $M_2$ | D | Solv-6 | — | 0.56 | 0.71 | −0.05 | 0.24 | Comparative Example |
| $N_2$ | D | Solv-7 | 100 | 0.39 | 0.83 | −0.06 | 0.26 | Comparative Example |
| $O_2$ | D | Solv-8 | 100 | 0.33 | 0.79 | −0.05 | 0.26 | Comparative Example |
| $P_2$ | D | I-2 | 50 | 0.12 | 0.51 | −0.05 | 0.27 | This Invention |
| $Q_2$ | D | I-2 | 100 | 0.04 | 0.44 | −0.08 | 0.29 | This Invention |
| $R_2$ | D | I-4 | 100 | 0.08 | 0.39 | −0.07 | 0.30 | This Invention |
| $S_2$ | D | I-8 | 100 | 0.09 | 0.44 | −0.06 | 0.29 | This Invention |
| $T_2$ | D | II-1 | 100 | 0.07 | 0.40 | −0.07 | 0.26 | This Invention |
| $U_2$ | D | III-1 | 100 | 0.13 | 0.35 | −0.08 | 0.29 | This Invention |

Note;
Substitution ratio of Solv-6 is shown in %.
ΔD of acid-fading,
ΔD of heat-fading,
ΔS of durability of raw material, and
ΔD of running processability designate that the smaller each absolute value, the better the property.

As is apparent from the results shown in Table 7, the samples that use the epoxy compounds of the present invention are excellent in fastness of the cyan dye image to an acid and heat than that of the prior art. Further, when the epoxy compound is used in combination with a silver halide emulsion of the present invention, which is obtained by forming silver bromide localized phases and chemically sensitizing the surfaces, an excellent photographic material can be obtained without aggravating the raw stock stability and running processability.

EXAMPLE 4

32 g of lime-processed gelatin was added to 1000 ml of distilled water and dissolved at 40° C., and after 1.6 g of sodium chloride was added, the temperature was elevated to 54° C. 1.7 ml of N,N'-dimethyl-imidazolidine-2-thion (1% aqueous solution) was added to the solution. Then, a solution of 32.0 g of silver nitrate in 200 ml of distilled water and a solution of 11.0 g of sodium chloride in 200 ml of distilled water were added to the above-described solution over 14 min keeping at 54° C. Next, a solution of 48.0 g of silver nitrate in 210 ml of distilled water and a solution of 16.5 g of sodium chloride in 210 ml of distilled water were added and mixed over 15 min at 54° C. Further, a solution of 80.0 g of silver nitrate in 350 ml of distilled water and a solution of 27.5 g of sodium chloride in 350 ml of distilled water were added and mixed over 25 min keeping at 54° C. After desalting and washing at 40° C. were carried out, 90.0 g of lime-processed gelatin was added and the pAg and the pH were respectively adjusted to 8.1 and 6.0 with sodium chloride and sodium hydroxide. After the temperature was raised up to 46° C., red-sensitive sensitizing dye (S-1) was added in an amount of $6\times10^{-5}$ mol per mol of silver halide. Then, a silver bromide ultrafine grain emulsion (having a grain size of 0.05 μm) was added in such an amount that 0.55 mol % of silver bromide would be contained for the silver chloride, and after 25 min of ripening the sulfur-sensitization was carried out optimally at 46° C. by using triethylthiourea. The thus-prepared silver chlorobromide emulsion (containing 0.55 mol % of silver bromide) was named Emulsion E.

A silver chlorobromide emulsion was prepared in the same manner as Emulsion E, except that before the sulfur sensitization, to a silver bromide ultrafine grain emulsion potassium hexachloroiridium (IV) acid in an amount of $1.2\times10^{-4}$ was added, and then the sulfur sensitization was carried out optimally, and this emulsion was named Emulsion F.

Silver chlorobromide emulsions were prepared in the same manner as Emulsion E, except that an aqueous solution of respective compound shown in Table 8 was added with the third addition of silver nitrate aqueous solution and sodium chloride aqueous solution over 25 min, and they were named Emulsions G to I.

Each of the five Emulsions E to I comprised cubic grains having a grain size of 0.52 μm and a grain size distribution of 0.10. The electromicrographs of Emulsions E, F, G, H, and I showed that the corners of the cubes were sharp. The X-ray diffraction of these emulsions showed a weak diffraction at a part corresponding to 10 mol % to 50 mol % in terms of silver bromide content. From the above, these emulsions seem to be one wherein localized phases having a silver bromide content of 10 mol % to 50 mol % are epitaxially grown on the corners of the cubic silver chloride grains.

Photographic materials were prepared in the same manner as Sample $B_2$, except that the emulsion of the fifth layer (red-sensitive emulsion layer) was changed as shown in Table 8, respectively, and these were named Samples $V_2$, $W_2$, $X_2$, $Y_2$, and $Z_2$.

These samples were given an exposure to light and processing similarly as Example 3 to evaluate their properties. Results obtained are shown in Table 8.

TABLE 8

| Sample | Emulsion of red-sensitive emulsion layer: Emulsion | Group (VIII) compound | Amount added | Acid-fading ΔD | Heat-fading ΔD | Durability of raw material ΔS | Running process-ability ΔD | Remarks |
|---|---|---|---|---|---|---|---|---|
| $B_2$ | A | — | — | 0.05 | 0.45 | −0.13 | 0.38 | Comparative Example |
| $V_2$ | E | — | — | 0.04 | 0.44 | −0.09 | 0.28 | This Invention |
| $W_2$ | F | $K_2IrCl_6$ | $6 \times 10^{-7}$ | 0.05 | 0.44 | −0.05 | 0.22 | This Invention |
| $X_2$ | G | $K_4Fe(CN)_6$ | $1 \times 10^{-5}$ | 0.04 | 0.44 | −0.06 | 0.26 | This Invention |
| $Y_2$ | H | $K_4Ru(CN)_6$ | $1 \times 10^{-5}$ | 0.05 | 0.45 | −0.06 | 0.24 | This Invention |
| $Z_2$ | I | $K_3Ir(CN)_6$ | $4 \times 10^{-5}$ | 0.05 | 0.43 | −0.07 | 0.24 | This Invention |

Note;
Amount added of compound is represented in mol per mol of silver halide in the red-sensitive emulsion layer.
ΔD of acid-fading,
ΔD of heat-fading,
ΔS of durability of raw material, and
ΔD of running processability designate that the smaller each absolute value, the better the property.

As is apparent from results in Table 8, by adding an iridium compound, or metal complex, such as Fe, Ru, and Ir, having cyan ligand to the silver halide photographic material excellent effect can be obtained.

EXAMPLE 5

32 g of lime-processed gelatin was added to 800 ml of distilled water and dissolved at 40° C., and after 5.7 g of sodium chloride was added, the temperature was elevated to 75° C. 1.8 ml of N,N'-dimethylimidazolidine-2-thion (1% aqueous solution) was added to the solution. Then, a solution of 100 g of silver nitrate in 400 ml of distilled water and a solution of 34.4 g of sodium chloride in 400 ml of distilled water were added to and mixed with the above solution over 53 min keeping at 75°. Then a solution of 60 g of silver nitrate in 200 ml of distilled water and a solution of 17.4 g of sodium chloride in 200 ml of distilled water were added over 18 min keeping at 75° C. After desalting at 40° C. and washing were carried out, 90 g of lime-processed gelatin was added and the pAg and the pH were respectively adjusted to 7.5 and 6.5 with sodium chloride and sodium hydroxide. Then, after the temperature was raised at 58° C., a blue-sensitive sensitizing dye shown below was added in an amount of $3'10^{-4}$ mol per mol of silver halide, the silver chloride emulsion was sulfur-sensitized with triethyl thiourea optimally. The resulting silver chloride emulsion was named Emulsion J.

A silver chlorobromide emulsion was prepared in the same manner as Emulsion J, except that before the sulfur sensitization, a silver bromide ultrafine emulsion (having a grain size of 0.05 μm) was added at 58° C. in such an amount that 0.3 mol % of silver bromide would be contained for the silver chloride and after 25 min of ripening the sulfur sensitization was carried out optimally at 58° C., and this emulsion was named Emulsion D.

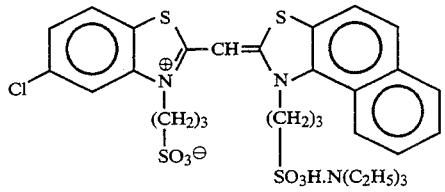

With respect to the thus prepared Emulsions J and K, the shape of the grains, the grain size, and the grain size distribution were determined from their electromicrographs, in the same manner as in Example 3. Each of the Emulsions J and K comprised cubic grains having a grain size of 0.82 μm and a grain size distribution of 0.10.

The electromicrograph of the Emulsion K, wherein silver bromide ultrafine grains had been added, showed that the corners of the cubes were sharper than those of the Emulsion J, wherein silver bromide ultrafine grains had not been added. The X-ray diffraction of the Emulsion K showed a weak diffraction at a part corresponding to 10 mol % to 40 mol % in terms of silver bromide content. From the above, the Emulsion K seems to be one wherein localized phases having a silver bromide content of 10 mol % to 50 mol % are epitaxially grown on the corners of the cubic silver chloride grains.

Photographic materials were prepared in the same procedure as Sample A in Example 3, except that the emulsion of the first layer (blue-sensitive emulsion layer) was changed as shown in Table 9 and further as the solvent of the same layer the epoxy compound of the present invention was added in addition of Solv-3, respectively, and these samples were named a to p.

The thus-prepared Samples were subjected to the same exposure to light and processing as in Example 1.

To evaluate the fading of the yellow dye images by acids (acid-fastness), each of the processed samples was immersed in a 1 N citric acid solution for 1 min, then it was dried and allowed to stand at 40° C. and 70% RH for 2 days, and the drop of the density (ΔD) of the yellow from the initial density of 1.8 was determined.

To evaluate the fading of the yellow dye images under a high-humidity condition (humidity- and heat-fastness), each of the processed samples was allowed to stand at 80° C. and 70% RH for 14 days, and the drop (ΔD) of the density of the yellow from the initial density of 1.8 was determined.

To evaluate the change of the photographic performance due to the continuous processing of the photographic material (running processability), at the exposure amount needed to give a yellow density of 1.8 at the start of the above continuous processing, the density obtained during the continuous processing was determined and the change was expressed by the drop (ΔD) of the density.

The results are shown in Table 9.

TABLE 9

| Sample | Composition of blue-sensitive emulsion layer: Emulsion | Epoxy compound | Coating amount (g/m²) | Acid-fading ΔD | Humidity & Heat-fading ΔD | Running process-ability ΔD | Remarks |
|---|---|---|---|---|---|---|---|
| a | J | — | — | 0.37 | 0.22 | 0.18 | Comparative Example |
| b | J | I-2 | 0.18 | 0.08 | 0.14 | 0.26 | Comparative Example |
| c | J | I-4 | 0.09 | 0.14 | 0.14 | 0.23 | Comparative Example |
| d | J | I-4 | 0.18 | 0.11 | 0.12 | 0.25 | Comparative Example |
| e | J | I-5 | 0.18 | 0.13 | 0.15 | 0.26 | Comparative Example |
| f | J | II-1 | 0.18 | 0.09 | 0.13 | 0.29 | Comparative Example |
| g | J | III-1 | 0.18 | 0.13 | 0.16 | 0.29 | Comparative Example |
| h | K | — | — | 0.38 | 0.23 | 0.17 | Comparative Example |
| i | K | I-2 | 0.09 | 0.12 | 0.16 | 0.21 | This Invention |
| j | K | I-2 | 0.18 | 0.09 | 0.14 | 0.18 | This Invention |
| k | K | I-4 | 0.09 | 0.13 | 0.15 | 0.18 | This Invention |
| l | K | I-4 | 0.18 | 0.11 | 0.12 | 0.19 | This Invention |
| m | K | I-5 | 0.18 | 0.12 | 0.16 | 0.18 | This Invention |
| n | K | I-8 | 0.18 | 0.10 | 0.13 | 0.19 | This Invention |
| o | K | II-1 | 0.18 | 0.09 | 0.13 | 0.17 | This Invention |
| p | K | III-1 | 0.18 | 0.12 | 0.15 | 0.20 | This Invention |

Note;
ΔD of acid-fading,
ΔD of heat-fading, and
ΔD of running processability designate that the smaller each absolute value, the better the property.

As is apparent from the results shown in Table 9, the samples wherein epoxy compounds of the present invention are added are more excellent in fastness of the yellow dye image to an acid and heat than that of the prior art. Further, when the epoxy compound is used in combination with a silver halide emulsion of the present invention, obtained by forming silver bromide localized phases and chemically sensitizing the surfaces, an excellent photographic material can be obtained without deteriorating the running processability.

EXAMPLE 6

To a 3% aqueous solution of lime-processed gelatin, 6.4 g of sodium chloride was added, and 3.2 ml of N,N'-dimethyl-imidazolidine-2-thione (1% aqueous solution) was added to the solution. Then, an aqueous solution containing 0.2 mol of silver nitrate and an aqueous solution containing 0.4 mol of potassium bromide and 0.6 mol of sodium chloride were added to and mixed with the above solution at 52° C. with vigorously stirring. Further, to this solution, an aqueous solution containing 0.8 mol of silver nitrate and an aqueous solution containing 0.16 mol of potassium bromide and 0.64 mol of sodium chloride were added and mixed 52° C. with vigorously stirring. After being kept at 52° C. for 5 min, desalting and washing were effected, and 90.0 g of lime-processed gelatin was added. The resulting silver chlorobromide emulsion (cubic grains having 0.45 μm of average grain size and containing 20 mol % of silver bromide) was named Emulsion α.

After adding a spectral sensitizing dye (B) in an amount of $4\times10^{-4}$ mol per mol of silver halide to Emulsion α at 54° C. the mixture was divided into two, to one of which triethylthiourea in an amount of $2.6\times10^{-5}$ mol per mol of silver halide was added, and to another of which triethylthiourea in an amount of $2.6\times10^{-6}$ and chloroauric acid in an amount of $1.8\times10^{-5}$ were added, to effect a spectral sensitization and a chemical sensitization, and they were named Emulsions $\alpha$-$B_1$ and $\alpha$-$B_2$, respectively.

Next, to a 3% aqueous solution of lime-processed gelatin, 3.3 g of sodium chloride was added, and 1.6 ml of N,N'-dimethyl-imidazolidine-2-thione (1% aqueous solution) was added to the solution. Then, an aqueous solution containing 0.2 mol of silver nitrate and an aqueous solution containing 0.004 mol of potassium bromide and 0.196 mol of sodium chloride were added to and mixed with the above solution at 52° C. with vigorously stirring. Further, to this solution, an aqueous solution containing 0.8 mol of silver nitrate and an aqueous solution containing 0.016 mol of potassium bromide and 0.784 mol of sodium chloride were added and mixed at 52° C. with vigorously stirring. After being kept at 52° C. for 5 min, desalting and washing were effected, and 90.0 g of lime-processed gelatin was added. The resulting silver chlorobromide emulsion (cubic grains having 0.48 μm of average grain size And containing 2 mol % of silver bromide) was named Emulsion β.

After adding a spectral sensitizing dye (B) in an amount of $4\times10^{-4}$ mol per mol of silver halide to Emulsion β at 54° C. the mixture was divided into two, to one of which triethylthiourea in an amount of $1.8\times10^{-5}$ mol per mol of silver halide was added, and to another of which triethylthiourea in an amount of $1.8\times10^{-6}$ and chloroauric acid in an amount of $1.4\times10^{-5}$ were added, to effect a spectral sensitization and a chemical sensitization, and they were named Emulsions $\beta$-$B_1$ and $\beta$-$B_2$, respectively.

Next, to a 3% aqueous solution of lime-processed gelatin, 3.3 g of sodium chloride was added, and 3.2 ml of N,N'-dimethyl-imidazolidine-2-thione (1% aqueous solution) was added to the solution. Then, an aqueous solution containing 0.2 mol of silver nitrate and an aqueous solution containing 0.2 mol of sodium chloride and were added to and mixed with the above solution at 52° C. with vigorous stirring. Further, to this solution, an aqueous solution containing 0.8 mol of silver nitrate and an aqueous solution containing 0.8 mol of sodium chloride were and mixed 52° C. with vigorous stirring. After being kept at 52° C. for 5 min, desalting and washing were effected, and 90.0 g of lime-processed gelatin was added. The resulting silver chlorobromide emulsion (cubic grains having 0.47 μm of average grain size) was named Emulsion γ.

After adding a spectral sensitizing dye (B) in an amount of $4\times10^{-4}$ mol per mol of silver halide to Emulsion at 54° C., the mixture was divided into six parts, and they were each spectrally and chemically sensitized as follows: To the first emulsion, after addition of fine grain silver bromide (having 0.05 μm of grain size) in an amount corresponding to 2 mol %, triethylthiourea in an amount of $1.6\times10^{-5}$ mol per mol of silver halide was added; to the second emulsion, besides the above, chloroauric acid in an amount of $1.4\times10^{-5}$ was added; to the third only chloroauric acid in an amount of $1.4\times10^{-5}$ was added; to the fourth emulsion, without the addition of fine grain silver bromide, triethylthiourea in an amount of $1.6\times10^{-5}$ was added; to the fifth emulsion, besides the above, chloroauric acid in an amount of $1.4\times10^{-5}$ mol per mol of silver halide was added; and to the sixth emulsion only chloroauric acid in an amount of $1.4\times10^{-5}$ was added. The thus-prepared emulsions were named Emulsion γ-B1, γ-B2, γ-B3, γ-B4, γ-B5, and γ-B6, respectively.

The characteristics of these emulsions are shown in Table 10.

TABLE 10

| Emulsion | Halogen composition | Chemical Sensitization | Remarks (distribution of halogen) |
|---|---|---|---|
| α-B1 | Cl 80 mol % (Br 20 mol %) | Surfur-sensitization | Uniform composition |
| α-B2 | Cl 80 mol % (Br 20 mol %) | Gold & sulfur-sensitixation | Uniform composition |
| β-B1 | Cl 98 mol % (Br 2 mol %) | Surfur-sensitization | Uniform composition |
| β-B2 | Cl 98 mol % (Br 2 mol %) | Gold & sulfur-sensitixation | Uniform composition |
| γ-B1 | Cl 98 mol % (Br 2 mol %) | Surfur-sensitization | Silver bromide localized phase exists on the surface of grain |
| γ-B2 | Cl 98 mol % (Br 2 mol %) | Gold & sulfur-sensitixation | Silver bromide localized phase exists on the surface of grain |
| γ-B3 | Cl 98 mol % (Br 2 mol %) | Gold-sensitization | Silver bromide localized phase exists on the surface of grain |
| γ-B4 | Cl 100 mol % | Surfur-sensitization | Uniform composition |
| γ-B5 | Cl 100 mol % | Gold & sulfur-sensitixation | Uniform composition |
| γ-B6 | Cl 100 mol % | Gold-sensitization | Uniform compositionon |

Emulsions of which names are shown below were prepared in the same manner as the above, except that, instead of the spectral sensitizing dye (B), spectral sensitizing dyes (G) and (R) in respective amounts of $4\times10^{-4}$ mol per mol of silver halide were added.

Emulsions α-G1, α-G2, β-G1, β-G2, γ-G1, γ-G2, γ-G3, γ-G4, γ-G5, γ-G6, and

Emulsions α-R1, α-R2, β-R1, β-R2, γ-R1, γ-R2, γ-R3, γ-R4, γ-R5, γ-R6

Spectral sensitizing dye (B)

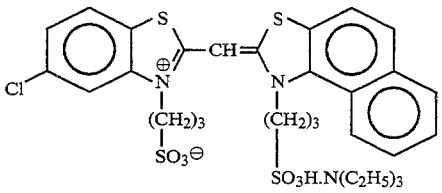

Spectral sensitizing dye (G)

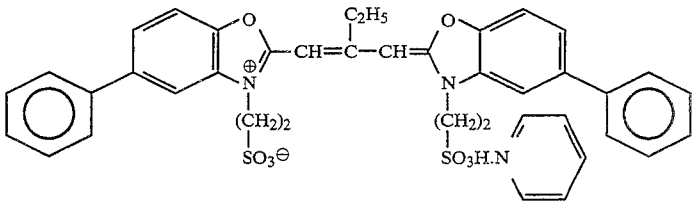

Spectral sensitizing dye (R)

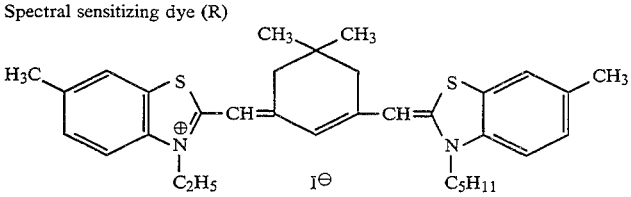

(Preparation of photographic material)

After a treatment by corona discharge on the surface of both sides polyethylene laminated paper support, there was provided a gelatin prime coated layer containing sodium dodecylbenzenesulfonate on the surface, followed by coating with various photographic constituting layers to prepare a multilayer color photographic paper A having layer compositions as shown below. Coating solutions were prepared as follows:

The preparation of the first layer coating solution 27.2 ml of ethyl acetate and each 4.1 g of solvents (Solv-3) and (Solv-7) were added to 19.1 g of Yellow coupler (ExY), 4.4 g of image-dye stabilizer (Cpd-1), and 0.7 g of image-dye stabilizer (Cpd-7) to dissolve them, and the solution was dispersed and emulsified into 185 ml of a 10% aqueous gelatin solution containing 8 ml of 10% sodium dodecylbenzenesulfonate solution to prepare a emulsified dispersion.

This emulsified dispersion and Emulsion $\alpha$-$B_1$ were mixed and dissolved to prepare the first coating solution to give the composition as shown below.

Coating solutions for the second to seventh layers were also prepared in the same manner as the first layer coating solution. As a gelatin hardener for respective layers, 1-hydroxy-3,5-dichloro-s-triazine sodium salt was used.

Further, Cpd-10 and Cpd-11 were added in each layer so as to be total amount 25 0 mg/m$^2$ and 50 mg/m$^2$respectively.

To the red-sensitive emulsion layer, the following compound was added in an amount of $2.6\times10^{-3}$ mol per mol of silver halide:

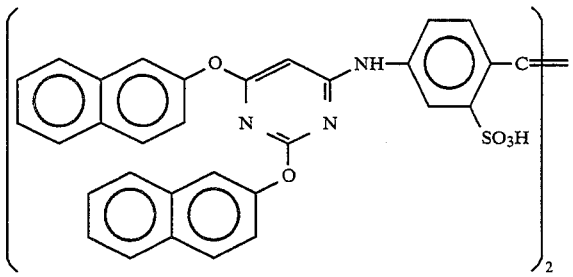

Further, 4-hydroxy-6-methyl-1,3,3a,7-tetrazaindene was added to the blue-sensitive emulsion layer and the green-sensitive layer in an amount of $1\times10^{-4}$ mol and $2\times10^{-4}$ mol, per mol of silver halide, respectively.

Further, the following dyes were added to each emulsion layer for the prevention of irradiation (coating amount are shown in parenthesis).

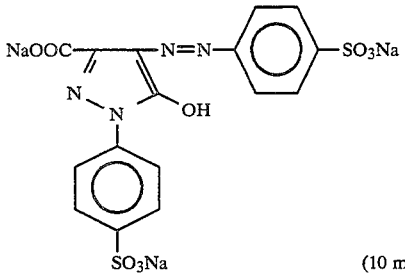

(10 mg/m$^2$)

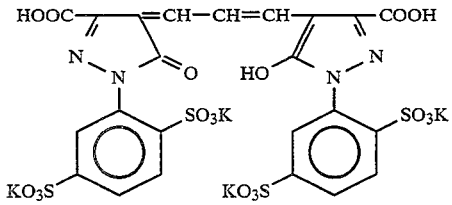

(10 mg/m$^2$)

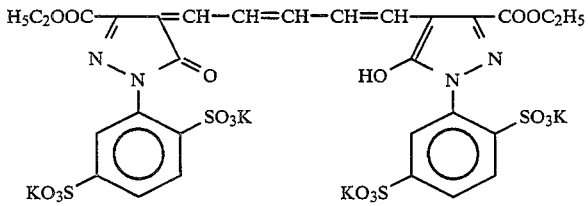

(40 mg/m$^2$)

and

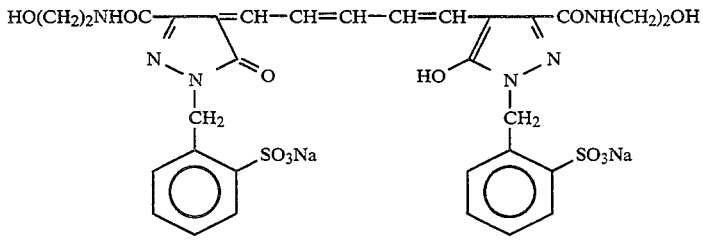

(20 mg/m$^2$)

(Composition of layers)

The composition of each layer is shown below. The figures represent coating amount (g/m$^2$). The coating amount of each halide emulsion is given in terms of silver.

| | |
|---|---|
| Supporting base | |
| Polyethylene laminated paper (a white pigment, $TiO_2$, and a bluing dye, ultramarine, were included in the polyethylene film of the first layer side) | |
| First layer (Blue-sensitive emulsion layer) | |
| The above-described silver chlorobromide emulsion $\alpha$-$B_1$ | 0.30 |
| Gelatin | 1.86 |
| Yellow coupler (ExY) | 0.82 |
| Image-dye stabilizer (Cpd-1) | 0.19 |
| Solvent (Solv-3) | 0.18 |
| Solvent (Solv-7) | 0.18 |
| Image-dye stabilizer (Cpd-7) | 0.06 |
| Second layer (Color-mix preventing layer) | |
| Gelatin | 0.99 |
| Color-mix inhibitor (Cpd-5) | 0.08 |
| Solvent (Solv-1) | 0.16 |
| Solvent (Solv-4) | 0.08 |
| Third layer (Green-sensitive emulsion layer) | |
| The above-described silver chlorobromide emulsion $\gamma$-$G_1$ | 0.12 |
| Gelatin | 1.24 |
| Magenta coupler (ExM) | 0.23 |
| Image-dye stabilizer (Cpd-2) | 0.03 |
| image-dye stabilizer (Cpd-3) | 0.16 |
| Image-dye stabilizer (Cpd-4) | 0.02 |
| Image-dye stabilizer (Cpd-9) | 0.02 |
| Solvent (Solv-2) | 0.40 |
| Fourth layer (Ultraviolet ray absorbing layer) | |
| Gelatin | 1.58 |
| Ultraviolet ray absorber (UV-1) | 0.47 |
| Color-mix inhibitor (Cpd-5) | 0.05 |
| Solvent (Solv-5) | 0.24 |
| Fifth layer (Red-sensitive emulsion later) | |
| The above-described silver chlorobromide emulsion) $\gamma$-$R_1$ | 0.23 |
| Gelatin | 1.34 |
| Cyan coupler (ExC) | 0.32 |
| Image-dye stabilizer (Cpd-2) | 0.03 |
| Image-dye stabilizer (Cpd-4) | 0.02 |
| Image-dye stabilizer (Cpd-6) | 0.18 |
| Image-dye stabilizer (Cpd-7) | 0.40 |
| Image-dye stabilizer (Cpd-8) | 0.05 |
| Solvent (Solv-6) | 0.14 |
| Sixth layer (Ultraviolet ray absorbing layer) | |
| Gelatin | 0.53 |
| Ultraviolet ray absorber (UV-1) | 0.16 |
| Color-mix inhibitor (Cpd-5) | 0.02 |
| Solvent (Solv-5) | 0.08 |
| Seventh layer (Protective layer) | |
| Gelatin | 1.33 |
| Acryl-modified copolymer of polyvinyl alcohol (modification degree: 17%) | 0.17 |
| Liquid paraffin | 0.03 |

Compounds used are as follows:

(ExY) Yellow coupler
The same as (ExY) in Example 3
(ExM) Magenta coupler
The same as (ExM) in Example 3
(ExC) Cyan coupler
The same as (ExC) in Example 3
(Cpd-1) Image-dye stabilizer
The same as (Cpd-1) in Example 3
(Cpd-2) Image-dye stabilizer
The same as (Cpd-2) in Example 3
(Cpd-3) Image-dye stabilizer
The same as (Cpd-3) in Example 3
(Cpd-4) Image-dye stabilizer
The same as (Cpd-4) in Example 3
(Cpd-5) Color-mix inhibitor
The same as (Cpd-5) in Example 3
(Cpd-6) Image-dye stabilizer
The same as (Cpd-6) in Example 3
(Cpd-7) Image-dye stabilizer
The same as (Cpd-7) in Example 3
(Cpd-8) Image-dye stabilizer
The same as (Cpd-8) in Example 3
(Cpd-9) Image-dye stabilizer
The same as (Cpd-9) in Example 3
(Cpd-10) Antiseptic
The same as (Cpd-10) in Example 3
(Cpd-11) Antiseptic
The same as (Cpd-11) in Example 3
(UV-1) Ultraviolet ray absorber
The same as (UV-1) in Example 3
(Solv-1) Solvent
The same as (Solv-1) in Example 3
(Solv-2) Solvent
The same as (Solv-2) in Example 3
(Solv-3) Solvent
The same as (Solv-3) in Example 3
(Solv-4) Solvent
The same as (Solv-4) in Example 3
(Solv-5) Solvent
The same as (Solv-5) in Example 3
(Solv-6) Solvent
The same as (Solv-6) in Example 3
(Solv-7) Solvent
The same as (Solv-7) in Example 3

Samples were prepared in the same composition as Sample A, except that the emulsion of the first layer (blue-sensitive emulsion layer) was exchanged silver chlorobromide emulsion $\alpha$-$B_1$ with equal amount of each above-described silver halide emulsion, the epoxy compound of the present invention was added in the first layer (blue-sensitive emulsion layer) besides Solv-3 and Solv-7 as solvent, and the mercapto compound represented by the above-described formula (IV) in amount of $8.5\times10^{-5}$ mol per mol of silver halide was added in the first layer (blue-sensitive emulsion layer), as each of them is shown in Table 11.

TABLE 11

| Color print paper | Silver halide emulsion | Epoxy compound NO. | Epoxy compound coating amount (g/m$^2$) | Mercapto compound of formula (IV) | Remarks |
|---|---|---|---|---|---|
| A | $\alpha$-$B_1$ | — | — | — | Comparative Example |
| B | $\alpha$-$B_2$ | — | — | — | Comparative Example |
| C | $\alpha$-$B_1$ | I-2 | 0.18 | — | Comparative Example |
| D | $\gamma$-$B_2$ | — | — | — | Comparative Example |
| E | $\gamma$-$B_1$ | I-2 | 0.18 | — | Comparative Example |
| F | $\gamma$-$B_4$ | I-2 | 0.18 | IV-2-6 | Comparative Example |
| G | $\beta$-$B_1$ | II-1 | 0.18 | IV-2-6 | Comparative Example |
| H | $\gamma$-$B_3$ | — | — | IV-2-6 | Comparative Example |
| I | $\alpha$-$B_2$ | I-2 | 0.18 | — | This Invention |
| J | $\alpha$-$B_2$ | II-1 | 0.18 | — | This Invention |

TABLE 11-continued

| Color print paper | Silver halide emulsion | Epoxy compound NO. | Epoxy compound coating amount (g/m²) | Mercapto compound of formula (IV) | Remarks |
|---|---|---|---|---|---|
| K | β-B2 | II-2 | 0.18 | — | This Invention |
| L | γ-B2 | I-2 | 0.09 | — | This Invention |
| M | γ-B2 | I-2 | 0.18 | — | This Invention |
| N | γ-B2 | I-2 | 0.18 | IV-2-6 | This Invention |
| O | γ-B2 | I-2 | 0.18 | IV-1-2 | This Invention |
| P | γ-B2 | II-2 | 0.18 | IV-2-6 | This Invention |
| Q | γ-B2 | III-2 | 0.18 | IV-2-5 | This Invention |
| R | γ-B3 | I-4 | 0.09 | — | This Invention |
| S | γ-B3 | III-2 | 0.18 | — | This Invention |
| T | γ-B3 | III-2 | 0.18 | IV-2-5 | This Invention |
| U | γ-B5 | I-6 | 0.09 | — | This Invention |
| V | γ-B5 | I-6 | 0.18 | — | This Invention |
| W | γ-B5 | I-6 | 0.18 | IV-3-2 | This Invention |
| X | γ-B6 | II-1 | 0.18 | — | This Invention |
| Y | γ-B6 | II-1 | 0.18 | IV-4-4 | This Invention |
| Z | γ-B6 | III-2 | 0.18 | IV-1-3 | This Invention |

Each samples was subjected to the same exposure to light and processing as in Example 3.

With respect to samples that had been given gradation exposure by using separation filters, the processed photographic print papers were dipped in a 1N citric acid solution for 1 min, then they were dried and allowed to stand at 80° C. or 40° C. and 70% RH for 3 days, and the drop of the yellow density from the initial density of 2.0 was determined to test the fastness of the yellow dye image under acidic conditions.

At the same time, other processed photographic papers were allowed to stand at 80° C. and 70% RH for 2 weeks, and the drop of the yellow density from the initial density of 2.0 was determined to test the heat and humidity fastness of the yellow dye image.

With respect to samples that had been subjected to gray exposure, they were processed 3 days after the exposure and the extent of the unevenness of the development of the processed photographic papers was evaluated visually.

<visual evaluation>

◎: there was no unevenness of the development at all.

○: there was almost no unevenness of the development.

Δ: there was a little tendency of unevenness of the development.

X: there was conspicuous unevenness of the development.

Results are shown in Table 12.

TABLE 12

| Color print paper | Acid-fading* 80° C. 3 days | Acid-fading* 40° C., 70% RH 3 days | Humidity & heat-fading* 80° C., 70% H 2 weeks | Degree of developing unevenness | Remarks |
|---|---|---|---|---|---|
| A | 0.31 | 0.46 | 0.25 | ○ | Comparative Example |
| B | 0.33 | 0.44 | 0.24 | ○ | Comparative Example |
| C | 0.17 | 0.18 | 0.17 | X | Comparative Example |
| D | 0.31 | 0.45 | 0.26 | ◎ | Comparative Example |
| E | 0.14 | 0.17 | 0.17 | Δ | Comparative Example |
| F | 0.13 | 0.13 | 0.15 | X | Comparative Example |
| G | 0.14 | 0.14 | 0.15 | X | Comparative Example |
| H | 0.30 | 0.41 | 0.26 | ◎ | Comparative Example |
| I | 0.16 | 0.17 | 0.16 | ○ | This Invention |
| J | 0.17 | 0.17 | 0.16 | ○ | This Invention |
| K | 0.12 | 0.15 | 0.14 | ○ | This Invention |
| L | 0.11 | 0.15 | 0.15 | ◎ | This Invention |
| M | 0.12 | 0.15 | 0.14 | ◎ | This Invention |
| N | 0.09 | 0.12 | 0.14 | ◎ | This Invention |
| O | 0.10 | 0.11 | 0.15 | ◎ | This Invention |
| P | 0.11 | 0.12 | 0.14 | ◎ | This Invention |
| Q | 0.09 | 0.12 | 0.14 | ◎ | This Invention |
| R | 0.12 | 0.12 | 0.14 | ◎ | This Invention |
| S | 0.12 | 0.15 | 0.15 | ○ | This Invention |
| T | 0.09 | 0.11 | 0.13 | ◎ | This Invention |
| U | 0.12 | 0.12 | 0.13 | ◎ | This Invention |
| V | 0.12 | 0.13 | 0.14 | ◎ | This Invention |
| W | 0.09 | 0.12 | 0.15 | ◎ | This Invention |
| X | 0.10 | 0.12 | 0.14 | ○ | This Invention |
| Y | 0.11 | 0.13 | 0.14 | ◎ | This Invention |
| Z | 0.10 | 0.11 | 0.11 | ◎ | This Invention |

Note;
*decrement of density from an initial density 2.0 (value the smaller, the better)

As is apparent from the results shown in Table 12, the yellow dye image of the color photographic papers that use an epoxy compound of the present invention is excellent in acid fastness and heat and humidity fastness. Further only when an epoxy compound is used in combination with a gold-sensitized emulsion, is the acid fastness and the heat and humidity fastness excellent, and unevenness of the development does not occur even when the development processing of the sample is carried several days after the exposure to light. It is also clear that this effect is emphasized when a high-silver-chloride emulsion and a mercapto compound are used.

EXAMPLE 7

Samples as shown in Table 13 were prepared in the same composition of the color print paper A in Example 6, except that, instead of the silver chlorobromide emulsion α-$B_1$ used in the first layer (blue-sensitive emulsion layer) of the color photographic paper A, the silver halide emulsions above-described each in the same amount were used, an epoxy compound of the present was further added to the second layer (color-mix preventing layer) in addition to Solv-1 and Solv-2 as solvents, and a mercapto compound of formula (IV) was added to the first layer (blue-sensitive emulsion layer) in an amount of $8.5\times10^{-5}$ mol per mol of the silver halide. The exposure to light, the processing, and the evaluation were conducted similarly to Example 6.

Results are shown in Table 14.

TABLE 13

| Color print paper | Silver halide emulsion | Epoxy compound NO. | Epoxy compound coating amount (g/m²) | Mercapto compound of formula (IV) | Remarks |
|---|---|---|---|---|---|
| a | γ-$B_1$ | — | — | — | Comparative Example |
| b | γ-$B_1$ | I-2 | 0.18 | — | Comparative Example |
| c | γ-$B_2$ | — | — | — | Comparative Example |
| d | γ-$B_2$ | — | — | IV-2-6 | Comparative Example |
| e | γ-$B_4$ | I-2 | 0.18 | IV-2-6 | Comparative Example |
| f | α-$B_2$ | I-2 | 0.09 | — | This Invention |
| g | α-$B_2$ | II-1 | 0.18 | — | This Invention |
| h | β-$B_2$ | I-2 | 0.18 | — | This Invention |
| i | β-$B_2$ | III-2 | 0.18 | IV-2-6 | This Invention |
| j | γ-$B_2$ | II-2 | 0.09 | — | This Invention |
| k | γ-$B_2$ | II-2 | 0.18 | — | This Invention |
| l | γ-$B_2$ | II-2 | 0.18 | IV-2-6 | This Invention |
| m | γ-$B_3$ | III-2 | 0.09 | IV-1-5 | This Invention |
| n | γ-$B_3$ | III-2 | 0.18 | IV-3-2 | This Invention |
| o | γ-$B_5$ | I-4 | 0.18 | IV-2-5 | This Invention |
| p | γ-$B_6$ | I-4 | 0.18 | IV-2-2 | This Invention |

TABLE 14

| Color print paper | Acid-fading* 80° C. 3 days | Acid-fading* 40° C., 70% RH 3 days | Humidity & heat-fading* 80° C., 70% H 2 weeks | Degree of developing unevenness | Remarks |
|---|---|---|---|---|---|
| a | 0.33 | 0.49 | 0.25 | ○ | Comparative Example |
| b | 0.12 | 0.15 | 0.15 | X | Comparative Example |
| c | 0.30 | 0.47 | 0.24 | ○ | Comparative Example |
| d | 0.31 | 0.45 | 0.24 | ◎ | Comparative Example |
| e | 0.14 | 0.14 | 0.15 | Δ | Comparative Example |
| f | 0.14 | 0.16 | 0.17 | ○ | This Invention |
| g | 0.15 | 0.15 | 0.17 | ○ | This Invention |
| h | 0.10 | 0.15 | 0.14 | ○ | This Invention |
| i | 0.09 | 0.15 | 0.15 | ◎ | This Invention |
| j | 0.11 | 0.16 | 0.14 | ◎ | This Invention |
| k | 0.10 | 0.14 | 0.15 | ○ | This Invention |
| l | 0.09 | 0.15 | 0.13 | ○ | This Invention |
| m | 0.10 | 0.13 | 0.16 | ◎ | This Invention |
| n | 0.10 | 0.12 | 0.15 | ◎ | This Invention |
| o | 0.09 | 0.13 | 0.14 | ○ | This Invention |
| p | 0.09 | 0.11 | 0.15 | ◎ | This Invention |

Note;
*decrement of density from an initial density 2.0 (value the smaller, the better)

As is apparent from the results shown in Table 14, the yellow dye image of the color photographic papers that use an epoxy compound of the present invention is excellent in acid fastness and heat and humidity fastness. Further only when an epoxy compound is used in combination with a gold-sensitized emulsion, is the acid fastness and the heat and humidity fastness excellent, and unevenness of the development does not occur even when the development processing of the sample is carried several days after the exposure to light. It is also clear that this effect is emphasized when a high-silver-chloride emulsion and a mercapto compound are used.

EXAMPLE 8

Samples as shown in Table 15 were prepared in the same composition of the color print paper A in Example 6, except that, instead of the silver chlorobromide emulsion α-$B_1$ used in the first layer (blue-sensitive emulsion layer) of the color photographic paper A, the emulsion γ-$B_1$ in the same amount was used; instead of the silver chlorobromide emulsion γ-$G_1$ used in the third layer (green-sensitive emulsion layer), the above-described silver halide emulsions each in the same amount was used; an epoxy compound of the present invention was further added to the third layer (green-sensitive emulsion layer) in addition to Solv-2 as solvents; and a mercapto compound of formula (IV) above-described was added to the second layer (color-mix preventing layer) in an amount of 2.1 mg/m². The exposure to light, the processing, and the evaluation were conducted similarly to Example 6.

Results are shown in Table 16.

TABLE 15

| Color print paper | Silver halide emulsion | Epoxy compound NO. | Epoxy compound coating amount (g/m²) | Mercapto compound of formula (IV) | Remarks |
|---|---|---|---|---|---|
| $A_3$ | α-$G_1$ | — | — | — | Comparative Example |
| $B_3$ | β-$G_2$ | — | — | — | Comparative Example |
| $C_3$ | γ-$G_3$ | — | — | IV-2-6 | Comparative Example |
| $D_3$ | γ-$G_1$ | I-2 | 0.18 | — | Comparative Example |
| $E_3$ | γ-$G_4$ | II-1 | 0.18 | IV-2-6 | Comparative Example |
| $F_3$ | γ-$G_4$ | III-2 | 0.18 | IV-3-2 | Comparative Example |
| $G_3$ | α-$G_2$ | I-2 | 0.09 | — | This Invention |
| $H_3$ | β-$G_2$ | II-2 | 0.18 | — | This Invention |
| $I_3$ | β-$G_2$ | II-1 | 0.18 | IV-2-6 | This Invention |
| $J_3$ | γ-$G_2$ | I-2 | 0.09 | — | This Invention |
| $K_3$ | γ-$G_2$ | I-2 | 0.18 | — | This Invention |
| $L_3$ | γ-$G_2$ | I-2 | 0.18 | IV-2-6 | This Invention |
| $M_3$ | γ-$G_3$ | III-1 | 0.09 | — | This Invention |
| $N_3$ | γ-$G_3$ | III-1 | 0.09 | IV-2-1 | This Invention |
| $O_3$ | γ-$G_3$ | I-4 | 0.18 | IV-4-3 | This Invention |
| $P_3$ | γ-$G_5$ | I-3 | 0.09 | — | This Invention |
| $Q_3$ | γ-$G_5$ | I-3 | 0.18 | — | This Invention |
| $R_3$ | γ-$G_6$ | II-1 | 0.09 | — | This Invention |
| $S_3$ | γ-$G_6$ | II-2 | 0.18 | IV-2-6 | This Invention |
| $T_3$ | γ-$G_6$ | III-3 | 0.18 | IV-1-3 | This Invention |

TABLE 16

| Color print paper | Acid-fading* 80° C. 3 days | Acid-fading* 40° C., 70% RH 3 days | Humidity & heat-fading* 80° C., 70% H 2 weeks | Degree of developing unevenness | Remarks |
|---|---|---|---|---|---|
| $A_3$ | 0.32 | 0.45 | 0.24 | ○ | Comparative Example |
| $B_3$ | 0.35 | 0.40 | 0.22 | ○ | Comparative Example |
| $C_3$ | 0.29 | 0.40 | 0.23 | ◎ | Comparative Example |
| $D_3$ | 0.14 | 0.16 | 0.18 | X | Comparative Example |
| $E_3$ | 0.14 | 0.15 | 0.17 | Δ | Comparative Example |
| $F_3$ | 0.13 | 0.15 | 0.16 | Δ | Comparative Example |
| $G_3$ | 0.15 | 0.17 | 0.17 | ◎ | This Invention |
| $H_3$ | 0.12 | 0.15 | 0.14 | ◎ | This Invention |
| $I_3$ | 0.12 | 0.13 | 0.15 | ◎ | This Invention |
| $J_3$ | 0.13 | 0.14 | 0.16 | ◎ | This Invention |
| $K_3$ | 0.12 | 0.13 | 0.15 | ○ | This Invention |
| $L_3$ | 0.09 | 0.11 | 0.15 | ◎ | This Invention |
| $M_3$ | 0.13 | 0.15 | 0.15 | ◎ | This Invention |
| $N_3$ | 0.12 | 0.14 | 0.14 | ◎ | This Invention |
| $O_3$ | 0.10 | 0.14 | 0.13 | ◎ | This Invention |
| $P_3$ | 0.13 | 0.14 | 0.16 | ◎ | This Invention |
| $Q_3$ | 0.13 | 0.15 | 0.15 | ○ | This Invention |
| $R_3$ | 0.13 | 0.13 | 0.15 | ◎ | This Invention |
| $S_3$ | 0.09 | 0.13 | 0.15 | ◎ | This Invention |
| $T_3$ | 0.09 | 0.12 | 0.14 | ◎ | This Invention |

Note;
*decrement of density from an initial density 2.0 (value the smaller, the better)

As is apparent from the results shown in Table 16, the yellow dye image of the color photographic papers that use an epoxy compound of the present invention is excellent in acid fastness and heat and humidity fastness. Further only when an epoxy compound is used in combination with a gold-sensitized emulsion, is the acid fastness and the heat and humidity fastness excellent, and unevenness of the development does not occur even when the development processing of the sample is carried several days after the exposure to light. It is also clear that this effect is emphasized when a high-silver-chloride emulsion and a mercapto compound are used.

Having described our invention as related to the present embodiments, it is our intention that the invention should not be limited by any of the details of the description, unless otherwise specified, but rather be construed broadly within its spirit and scope as set out in the accompanying claims.

What we claim is:

1. A silver halide color photographic material, which comprises at least one sparingly water-soluble epoxy compound represented by the following formula (I) and a silver halide emulsion containing silver chlorobromoiodide grains, silver chlorobromide grains, or silver chloride grains comprising 90 mol % or more of silver chloride, said silver chlorobromoiodide grains, silver chlorobromide grains, or silver chloride grains containing at least one metal ion of Group VIII of the Periodic Table in an amount of $10^{-9}$ to $10^{-2}$ mol per mol of the silver halide:

Formula (I)

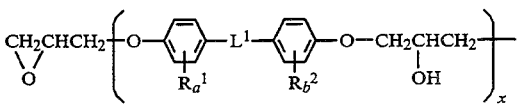

-continued

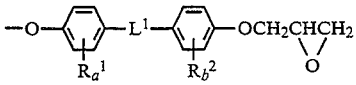

wherein $R^1$ and $R^2$ each represent an alkyl group or a halogen atom; $L^1$ represents a divalent aliphatic group; a and b each are an integer of 0 to 4; and x is an actual number of 0 to 20; said at least one sparingly water-soluble epoxy compound represented by formula (I) is incorporated into at least one coupler containing layer.

2. The silver halide color photographic material as claimed in claim 1, wherein the metal ion is selected from the group consisting of iron ion, iridium ion, platinum ion, palladium ion, nickel ion, rhodium ion, osmium ion, and ruthenium ion.

3. The silver halide color photographic material as claimed in claim 1, wherein the metal ion of Group VIII of the Periodic Table is an iron ion.

4. The silver halide color photographic material as claimed in claim 3, wherein an iron ion localized layer where the concentration of the iron ions is at least 10 times higher than other parts exists on the surface layer constituting 50% or less of the grain volume.

5. The silver halide color photographic material as claimed in claim 1, wherein the epoxy compound represented by formula (I) is added in an amount of 0.001 to 10 g per $m^2$ of the silver halide color photographic material.

6. The silver halide color photographic material as claimed in claim 1, wherein the silver halide emulsion comprises a silver chlorobromide emulsion substantially free from silver iodide and having a silver chloride content of 95 mol % or more, said silver chlorobromide having a silver bromide localized phase which has a silver bromide content of at least 10 mol % and is localized near the surfaces of the silver halide grains.

7. The silver halide color photographic materials as claimed in claim 1, wherein the silver halide color photographic material contains a support having thereon photographic constituting-layers comprising at least a non-photosensitive hydrophilic layer and at least a photosensitive silver halide emulsion layer, said sparingly water-soluble epoxy compound is incorporated in at least one of said photographic constituting layers.

8. The silver halide color photographic material as claimed in claim 7, wherein said sparingly water-soluble epoxy compound is incorporated in a yellow coupler-containing layer or a cyan coupler-containing layer.

9. The silver halide color photographic material as claimed in claim 7, wherein said sparingly water-soluble epoxy compound is incorporated in a yellow coupler-containing layer.

10. The silver halide color photographic material as claimed in claim 1, wherein the sparingly water-soluble epoxy compound and a color forming coupler are incorporated into an oil droplet.

11. A silver halide color photographic material comprising at least one sparingly water-soluble epoxy compound represented by the following formula (I) and a silver chlorobromide emulsion substantially free from silver iodide and having a silver chloride content of 95 mol % or more, said silver chlorobromide having a silver bromide localized phase which has a silver bromide content of at least 10 mol % and is located near the surfaces of the silver halide grains, and the surface of said silver halide grains being chemically sensitized:

Formula (I)

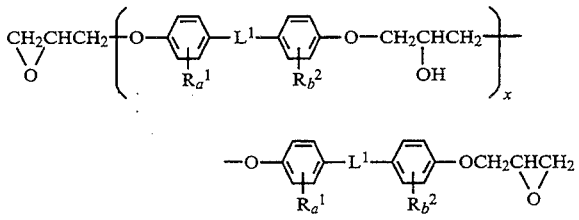

wherein $R^1$ and $R^2$ each represent a substituted or unsubstituted alkyl group or a halogen atom; $L^1$ represents a divalent aliphatic group, which may be substituted or unsubstituted; a and b each are an integer of 0 to 4; and x is an actual number of 0 to 20; said sparingly water-soluble epoxy compound is incorporated into at least one coupler containing layer.

12. The silver halide color photographic material as claimed in claim 11, wherein the epoxy compound represented by formula (I) is added in an amount of 0.001 to 10 g per $m^2$ of the silver halide color photographic material.

13. The silver halide color photographic material as claimed in claim 11, wherein said silver halide grains contain an iridium compound.

14. The silver halide color photographic material as claimed in claim 13, wherein the iridium compound is present in an amount of $10^{-9}$ to $10^{-4}$ mol per mol of silver halide.

15. The silver halide color photographic material as claimed in claim 11, wherein said silver halide grains contain at least one metal complex comprising a central metal ion of Fe, Ru, Rh, Re, Os, Ir, Pt or Au and at least two cyan-ligands.

16. The silver halide color photographic material as claimed in claim 15, wherein at least one metal complex comprising at least two cyan-ligands is added during the preparation of said silver halide grains.

17. The silver halide color photographic material as claimed in claim 11, wherein the formation of localized phase high in silver bromide content is conducted in the presence of an iridium compound.

18. The silver halide color photographic material as claimed in claim 11, wherein the silver halide color photographic material contains a support having thereon photographic constituting-layers comprising at least,a non-photosensitive hydrophilic layer and at least a photosensitive silver halide emulsion layer, said sparingly water-soluble epoxy compound being incorporated in at least one of said photographic constituting layers.

19. The silver halide color photographic material as claimed in claim 11, wherein said sparingly water-soluble epoxy compound is incorporated in a yellow coupler-containing layer or a cyan coupler-containing layer.

20. The silver halide color photographic material as claimed in claim 11, wherein said sparingly water-soluble epoxy compound is incorporated in a yellow coupler-containing layer.

21. The silver halide color photographic material as claimed in claim 11, wherein the epoxy compound represented by formula (I) is used in combination with a cyan coupler represented by the following formula (V) and a yellow coupler represented by the following formula (VI):

Formula (V)

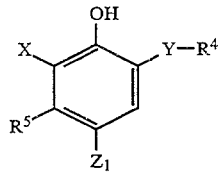

wherein Y represents —NHCO— or —CONH—, $R^4$ represents an aliphatic group, an aromatic group, a heterocyclic group, or an amino group, X represents a hydrogen atom, a halogen atom, an alkoxy group, or an acylamino group, $R^5$ represents an alkyl group or an acylamino group or a group of atoms required to form a 5- to 7-membered ring together with X, and $Z_1$ represents a hydrogen atom or a group capable of being released when it reacts with the oxidized product of a developing agent, Formula (VI)

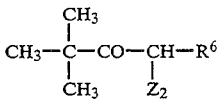

wherein $R^6$ represents an N-arylcarbamoyl group and $Z_2$ represents a group capable of being released upon a reaction thereof with the oxidized product of an aromatic primary amine developing agent.

22. The silver halide color photographic material as claimed in claim 11, wherein the sparingly water-soluble epoxy compound and a color forming coupler are incorporated into an oil droplet.

23. A silver halide color photographic material containing a support having thereon photographic constituting layers comprising at least a non-photosensitive hydrophilic layer and at least a photosensitive silver halide emulsion layer, said silver halide emulsion being sensitized by a gold compound, wherein the silver halide emulsion comprises a silver chlorobromide emulsion substantially free from silver iodide and having a silver chloride content of 95 mol % or more, which has been obtained by forming localized phases located near the surfaces of silver halide grains that have a silver bromide content of at least 10 mol % and then chemically sensitizing the surfaces, and at least one sparingly water-soluble epoxy compound represented by the following formula (I):

Formula (I)

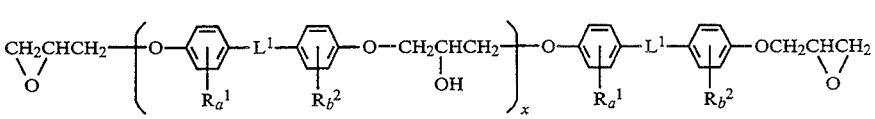

wherein $R^1$ and $R^2$ each represent a substituted or unsubstituted alkyl group or a halogen atom; $L^1$ represents a divalent aliphatic group, which may be substituted or unsubstituted; a and b each are an integer of 0 to 4; and x is an actual number of 0 to 20, said sparingly water-soluble epoxy compound is incorporated into at least one coupler containing layer.

24. The silver halide color photographic material as claimed in claim 23, wherein the epoxy compound represented by formula (I) is added in an amount of 0.001 to 10 g per $m^2$ of the silver halide color photographic material.

25. The silver halide color photographic material as claimed in claim 23, wherein said silver halide emulsion contains silver chlorobromide or silver chloride comprising 90 mol % or more of silver chloride and being substantially free from silver iodide.

26. The silver halide color photographic material as claimed in claim 23, wherein at least one photographic constituting layer contains a compound represented by the following formula (IV):

Formula (IV)

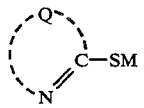

wherein Q represents an atomic group required to form a 5- or 6-membered heterocyclic ring, or 5- or 6-membered heterocyclic ring with condensed benzene ring, and M represents a hydrogen atom or a cation.

27. The silver halide color photographic material as claimed in claim 26, wherein the amount of the compound represented by formula (IV) to be added is $1\times10^{-5}$ to $5\times10^{-2}$ mol per mol of silver halide.

28. The silver halide color photographic material as claimed in claim 26, wherein the compound represented by formula (IV) is contained in a non-photosensitive hydrophilic layer between a yellow coupler-containing layer and a cyan coupler-containing layer.

29. The silver halide color photographic material as claimed in claim 23, wherein the silver halide emulsion contains silver chlorobromoiodide, silver chlorobromide, or silver chloride comprising 90 mol % or more of silver chloride.

30. The silver halide color photographic material as claimed in claim 23, wherein said sparingly water-soluble epoxy compound is incorporated in a yellow coupler-containing layer or a cyan coupler-containing layer.

31. The silver halide color photographic material as claimed in claim 23, wherein said sparingly water-soluble epoxy compound is incorporated in a yellow coupler-containing layer.

32. The silver halide color photographic material as claimed in claim 23, wherein the amount of gold compound to be added is $1\times10^{-7}$ to $1\times10^{-2}$ mol per mol of silver halide.

33. The silver halide color photographic material as claimed in claim 23, wherein the sparingly water-soluble epoxy compound and a color forming coupler are incorporated into an oil droplet.

34. A silver halide color photographic material, which comprises at least one sparingly water-soluble epoxy compound represented by the following formula (II), and a silver halide emulsion containing silver chlorobromoiodide grains, silver chlorobromide grains, or silver chloride grains comprising 90 mol % or more of silver chloride, said silver chlorobromoiodide grains, silver chlorobromide grains, or silver chloride grains containing at least one metal ion of Group VIII of the Periodic Table in an amount of $10^{-9}$ to $10^{-2}$ mol per mol of the silver halide:

Formula (II)

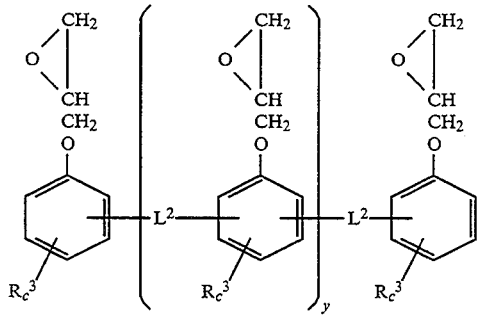

wherein $R^3$ represents an alkyl group or a halogen atom; $L^2$ represents a divalent aliphatic group; c is an integer of 0 to 4; and y is an actual number of 0 to 20; said at least one sparingly water-soluble epoxy compound represented by formula (II) is incorporated into at least one coupler containing layer.

35. The silver halide color photographic material as claimed in claim 34, wherein the sparingly water-soluble epoxy compound and a color forming coupler are incorporated into an oil droplet.

36. The silver halide color photographic material as claimed in claim 34, wherein the metal ion is selected from the group consisting of iron ion, iridium ion, platinum ion, palladium ion, nickel ion, rhodium ion, osmium ion, and ruthenium ion.

37. The silver halide color photographic material as claimed in claim 34, wherein the metal ion of Group VIII of the Periodic Table is an iron ion.

38. The silver halide color photographic material as claimed in claim 37, wherein an iron ion localized layer where the concentration of the iron ions is at least 10 times higher than other parts exists on the surface layer constituting 50% or less of the grain volume.

39. The silver halide color photographic material as claimed in claim 34, wherein the epoxy compound represented by formula (II) is added in an amount of 0.001 to 10 g per $m^2$ of the silver halide color photographic material.

40. The silver halide color photographic material as claimed in claim 34, wherein the silver halide emulsion comprises a silver chlorobromide emulsion substantially free from silver iodide and having a silver chloride content of 95 mol % or more, said silver chlorobromide having a silver bromide localized phase which has a silver bromide content of at least 10 mol % and is localized near the surfaces of the silver halide grains.

41. The silver halide color photographic materials as claimed in claim 34, wherein the silver halide color photographic material contains a support having thereon photographic constituting-layers comprising at least a non-photosensitive hydrophilic layer and at least a photosensitive silver halide emulsion layer, said sparingly water-soluble epoxy compound is incorporated in at least one of said photographic constituting layers.

42. The silver halide color photographic material as claimed in claim 41, wherein said sparingly water-soluble epoxy compound is incorporated in a yellow coupler-containing layer or a cyan coupler containing layer.

43. The silver halide color photographic material as claimed in claim 41, wherein said sparingly water soluble epoxy compound is incorporated in a yellow coupler-containing layer.

44. A silver halide color photographic material comprising at least one sparingly water-soluble epoxy compound represented by the following formula (II) and a silver chlorobromide emulsion substantially free from silver iodide and having a silver chloride content of 95 mol % or more, said silver chlorobromide having a silver bromide localized phase which has a silver bromide content of at least 10 mol % and is located near the surfaces of the silver halide grains, and the surface of said silver halide grains being chemically sensitized:

Formula (II)

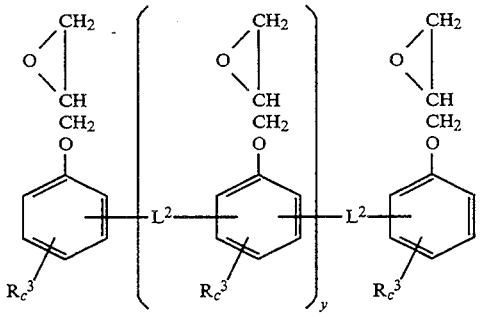

wherein $R^3$ represents a substituted or unsubstituted alkyl group or a halogen atom; $L^2$ represents a divalent aliphatic group, which may be substituted or unsubstituted; c is an integer of 0 to 4; and y is an actual number of 0 to 20; said sparingly water-soluble epoxy compound is incorporated into at least one coupler containing layer.

45. The silver halide color photographic material as claimed in claim 44, wherein the epoxy compound represented by formula (II) is added in an amount of 0.001 to 10 g per $m^2$ of the silver halide color photographic material.

46. The silver halide color photographic material as claimed in claim 44, wherein said silver halide grains contain an iridium compound.

47. The silver halide color photographic material as claimed in claim 46, wherein the iridium compound is present in an amount of $10^{-9}$ to $10^{-4}$ mol per mol of silver halide.

48. The silver halide color photographic material as claimed in claim 44, wherein said silver halide grains contain at least one metal complex comprising a central metal ion of Fe, Ru, Rh, Re, Os, Ir, Pt or Au and at least two cyan-ligands.

49. The silver halide color photographic material as claimed in claim 48, wherein at least one metal complex comprising at least two cyan-ligands is added during the preparation of said silver halide grains.

50. The silver halide color photographic material as claimed in claim 44, wherein the formation of localized phase high in silver bromide content is conducted in the presence of an iridium compound.

51. The silver halide color photographic material as claimed in claim 44, wherein the silver halide color photographic material contains a support having thereon photographic constituting-layers comprising at least a non-photosensitive hydrophilic layer and at least a photosensitive silver halide emulsion layer, said sparingly water-soluble epoxy compound being incorporated in at least one of said photographic constituting layers.

52. The silver halide color photographic material as claimed in claim 44, wherein said sparingly water-soluble epoxy compound is incorporated in a yellow coupler-containing layer or a cyan coupler-containing layer.

53. The silver halide color photographic material as claimed in claim 44, wherein said sparingly water-soluble epoxy compound is incorporated in a yellow coupler-containing layer.

54. The silver halide color photographic material as claimed in claim 44, wherein the epoxy compound represented by formula (II) is used in combination with a cyan coupler represented by the following formula (V) and a yellow coupler represented by the following formula (VI):

Formula (V)

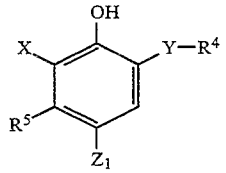

wherein Y represents —NHCO— or —CONH—, $R^4$ represents an aliphatic group, an aromatic group, a heterocyclic group, or an amino group, X represents a hydrogen atom, a halogen atom, an alkoxy group, or an acylamino group, $R^5$ represents an alkyl group or an acylamino group or a group of atoms required to form a 5- to 7-membered ring together with X, and $Z_1$ represents a hydrogen atom or a group capable of being released when it reacts with the oxidized product of a developing agent, Formula (V)

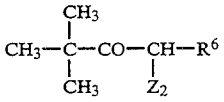

wherein $R^6$ represents an N-arylcarbamoyl group and $Z_2$ represents a group capable of being released upon a reaction thereof with the oxidized product of an aromatic primary amine developing agent.

55. The silver halide color photographic material as claimed in claim 44, wherein the sparingly water-soluble epoxy compound and a color forming coupler are incorporated into an oil droplet.

56. A silver halide color photographic material containing a support having thereon photographic constituting layers comprising at least a non-photosensitive hydrophilic layer and at least a photosensitive silver halide emulsion layer, said silver halide emulsion being sensitized by a gold compound, wherein the silver halide emulsion comprises a silver chlorobromide emulsion substantially free from silver iodide and having a silver chloride content of 95 mol % or more, which has been obtained by forming localized phases located near the surfaces of silver halide grains that have a silver bromide content of at least 10 mol % and then chemically sensitizing the surfaces, and at least one sparingly water-soluble epoxy compound represented by the following formula (II):

Formula (II)

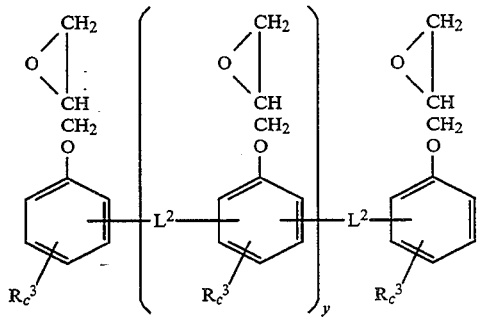

wherein $R^3$ represents a substituted or unsubstituted alkyl group or a halogen atom; $L^2$ represents a divalent aliphatic group, which may be substituted or unsubstituted; c is an integer of C to 4; and y is an actual number of 0 to 20; said sparingly water-soluble epoxy compound is incorporated into at least one coupler containing layer.

57. The silver halide color photographic material as claimed in claim 56, wherein the epoxy compound represented by formula (II) is added in an amount of 0.001 to 10 g per $m^2$ Of the silver halide color photographic material.

58. The silver halide color photographic material as claimed in claim 56, wherein said silver halide emulsion contains silver chlorobromide or silver chloride comprising 90 mol % or more of silver chloride and being substantially free from silver iodide.

59. The silver halide color photographic material as claimed in claim 56, wherein at least one photographic constituting layer contains a compound represented by the following formula (IV):

Formula (IV)

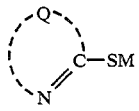

wherein Q represents an atomic group required to form a 5- or 6-membered heterocyclic ring, or 5- or 6-membered heterocyclic ring with condensed benzene ring, and M represents a hydrogen atom or a cation.

60. The silver halide color photographic material as claimed in claim 59, wherein the amount of the compound represented by formula (IV) to be added is $1\times10^{-5}$ to $5\times10^{-2}$ mol per mole of silver halide.

61. The silver halide color photographic material as claimed in claim 59, wherein the compound represented by formula (IV) is contained in a nonphotosensitive hydrophilic layer between a yellow coupler-containing layer and a cyan coupler-containing layer.

62. The silver halide color photographic material as claimed in claim 56, wherein the silver halide emulsion contains silver chlorobromoiodide, silver chlorobromide, or silver chloride comprising 90 mol % or more of silver chloride.

63. The silver halide color photographic material as claimed in claim 56, wherein said sparingly water-soluble epoxy compound is incorporated in a yellow coupler-containing layer or a cyan coupler-containing layer.

64. The silver halide color photographic material as claimed in claim 56, wherein said sparingly water-soluble epoxy compound is incorporated in a yellow coupler-containing layer.

65. The silver halide color photographic material as claimed in claim 56, wherein the amount of gold compound to be added is $1\times10^{-7}$ to $1\times10^{-2}$ mol per mol of silver halide.

66. The silver halide color photographic material as claimed in claim 56, wherein the sparingly water-soluble epoxy compound and a color forming coupler are incorporated into an oil droplet.

* * * * *